US007210763B2

(12) United States Patent
Kato et al.

(10) Patent No.: US 7,210,763 B2
(45) **Date of Patent: *May 1, 2007**

(54) INKJET RECORDING HEAD AND INKJET RECORDING DEVICE

(75) Inventors: Eiichi Kato, Kanagawa (JP); Takahiro Ishizuka, Kanagawa (JP)

(73) Assignee: Fujifilm Corporation, Minato-Ku, Tokyo (JP)

( * ) Notice: Subject to any disclaimer, the term of this patent is extended or adjusted under 35 U.S.C. 154(b) by 315 days.

This patent is subject to a terminal disclaimer.

(21) Appl. No.: 10/946,235

(22) Filed: Sep. 22, 2004

(65) Prior Publication Data

US 2005/0068367 A1 Mar. 31, 2005

(30) Foreign Application Priority Data

Sep. 24, 2003 (JP) ..... 2003-332159

(51) Int. Cl.
*B41J 2/135* (2006.01)

(52) U.S. Cl. ..... 347/45; 347/44; 347/20

(58) Field of Classification Search ..... 347/44, 347/45, 47, 46, 20
See application file for complete search history.

(56) References Cited

U.S. PATENT DOCUMENTS 5,010,356 A * 4/1991 Albinson ..... 347/45
6,302,523 B1 * 10/2001 Smith et al. ..... 347/45

FOREIGN PATENT DOCUMENTS

JP 9-221620 A 8/1997
JP 2001-233972 A 8/2001

* cited by examiner

*Primary Examiner*—Manish S. Shah
(74) *Attorney, Agent, or Firm*—Buchanan Ingersoll & Rooney PC

(57) ABSTRACT

To provide an inkjet recording head in which a high ink repelling property is kept even against the repeated use and which is excellent in film strength and abrasion resistance and is excellent with respect to printing quality of the resulting image, the inkjet recording head includes a nozzle having: a hole for discharging a recording liquid including an ink; and a portion capable of repelling the ink at the periphery of the hole, wherein the portion includes a cured film formed from a composition having a block copolymer, and the block copolymer includes a unit A and a unit B, wherein the unit A represents a block polymer (A) having at least one of a fluorine-containing polymer and a siloxane-containing polymer having a specific structure; and the unit B represents a block polymer (B) having a polyester polymer.

11 Claims, 1 Drawing Sheet

INKJET RECORDING HEAD AND INKJET RECORDING DEVICE

BACKGROUND OF THE INVENTION

1. Field of the Invention

The present invention relates to an inkjet recording head and an inkjet recording device using the same. In particular, the invention relates to a recording head in which the periphery of an ink discharge portion of the head is subjected to an ink repelling treatment and which is excellent in water repellency and abrasion resistance and excellent with respect to printing quality of the resulting image.

2. Background Art

A printer using an inkjet recording head for discharging an ink droplet from an ink discharge opening of a nozzle hole to form an image on recording paper is put into practical use and is characterized by silence and high-density printing. The printing quality of the image obtained by such an ink-jet recording head largely replies upon the position precision of dots constituting the image, which are composed of ink droplets on the recording paper. This position precision of dots is dominated by whether or not the flying direction of the ink droplet to be discharged from the ink discharge opening of the nozzle hole of the inkjet recording head is constant.

For the sake of keeping the flying direction of the ink droplet constant, it is important that the surrounding portion of the ink droplet discharge opening of the nozzle hole be in the uniform and stable surface state at the time of ink discharging, specifically it is important to realize the surface state of the surrounding portion of the ink droplet discharge opening of the nozzle hole, which is free from the matter that a part of the surrounding portion of the ink droplet discharge opening of the nozzle hole is wetted by the ink, or free from the occurrence of attachment of foreign matters such as paper powers.

In an inkjet recording head for discharging ink droplets, which are in general liquid, as small droplets from a discharge opening and attaching them to a material to be recorded such as paper to achieve recording or form an image, in order to more enhance the recording characteristic, attempts to increase the performance for smaller droplets, higher drive frequency, and the larger number of nozzles are being continued. Accordingly, a surface modification treatment for the purpose of keeping the surface state of the surrounding portion of the ink droplet discharge opening of the nozzle hole always constant becomes important more and more.

As a measure for keeping the surface state of the surrounding portion of the ink droplet discharge opening of the nozzle hole uniform and stable, there have hitherto been proposed the following two methods. That is, the first method is a method in which the nozzle plate surface including the nozzle hole and the surrounding portion of the ink droplet discharge opening of the nozzle hole is subjected to an ink repelling treatment; and the second method is a method in which in the case where an ink or foreign matters such as paper powders are attached to the surrounding portion of the ink droplet discharge opening of the nozzle hole, which has been subjected to an ink repelling treatment, the nozzle plate surface including the nozzle hole and the surrounding portion of the ink droplet discharge opening of the nozzle hole is wiped up (wiping operation) by a cleaning member made of a rubber blade, etc.

As the ink repelling treatment, there are proposed a variety of methods using water repellent materials such as fluorine-containing resins, siloxane resins, and fluorine-containing silane coupling agents. For example, there are disclosed a method of providing a plated film containing fine particles of a fluorine based resin, a method of providing a resin film containing fine particles of a fluorine based resin, a method of providing a film formed of a silicone based material, a method of providing a cured film of a fluorine based resin, and a method of providing a film made of a silane compound having a fluoroalkyl group.

In particular, as water repellent and oil repellent based resin cured films having high water repellency and oil repellency and being advantageous in film durability, there are proposed a cured film of a fluorine based resin and a heat curable epoxy resin (JP-A-11-138821 and JP-A-11-235826); a cured film formed of a fluoroolefin resin containing an active hydrogen atom-containing reactive group and an isocyanate curing agent (Japanese Patent No. 3,382,416); a cured film obtained from a self-crosslinking group-containing fluorine-containing resin and an acrylate based resin (JP-A-9-221620); and a cured film of a block copolymer constituted of a block containing a fluorine or siloxane water repellent and oil repellent component and a crosslinking group-containing non-water repellent and oil repellent block (JP-A-2001-233972).

SUMMERY OF THE INVENTION

On the other hand, in recent years, for the purpose of enhancing fixing property to paper, water resistance and the like of an ink, there is a trend to develop and use inks having enhanced wetting property. Thus, according to the conventional ink repelling treatment, in many cases, the ink repelling property is not sufficiently exhibited. This is a problem in achieving high precision and high image quality, and therefore, an improvement of the ink repelling property of the surroundings of the discharge opening is desired.

Also, as the inkjet recording becomes high in speed, not only durability against repeated cleaning by wiping of the conventional inkjet recording head but also more durability against rubbing between paper and an inkjet recording head portion at the time of high-speed traveling of the recorded paper are strongly desired.

However, it is a present state that according to the conventionally proposed technologies, these requirements are not sufficiently satisfied yet.

An object of the invention is to provide an ink-jet recording head in which a high ink repelling property is kept even against the repeated use and which is high in strength and excellent in abrasion resistance and is excellent with respect to printing quality of the resulting image.

Also, another object of the invention is to provide an inkjet recording device with an improved image quality, mounted with an inkjet recording head in which a high ink repelling property is kept even against the repeated use and which is high in strength and excellent in abrasion resistance.

For the sake of solving the foregoing problems, the present inventors made extensive and intensive investigations. As a result, it has been found that by combining a fluorine-containing polymer component or a polymer component having a siloxane structure with a polyester polymer component, the foregoing objects can be achieved, leading to accomplishment of the invention.

Specifically, the foregoing objects of the invention have been achieved by the following measures.

(1) An inkjet recording head, which comprises a nozzle having: a hole for discharging a recording liquid including an ink; and a portion capable of repelling the ink at the periphery of the hole, wherein the portion comprises a cured film formed from a composition comprising a block copolymer, and the block copolymer is at least one of: a block copolymer comprising a unit A and a unit B; a block copolymer comprising the unit A, the unit B and the unit A in this order; and a comb block copolymer comprising the unit A as a main chain and the unit B as a side chain, wherein the unit A represents a block polymer (A) comprising at least one of a fluorine-containing polymer and a siloxane-containing polymer that comprises at least one of a group represented by formula (SI) and a group represented by formula (SII):

Formula (SI)

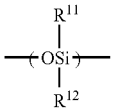

Formula (SII)

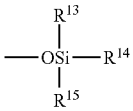

wherein $R^{11}$, $R^{12}$, $R^{13}$, $R^{14}$ and $R^{15}$ are the same or different and each represents an aliphatic group or an aromatic group; and the unit B represents a block polymer (B) comprising a polyester polymer.

(2) The inkjet recording head as set forth in (1), wherein the block copolymer has a reactive group, capable of contributing to crosslinking reaction, in at least one of a side chain substituent of the block polymer (A) and a main chain terminal of the block polymer (A); and the composition further comprises at least one of a curing agent and a curing accelerator.

(3) The inkjet recording head as set forth in (1) or (2), wherein the fluorine-containing polymer comprises at least one of a polymeric unit represented by formula (FI), a polymeric unit represented by formula (FII) and a polymeric unit represented by formula (FIII):

Formula (FI)

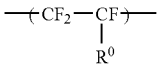

wherein $R^0$ represents a fluorine atom, a perfluoroalkyl group having from 1 to 8 carbon atoms, or an $—OR_f^1$ group; and the $R_f^1$ group represents a fluorine-containing aliphatic group having from 1 to 30 carbon atoms, Formula (FII)

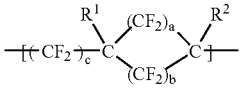

wherein $R^1$ and $R^2$ are the same or different and each represents a fluorine atom or a $—C_vF_{2v+1}$ group; v represents an integer of from 1 to 4; a represents 0 or 1; b represents an integer of from 2 to 5; and c represents 0 or 1, and Formula (FIII)

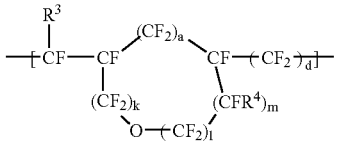

wherein $R^3$ and $R^4$ each represents a fluorine atom or a $—CF_3$ group; a represents the same as in formula (FII); d represents 0 or 1; k represents an integer of from 0 to 5; l represents an integer of from 0 to 4; m represents 0 or 1; and (k+l+m) represents an integer in the range of from 1 to 6.

(4) The inkjet recording head as set forth in any one of (1) to (3), wherein the block polymer (B) comprises at least one ring structure selected from the group consisting of an alicyclic hydrocarbon ring and an aromatic ring.

(5) The inkjet recording head as set forth in (2), wherein the reactive group is at least one functional group selected from the group consisting of a radical polymerizable group, a cationic polymerizable group and a silyl group having s hydrolyzable substituent.

(6) The inkjet recording head as set forth in any one of (1) to (5), wherein the block copolymer of the comb type is a copolymer of:

a monofunctional macromonomer which is a polyester polymer having a radical polymerizable group bonded to only one terminal of a main chain of the polyester polymer; and a radical polymerizable monomer.

(7) The inkjet recording head as set forth in any one of (1) to (6), wherein the composition further comprises an inorganic particle having a mean particle size of not more than 100 nm.

(8) The inkjet recording head as set forth in any one of (1) to (7), wherein the nozzle an underlying surface coated by the composition, wherein the underlying surface has a surface irregularity based on JIS B0601-1994 such that:

an arithmetical mean roughness (Ra) is not more than 0.5 μm;

a ratio (Ra/Rz) of the arithmetical mean roughness (Ra) to a ten-point mean roughness (Rz) is 0.1 or more;

a maximum height (Ry) is not more than 0.5 μm; and a mean space of the surface irregularity (Sm) is from 0.005 to 1 μm.

(9) The inkjet recording head as set forth in any one of (1) to (8), wherein the nozzle has an interlayer between the cured film and a substrate of the inkjet recording head.

(10) The inkjet recording head as set forth in any one of (1) to (9), wherein the portion capable of repelling the ink satisfies a condition that after the portion has a saturated charge amount by applying to an electrostatic field, the period that the portion gets to have a half amount of the saturated charge amount is not longer than 60 seconds.

(11) The inkjet recording head as set forth in any one of (1) to (10), wherein the portion capable of repelling the ink is on an outer surface of the nozzle.

(12) An inkjet recording device, which comprises an ink-jet recording head as set forth in any one of (1) to (10).

In the inkjet recording head of the invention, the cured film reveals extremely high water repellency and oil repellency and is good in film strength, high in hardness, and low in curing shrinkage, and even when exposed to a recording ink for a long period of time, it can keep the performance. In particular, in the case where the block copolymer to be used is curable, a cured film that is good in coating property, free from unevenness in high water repellency and high oil repellency with respect to the surface of the cured film, and excellent in durability is obtained. It may be considered that from the matters that the block copolymer itself is good in solubility in an organic solvent and exhibits extremely high water repellency and oil repellency, it is possible to form a uniform coating; that the block portion of the fluorine-containing polymer component and/or the siloxane-containing siloxane polymer is unevenly distributed in a high concentration on the surface of the coating; that the film itself becomes high in water repellency and oil repellency towards a bulk portion closed to the surface portion of the film; and that excellent resistance to brittleness and toughness are effectively revealed due to the formation of a micro phase separation structure of the polyester block. Further, in the case where the fluorine-containing polymer component is used, and its polymer main chain is composed of a perfluoro aliphatic hydrocarbon structure, the water repellency and oil repellency are more enhanced. This is considered to largely rely upon the matter that the perfluoroalkenyl structure of the polymer main chain in the high-molecular coating is oriented in a high density in the outermost surface as an interface with air, whereby the density of the fluorine atom per unit area increases, resulting in a lowering of the surface free energy.

Also, in the case where inorganic particles having a mean particle size of not more than 100 nm are contained, the film strength is more increased.

Moreover, in the case where the substrate surface on which the cured film-forming composition is to be provided by coating has a specific irregular shape, the coating solution can be uniformly coated, the adhesion becomes extremely good, and the film strength of the cured film itself becomes sufficient. This is estimated to rely upon the matter that the high-molecular coating containing the block copolymer of the invention having a low cohesive strength as the major component reveals uniform anchoring with the substrate surface.

The inkjet recording head of the invention keeps a high ink repelling property even against the repeated use and is high in strength and excellent in abrasion resistance, and excellent with respect to printing quality of the resulting image.

Also, the inkjet recording device of the invention keeps a high ink repelling property even against the repeated use and is high in strength and excellent in abrasion resistance.

BRIEF DESCRIPTION OF THE DRAWING

The sole FIGURE is an enlarged cross-sectional view showing the main portion of an inkjet recording head of the invention as prepared in the Examples.

DETAILED DESCRIPTION OF THE INVENTION

Figure 1:
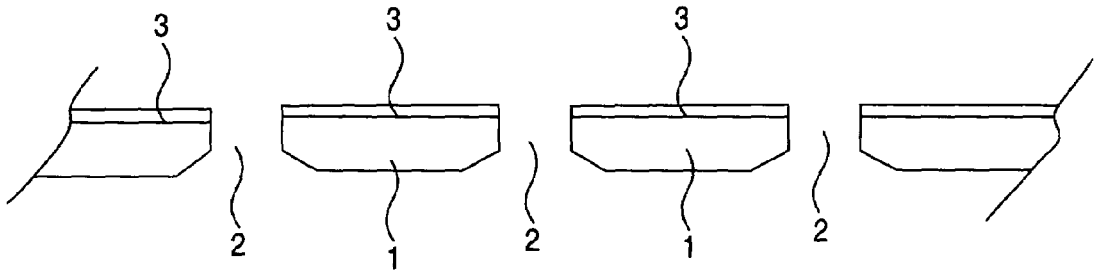

The inkjet recording head of the invention will be described below in more detail.

First of all, the cured film-forming composition that is used in the inkjet recording head of the invention will be described.

(Cured Film-forming Composition)

First of all, the block copolymer to be used as an essential component in the cured film-forming composition will be described.

(Block Copolymer)

The block copolymer that is used in the invention is a block copolymer comprising a unit A and a unit B, and the unit A represents a block polymer (A) comprising a fluorine-containing polymer and/or a siloxane-containing polymer (hereinafter referred to as "block A") and the unit B represents a block polymer (B) comprising a polyester polymer (hereinafter referred to as "block B").

This block copolymer is at least one of a block copolymer comprising the unit A and the unit B (hereinafter referred to as an AB type), a block copolymer comprising the unit A, the unit B and the unit A in this order (hereinafter referred to as an ABA type), and a comb block copolymer comprising the unit A as a main chain and the unit B as a side chain (hereinafter referred to as a comb type). The schematic views are shown below.

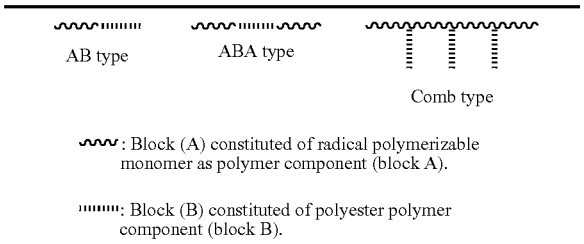

The foregoing block copolymer preferably has a weight average molecular weight of from $5\times10^3$ to $5\times10^5$, more preferably from $8\times10^3$ to $1\times10^5$, and especially preferably from $1\times10^4$ to $8\times10^4$. The block A preferably has a weight average molecular weight of from $1\times10^3$ to $1\times10^5$, and more preferably from $6\times10^3$ to $6\times10^4$. The block B preferably has a weight average molecular weight of from $1\times10^3$ to $1\times10^5$, and more preferably from $2\times10^3$ to $4\times10^4$.

A constitution ratio (weight ratio) of the block A to the block B is preferably from 95/5 to 5/95, more preferably from 90/10 to 20/80, and especially preferably from 80/20 to 30/70 in terms of (block A)/(block B).

In particular, in the case of the block copolymer of a comb type, from the viewpoint of copolymerization property between a monofunctional macromonomer having a radical polymerizable group bonded to only one terminal of each polymer main chain of the polyester polymer as described later and a monomer constituting the block A, the constitution ratio of the block A to the block B is preferably from 95/5 to 20/80, and more preferably from 90/10 to 40/60 in terms of (block A)/(block B).

A proportion of the foregoing block copolymer in the whole of solids in the cured film-forming composition is from 20 to 100% by weight, preferably from 30 to 99.5% by weight, more preferably from 40 to 95% by weight, and further preferably from 50 to 90% by weight.

Next, the block A and the block B, each of which is the essential constitutional unit of the foregoing block copolymer will be described.

(Block A)

The block A contains at least one of a fluorine-containing polymer component and a specific siloxane-containing polymer component.

In the block A, a proportion of these polymer components is preferable from 40 to 100% by weight, and more preferably from 60 to 95% by weight.

In the case of containing both of the fluorine-containing polymer component and the siloxane-containing polymer component, a constitution ratio (weight ratio) of the fluorine-containing polymer component to the siloxane-containing polymer component in the block A is preferably from 5/95 to 95/5, more preferably from 10/90 to 90/10, and especially preferably from 30/70 to 90/10 in terms of (fluorine-containing polymer component)/(siloxane-containing polymer component).

First of all, the fluorine-containing polymer component will be described below.

(Fluorine-containing Polymer Component)

The content of fluorine in the fluorine-containing polymer component is preferably 30% (by number) or more, and more preferably 35% or more in the whole of elements in the fluorine-containing polymer component.

Specifically, examples include vinyl polymer components in which a perfluoro hydrocarbon group having 4 or more carbon atoms is substituted on a side chain represented by the following formula (F0), perfluorovinyl ether components [for example, —($CF_2$—$CF_2O$)— and —($CF(CF_3)$—$CF_2O$)—], and polymer components in which a methylene group constituting the polymer main chain is constituted of a perfluoromethylene group.

Formula (F0)

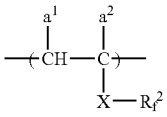

In formula, X represents —$COO(CH_2)_2$— or —O—; $R_f^2$ represents a perfluoro aliphatic group having from 4 to 12 carbon atoms; and $a^1$ and $a^2$ may be the same or different and each represents a hydrogen atom, a fluorine atom, —$C_nH_{2n+1}$ (wherein n represents an integer of from 1 to 4), or —$CF_3$.

Preferred embodiments of the fluorine-containing polymer component include polymer components represented by the following formulae (FI), (FII) and (FIII).

Formula (FI)

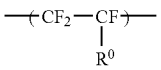

In formula, $R^0$ represents a fluorine atom, a perfluoroalkyl group having from 1 to 8 carbon atoms, or an —$OR_f^1$ group; and the $R_f^1$ group represents a fluorine-containing aliphatic group having from 1 to 30 carbon atoms.

In the case where $R^0$ is a perfluoroalkyl group, a perfluoromethyl group, a perfluoroethyl group, a perfluoropropyl group, and a perfluorobutyl group are more preferable from the viewpoint of polymerization reactivity of a corresponding monomer.

$R_f^1$ is preferably a fluorine-containing aliphatic group having from 1 to 22 carbon atoms, and more preferably a fluorine-containing aliphatic group having from 1 to 12 carbon atoms. Specifically, it may be, for example, a perfluoroalkyl group having from 1 to 8 carbon atoms (for example, —$CH_2F$, —$CHF_2$, —$CH_2CF_3$, —$(CH_2)_2C_2F_5$, —$CH_2CF_2CF_2CFH_2$, —$CH_2(CF_2)_4H$, —$CH_2(CF_2)_8CF_3$, and —$CH_2CH_2(CF_2)_4H$); may have a branched structure (for example, $CH(CF_3)_2$, $CH_2CF(CF_3)_2$, $CH(CH_3)CF_2CF_3$, and $CH(CH_3)(CF_2)_5CF_2H$); may have an alicyclic structure (preferably a 5-membered ring or a 6-membered ring, for example, a perfluorocyclohexyl group, a perfluorocyclopentyl group, and an alkyl group substituted with such a group); or may be a fluorine-containing aliphatic ether bonding group (for example, —$CH_2OCH_2CF_2CF_3$, —$CH_2CH_2OCH_2C_4F_8H$, —$CH_2CH_2OCH_2CH_2C_8F_{17}$, —$CH_2CH_2OCF_2CF_2OCF_2CF_2H$, —$CF_2CH_2OCH_2CF_3$, and —$(CF_2)_2(CH_2)_2OCH(CF_3)_3$).

Formula (FII)

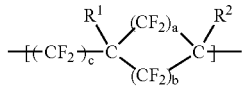

In formula, $R^1$ and $R^2$ may be the same or different and each represents a fluorine atom or a —$C_vF_{2v+1}$ group; v represents an integer of from 1 to 4; a represents 0 or 1; b represents an integer of from 2 to 5; and c represents 0 or 1. In the case where a and/or c is 0, each represents a single bond.

Formula (FIII)

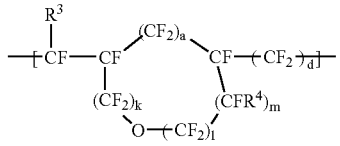

In formula, $R^3$ and $R^4$ each represents a fluorine atom or a —$CF_3$ group; a represents the same as in the foregoing formula (FII); d represents 0 or 1; k represents an integer of from 0 to 5; l represents an integer of from 0 to 4; and m represents 0 or 1. In the case of d, k, l, and/or m is 9, each represents a single bond. Here, (k+l+m) represents an integer in the range of from 1 to 6.

Specific examples of the fluorine-containing components represented by formulae (FII) [(f-1) to (f-8)] and (FIII) [(f-9) to (f-16)] will be given below.

(f-1)

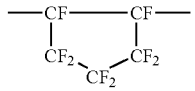

(f-2)

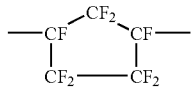

(f-3)

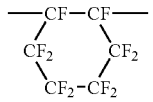

(f-4)

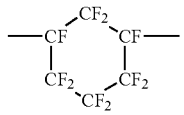

-continued (f-5)

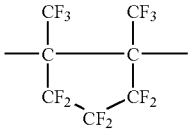

(f-6)

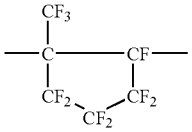

(f-7)

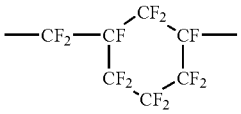

(f-8)

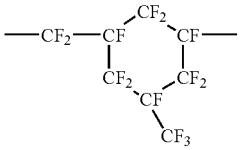

(f-9)

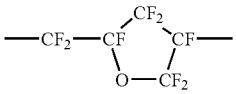

(f-10)

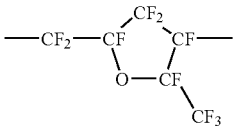

(f-11)

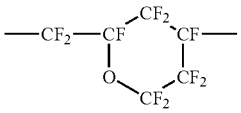

(f-12)

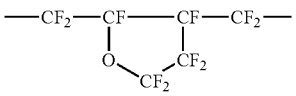

(f-13)

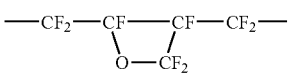

(f-14)

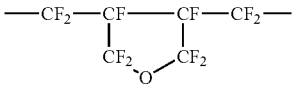

(f-15)

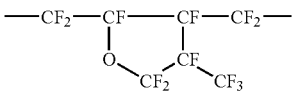

(f-16)

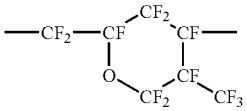

(Siloxane-containing Polymer Component)

The foregoing siloxane-containing polymer component that is used in the invention is a polymer component containing at least one of a siloxane structure represented by formula (SI) and a siloxane structure represented by formula (SII).

Formula (SI)

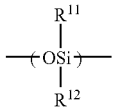

Formula (SII)

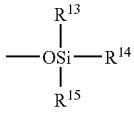

In formulae, $R^{11}$ to $R^{15}$ may be the same or different and each represents an aliphatic group or an aromatic group.

Specific examples of the siloxane-containing polymer component include structures represented by the following formulae (SIIa) and (SIIb).

Formula (SIIa)

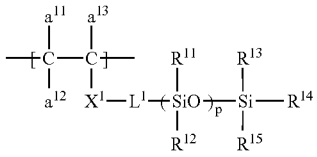

Formula (SIIb)

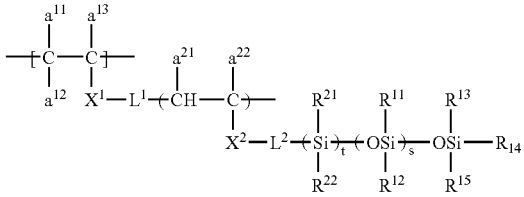

Here, the structural portions (represented by formula (I)) in formulae (SIIa) and (SIIb) express the same contents.

Formula (I)

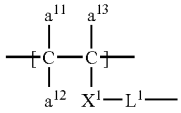

In formula (I), $X^1$ represents —O—, —OCO—, —COO—, —CONH—, or any one of the following groups. Here, q represents an integer of from 1 to 12. These groups may further have a substituent.

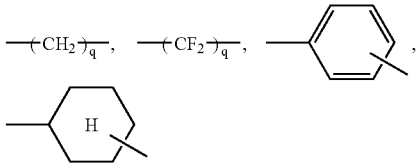

$L^1$ represents a divalent connecting group of connecting —$X^1$— to a siloxane structure-containing repeating unit or a direct bond. Specifically, $L^1$ is constituted of an arbitrary combination of the atomic groups such as groups having the following structures, divalent alicyclic groups (examples of the hydrocarbon ring of the alicyclic structure include a cycloheptane ring, a cyclohexane ring, a cyclooctane group, a bicyclopentane ring, a tricyclohexane ring, a bicyclooctane ring, a bicyclononane ring, and a tricyclodecane ring), and divalent aryl ring groups (examples of the aryl ring include a benzene ring and a naphthalene ring).

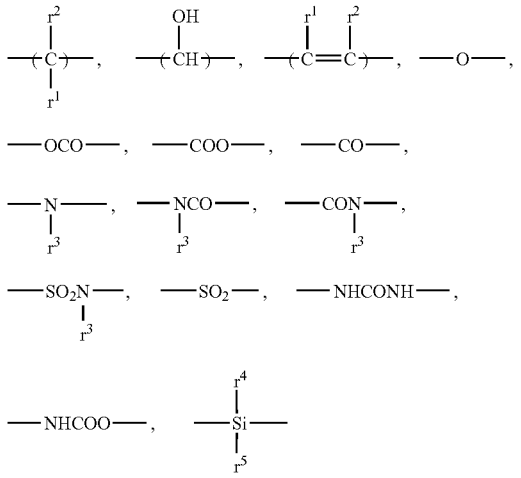

In formulae, $r^1$ and $r^2$ may be the same or different and each represents a hydrogen atom, a halogen atom (for example, a fluorine atom, a chlorine atom, a bromine atom, and an iodine atom), or an optionally substituted alkyl group having from 1 to 6 carbon atoms (for example, a methyl group, an ethyl group, a propyl group, a butyl group, a pentyl group, a hexyl group, a trifluoromethyl group, a methoxyethyl group, a cyanoethyl group, and a chloroethyl group); $r^3$ represents a hydrogen atom or an optionally substituted hydrocarbon group having from 1 to 12 carbon atoms (for example, a methyl group, an ethyl group, a propyl group, a butyl group, a hexyl group, a cyclohexyl group, a cyclohexylmethyl group, a benzyl group, a phenethyl group, a phenyl group, a chlorophenyl group, a methoxyphenyl group, an acetylphenyl group, and a trifluorophenyl group); and $r^4$ and $r^5$ may be the same or different and each represents an optionally substituted hydrocarbon group having from 1 to 12 carbon atoms (specifically, the same as in $r^3$).

In formula (I), the bonding group represented by —$X^1$-$L^1$-preferably has the total sum of atoms, excluding the hydrogen atom, of from 1 to 20, and more preferably from 4 to 8. In this range, not only the curing reaction rapidly proceeds, but also the strength of the formed film is kept sufficiently.

$a^{11}$, $a^{12}$ and $a^{13}$ may be the same or different and each represents a hydrogen atom, a fluorine atom, or an optionally substituted alkyl group having from 1 to 6 carbon atoms (for example, a methyl group, an ethyl group, a propyl group, a butyl group, a methoxycarbonylmethyl group, an ethoxycarbonylmethyl group, and a propoxycarbonylmethyl group).

In formula (I), examples of the structural formula (represented by formula (II)) excluding —$X^1$-$L^1$- include the following groups.

Formula (II)

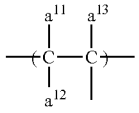

Preferred examples represented by formula (II) are as follows.

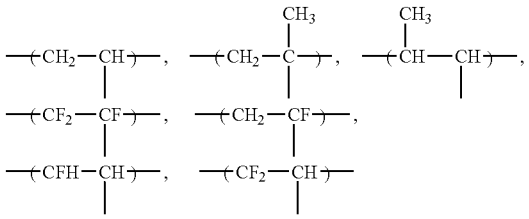

First of all, the cyclohexane structure in the polymer component represented by the foregoing formula (SIIa), i.e., a structure represented by the following formula (SIIa)', will be described.

Formula (SIIa)'

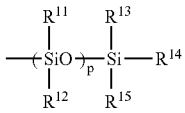

In formula, $R^{11}$ and $R^{12}$ may be the same or different and each preferably represents an optionally substituted aliphatic group having from 1 to 12 carbon atoms or an optionally substituted aryl group having from 6 to 14 carbon atoms.

Examples of the aliphatic group include a linear or branched alkyl group having from 1 to 12 carbon atoms (for example, a methyl group, an ethyl group, a propyl group, a butyl group, a pentyl group, a hexyl group, an octyl group, a decyl group, and a dodecyl group), a linear or branched alkenyl group having from 2 to 12 carbon atoms (for example, a vinyl group, a propenyl group, a butenyl group, a pentenyl group, a hexenyl group, an octenyl group, a decenyl group, and a dodecenyl group), a linear or branched alkynyl group having from 3 to 12 carbon atoms (for example, a propynyl group, a butynyl group, a cyclohexynyl group, and an octynyl group), an aralkyl group having from 7 to 12 carbon atoms (for example, a benzyl group, a phenethyl group, a 3-phenylpropyl group, a naphthylmethyl group, and a 2-naphthylethyl group), and an alicyclic group having from 5 to 12 carbon atoms (for example, a cyclopentyl group, a cyclohexyl group, a cyclooctyl group, a tricyclodecyl group, a bicyclooctyl group, and a tricyclododecyl group).

Examples of the aryl group include a phenyl group, a naphthyl group, and an anthranyl group. These aliphatic groups and aryl groups may have a substituent, and any residual groups constituted of a monovalent non-metal atom excluding a hydrogen atom can be employed without limitations. As the substituent, a fluorine atom and an alkoxy group (for example, a methoxy group, an ethoxy group, and a propoxy group) are preferable.

As $R^{11}$ and $R^{12}$, a methyl group, an ethyl group, a cyclohexyl group, a trifluoromethyl group, a 2,2,2-trifluoroethyl group, a benzyl group, and a phenyl group are especially preferable.

p represents an integer of from 10 to 500, preferably from 50 to 300, and especially preferably from 100 to 250. In —$Si(R^{11})(R^{12})$—O— in the number of p, ones having different $R^{11}$ and/or $R^{12}$ may be mixed.

$R^{13}$, $R^{14}$, and $R^{15}$ may be the same or different and each represents a monovalent organic group; preferably an alkyl group having from 1 to 10 carbon atoms (for example, a methyl group, an ethyl group, and an octyl group), an alkoxy group having from 1 to 10 carbon atoms (for example, a methoxy group, an ethoxy group, and a propyloxy group), or an aryl group having from 6 to 20 carbon atoms (for example, a phenyl group and a naphthyl group); and especially preferably an alkyl group having from 1 to 5 carbon atoms. These groups may further have a substituent.

Specific examples of [—$X^1$-$L^1$-(SIIa)'] in formula (SIIa) will be given below, but it should not be construed that the invention is limited thereto.

(S-1)

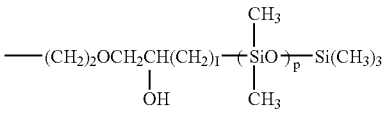

I: an integer of from 2 to 10

(S-2)

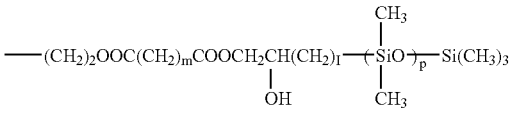

m: an integer of from 2 to 6

(S-3)

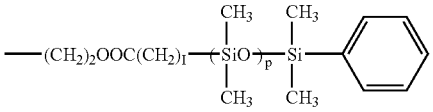

(S-4)

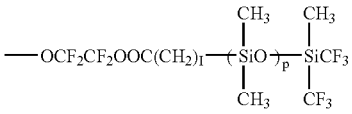

(S-5)

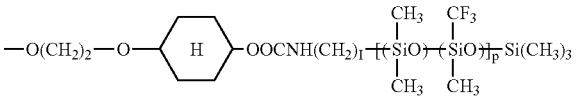

(S-6)

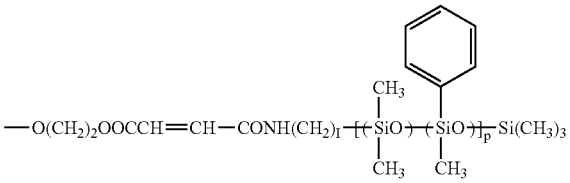

(S-7)

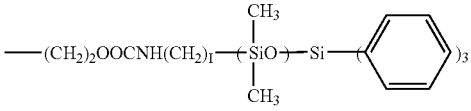

-continued (S-8)

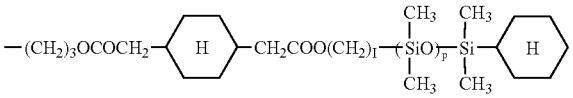

(S-9)

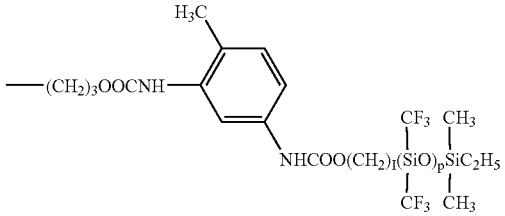

(S-10)

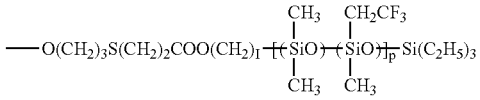

(S-11)

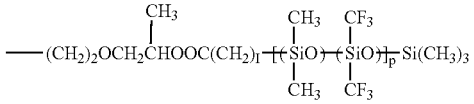

(S-12)

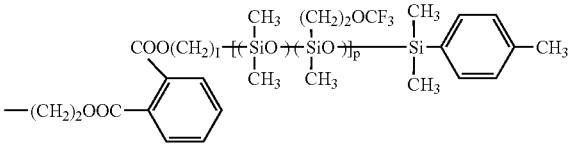

(S-13)

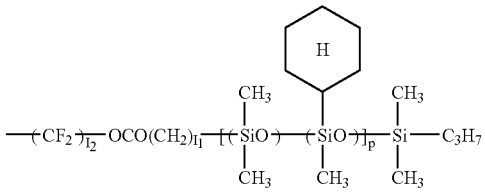

$I_1$: an integer of from 2 to 12
$I_2$: an integer of from 1 to 4

(S-14)

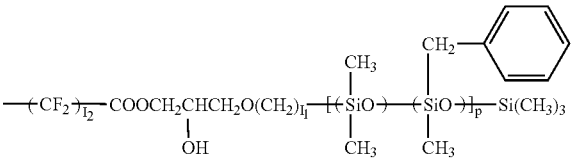

(S-15)

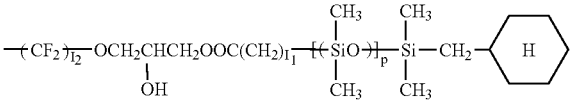

(S-16)

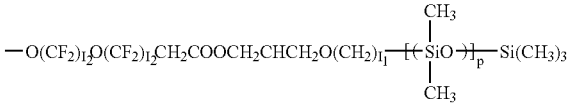

-continued (S-17)

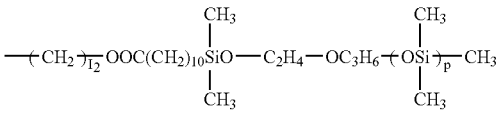

(S-18)

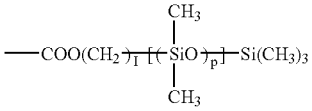

(S-19)

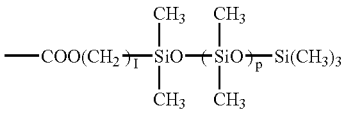

(S-20)

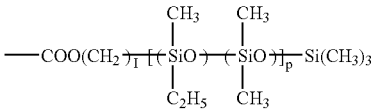

(S-21)

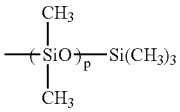

The structure represented by formula (SIIb) will be described. This structure is characterized in that the terminal of the main chain of an ethylenic polymer segment (represented by formula (SIIb)') containing a siloxane structure represented by the following formula (SIIb)" as a subsituent of the side chain is bonded to formula (I). This ethylenic polymer segment preferably has a weight average molecular weight of from $1\times10^3$ to $2\times10^4$, and more preferably from $3\times10^3$ to $1.5\times10^4$.

Formula (SIIb)"

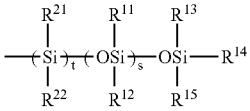

Formula (SIIb)'

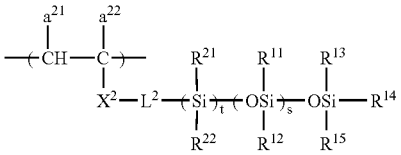

In formulae (SIIb) and (SIIb)', $a^{21}$ and $a^{22}$ each represents a hydrogen atom, a halogen atom (for example, a chlorine atom and a bromine atom), a cyano group, an alkyl group having from 1 to 4 carbon atoms (for example, a methyl group, an ethyl group, a propyl group, and a butyl group), or a —$CH_2COOR^{30}$ group (wherein $R^{30}$ represents an alkyl group having from 1 to 4 carbon atoms), and more preferably a hydrogen atom or a methyl group.

$X^2$ represents —COO—, —OCO—, —CONH—, —O—, —$(CH_2)_1$—COO— (wherein 1 represents an integer of 1 or 2), or the following group.

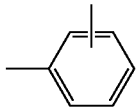

In formula, $L^2$ is synonymous with $L^1$ in formula (SIIa).

$R^{11}$, $R^{12}$, $R^{13}$, $R^{14}$, and $R^{15}$ are synonymous with those in formula (SIIa).

$R^{21}$ and $R^{22}$ may be the same or different and are each synonymous with $R^{11}$ to $R^{15}$ or —$OSi(R^{13})(R^{14})(R^{15})$.

s represents 0 or an integer of from 1 to 8; and t represents 0 or 1.

Specific examples of formula (SIIb)' will be given below, but it should not be construed that the invention is limited thereto.

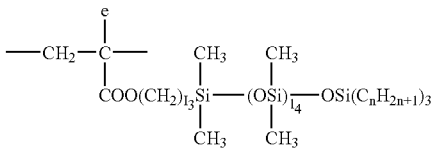

e: —H, —$CH_3$
$l_3$: an integer of from 2 to 6
$l_4$: an integer of from 0 to 10
n: an integer of from 1 to 4

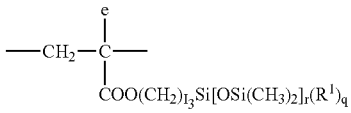

$R^1$: —$C_nH_{2n+1}$, —$R_f$
$R_f$: —$CF_3$, —$C_2F_5$, —$CH(CF_3)_2$
r + q = 3
r, q: an integer of from 0 to 3

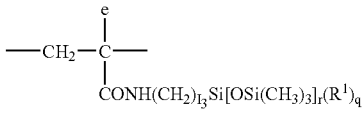

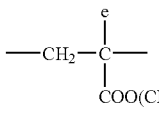

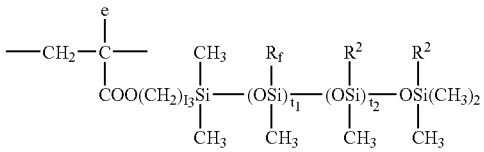

$R^2$: —$C_nH_{2n+1}$, —$(CH_3)_3$—
$t_1 + t_2 = 10$
$t_1$: an integer of from 0 to 4
$t_2$: an integer of from 0 to 10

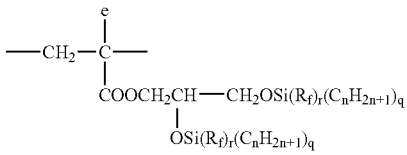

-continued

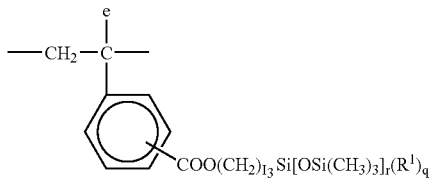

The respective polymer components of the block A can be easily synthesized using the conventionally known radical polymerizable unsaturated bond-containing compound of the fluorine-containing component/siloxane-containing component by the conventionally known radical polymerization reaction.

Also, in formula (FII), in the case of c=0, a copolymer containing a perfluoroalkane structure can be obtained by radical polymerization reaction of a corresponding perfluorocycloalkane compound with other copolymerizable monomer.

Specifically, for example, polymerization conditions described in JP-A-2001-272504 and so on are employable.

Also, on the other hand, a copolymer containing the fluorine-containing polymer component represented by formula (FII) wherein n represents 1 and a copolymer containing the fluorine-containing polymer component represented by formula (FIII) are synthesized by radical cyclization polymerization reaction of a non-conjugated perfluorodiene compound corresponding to the polymer component.

In this case, the copolymer is obtained by introducing a copolymerizable monomer by radical polymerization reaction and performing polymerization reaction.

Specifically, there are enumerated methods described in Zhen-Yu Yaug, et al., *J. Am. Chem. Soc.,* 116 (No. 9), pp.4135–4136 (1994), JP-A-1-131215, JP-A-2001-206864, and JP-A-2001-302725.

(Other Copolymerization Component to be Contained in the Block A)

In the foregoing block A, the foregoing fluorine-containing polymer component and the foregoing siloxane-containing polymer may be one resulting from copolymerization of a monomer constituting the foregoing polymer component and copolymerizable other polymerizable monomer.

As such other polymerizable monomers, a repeating unit represented by formula (A-1) is enumerated.

Formula (A-1)

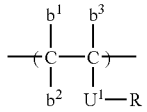

In formula (A-1), $b^1$, $b^2$, and $b^3$ may be the same or different and each represents a hydrogen atom, a fluorine atom, or an alkyl group (for example, a methyl group, an ethyl group, a propyl group, and a butyl group).

Preferred examples of $b^1$, $b^2$, and $b^3$ include $CF_2{=}CF$—, $CF_2{=}CH$—, $CFH{=}CF$—, $CH_2{=}CF$—, $CH_2{=}CH$—, $CH(CH_3){=}CH$—, and $CH_2{=}C(CH_3)$—.

$U^1$ represents —$(CH_2)_dCOO$—, —$(CH_2)_dOCO$—, —O—, —$SO_2$—, —CONHCOO—, —CONHCONH—, —$CON(k^1)$-, —$SO_2N(k^1)$-, a phenylene group, or a single bond of bonding [—$C(b^3)$-] directly to —R (wherein $k^1$ represents a hydrogen atom or an aliphatic group having from 1 to 12 carbon atoms; and d represents 0 or an integer of from 1 to 4).

$k^1$ preferably represents a hydrogen atom or an optionally substituted aliphatic group having from 1 to 8 carbon atoms (for example, a methyl group, an ethyl group, a propyl group, a butyl group, a 2-chloroethyl group, a 2-bromoethyl group, a 2-cyanoethyl group, a 2-hydroxyethyl group, a benzyl group, a chlorobenzyl group, a methylbenzyl group, a methoxybenzyl group, a phenethyl group, a 3-phenylpropyl group, a dimethylbenzyl group, a fluorobenzyl group, a 2-methoxyethyl group, and a 3-methoxypropyl group).

$U^1$ preferably represents —O—, a phenylene group, or a direct bond.

R represents an optionally substituted linear or branched aliphatic group having from 1 to 22 carbon atoms or an optionally substituted aromatic group having from 6 to 12 carbon atoms.

Preferred examples of R include an optionally substituted linear or branched alkyl group having from 1 to 18 carbon atoms (for example, a methyl group, an ethyl group, a propyl group, a butyl group, a hexyl group, a heptyl group, an octyl group, a nonyl group, a decyl group, a dodecyl group, a tridecyl group, a tetradecyl group, a hexadecyl group, an octadecyl group, a 2-fluoroethyl group, a trifluoromethyl group, a 2-chloroethyl group, a 2-bromoethyl group, a 2-cyanoethyl group, a 2-methoxycarbonylethyl group, a 2-methoxyethyl group, a 3-bromopropyl group, a 2-methylcarbonylethyl group, a 2,3-dimethoxypropyl group, and a fluorinated alkyl group {for example, a —$(CH_2)_hC_iF_{2i+1}$ group (wherein h represents an integer of from 1 to 6; and i represents an integer of from 1 to 12), a —$(CH_2)_h$—$(CF_2)_j$—$R^{36}$ group (wherein j represents 0 or an integer of from 1 to 12; and the $R^{36}$ group represents an alkyl group having from 1 to 12 carbon atoms, —$CF_2H$, or —$CFH_2$), —$CH(CF_3)_2$, —$CF_2Cl$, —$CFCl_2$, —CFClH, —$CF(CF_3)OC_iF_{2i+1}$, —$OC_iF_{2i+1}$, and —$C(CF_3)_2OC_iF_{2i+1}$}), an optionally substituted alkenyl group having from 4 to 18 carbon atoms (for example, a 2-methyl-1-propenyl group, a 2-butenyl group, a 2-pentenyl group, a 3-methyl-2-pentenyl group, a 1-pentenyl group, a 1-hexenyl group, a 2-hexenyl group, a 4-methyl-2-hexenyl group, a decenyl group, a dodecenyl group, a tridecenyl group, a hexadecenyl group, an octadecenyl group, and a linolenyl group), an optionally substituted aralkyl group having from 7 to 12 carbon atoms (for example, a benzyl group, a phenethyl group, a 3-phenylpropyl group, a naphthylmethyl group, a 2-naphthylethyl group, a chlorobenzyl group, a fluorobenzyl group, a perfluorobenzyl group, a methylbenzyl group, an ethylbenzyl group, a methoxybenzyl group, a dimethylbenzyl group, and a dimethoxybenzyl group), an optionally substituted alicyclic group having from 5 to 8 carbon atoms (for example, a cyclopentyl group, a cyclohexyl group, a 2-cyclohexylethyl group, a 2-cyclopentylethyl group, a perfluorohexyl group, a tetrafluorohexyl group, a methylcyclohexyl group, and a methoxycyclohexyl group), and an optionally substituted aromatic group having from 6 to 12 carbon atoms (for example, a phenyl group, a naphthyl group, a tolyl group, a xylyl group, a propylphenyl group, a butylphenyl group, an octylphenyl group, a methoxyphenyl group, a fluorophenyl group, a chlorophenyl group, a difluorophenyl group, a perfluorophenyl group, a cyanophenyl group, an acetylphenyl group, a methoxycarbonylphenyl group, and an acetamidophenyl group).

In the case where R represents an aliphatic group, specific examples of other substituent that may be substituted on the aliphatic group include an —OR' group, an —OCOR' group, and a —COOR' group, wherein R' represents a fluorine atom-containing aliphatic group having from 1 to 12 carbon atoms. Specifically, those as in the fluorine-containing aliphatic group represented by $R_f^1$ in the foregoing formula (FI) are enumerated.

With respect to the repeating unit represented by formula (A-1), its kind and compounding proportion are determined within the range where the effect of the block copolymer of the invention is neither increased nor lowered.

Other copolymerization component to be contained in the block A can be adequately chosen from various viewpoints of hardness, adhesion to a substrate, solubility in a solvent, transparency, and others.

A proportion of other copolymerization component in the foregoing block A is not more than 40% by weight, and preferably not more than 30% by weight.

(Block B)

Next, the polyester polymer component constituting the block B will be described.

The block B is constituted of only a polyester polymer component.

In the block B, it is preferable that the polyester polymer component contains a polyester polymer chain to be formed by polycondensation reaction of a diol and a dicarboxylic acid or self-condensation polymerization reaction of a hydroxycarboxylic acid.

Examples of the polyester polymer component include polymer components represented by formula (V) or (VI).

$$-\!\!\left[O-E^1-OCO-E^2-CO\right]\!\!- \quad (V)$$

$$-\!\!\left[O-E^3-CO\right]\!\!- \quad (VI)$$

In formula (V) or (VI), $E^1$ and $E^2$ may be the same or different and each represents a divalent aliphatic group, a divalent aromatic group, or an organic residual group constituted of a combination of these residual groups (in which at least one bonding group selected from $—C(k^2)(k^3)-$, —O—, —S—, $—N(k^4)-$, $—SO_2—$, —COO—, —OCO—, —NHCOO—, —NHCONH—, $—CON(k^4)-$, $—SO_2N(k^4)-$, and $—Si(k^5)(k^6)-$ (wherein $k^2$, $k^3$, and $k^4$ each represents a hydrogen atom or a hydrocarbon group having from 1 to 12 carbon atoms; and $k^5$ and $k^6$ each represents a hydrocarbon group having from 1 to 12 carbon atoms) may be present in the bond of the respective divalent organic residual group).

$E^3$ represents a divalent aliphatic group.

Examples of the divalent aliphatic group include an alkylene group having from 2 to 12 carbon atoms, an alkenyl group having from 2 to 12 carbon atoms, an alkynyl group having from 2 to 12 carbon atoms, a cycloalkane cyclic group having from 3 to 30 carbon atoms, and a cycloalkene cyclic group having from 6 to 30 carbon atoms; and examples of the divalent aromatic group include an aryl group having from 6 to 14 carbon atoms, a 5-membered to 6-membered heterocyclic group containing at least hetero atom (for example, an oxygen atom, a sulfur atom, and a nitrogen atom), or a heterocyclic group that may form a fused ring structure.

It is preferable that at least one of $E^1$ and $E^2$ contains a divalent alicyclic hydrocarbon ring having from 3 to 30 carbon atoms. Specific examples include monocyclo, bicyclo, tricyclo, tetracyclo, and pentacyclo structures having 5 or more carbon atoms. Those having from 6 to 25 carbon atoms are especially preferable.

Structural examples of the alicyclic hydrocarbon ring will be given below. Incidentally, in the following structural examples, a double bond may be contained at the non-conjugated position.

(1)

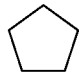

(2)

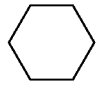

(3)

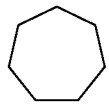

(4)

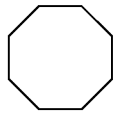

(5)

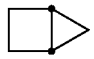

(6)

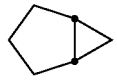

(7)

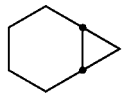

(8)

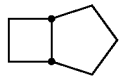

(9)

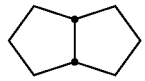

(10)

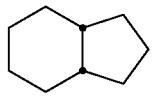

(11)

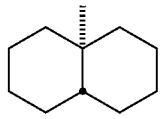

(12)

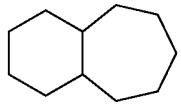

(13)

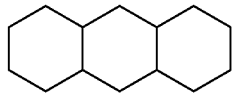

(14)

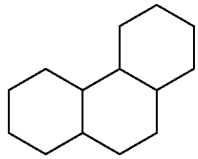

-continued
(15)
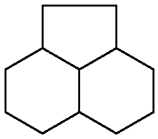
(16)
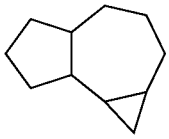
(17)
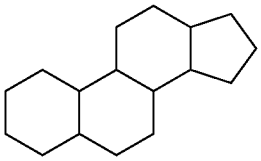
(18)
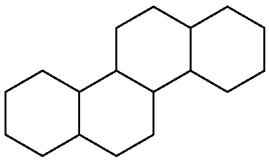
(19)
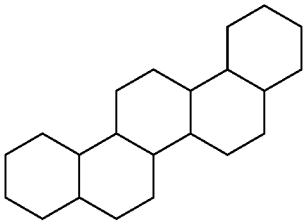
(20)
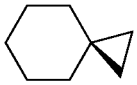
(21)
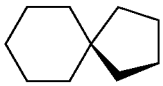
(22)
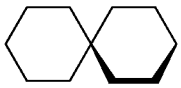
(23)
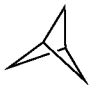
(24)
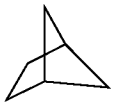
(25)
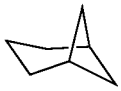
(26)
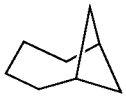
-continued
(27)
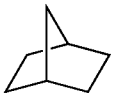
(28)
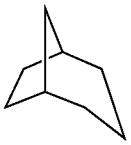
(29)
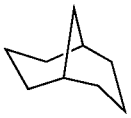
(30)
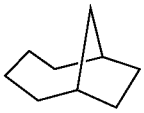
(31)
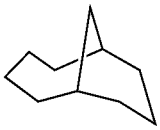
(32)
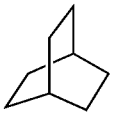
(33)
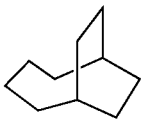
(34)
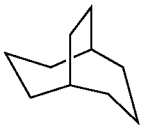
(35)
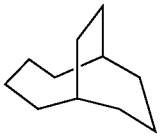
(36)
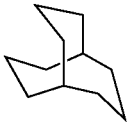
(37)
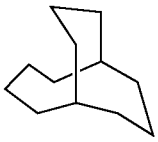
(38)
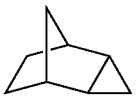

-continued (39)

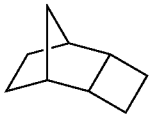

(40)

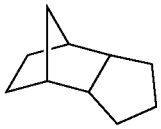

(41)

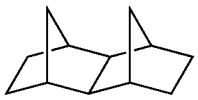

(42)

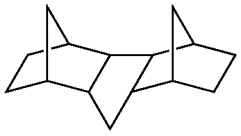

(43)

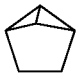

(44)

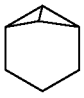

(45)

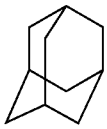

(46)

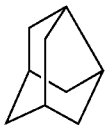

(47)

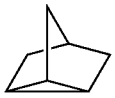

(48)

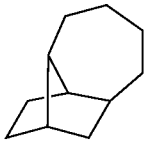

(49)

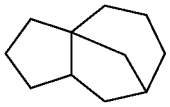

(50)

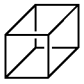

-continued (51)

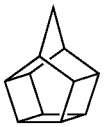

Also, these alicyclic hydrocarbon groups may have at least one substituent, and as the substituent capable of being introduced, a monovalent non-metal atomic group excluding a hydrogen atom is used.

Specific examples of the non-metal atomic group include a halogen atom (for example, a fluorine atom, a chlorine atom, a bromine atom, and an iodine atom), a cyano group, a nitro group, a hydrocarbon group, —$OR^{41}$, —$SR^{41}$, —$COR^{41}$, —$COOR^{41}$, —$OCOR^{41}$, —$SO_2R^{41}$, —$NHCONHR^{41}$, —$N(R^{42})COR^{41}$, —$N(R^{42})SO_2R^{41}$, —$N(R^{43})(R^{44})$, —$CON(R^{43})(R^{44})$, —$SO_2N(R^{43})(R^{44})$, —$P(=O)(R^{45})(R^{46})$, —$OP(=O)(R^{45})(R^{46})$, and —$Si(R^{47})(R^{48})(R^{49})$.

Specifically, the foregoing hydrocarbon group represents an aliphatic group, an aryl group, or a heterocyclic group. Examples of the aliphatic group include a linear or branched alkyl group having from 1 to 22 carbon atoms (for example, a methyl group, an ethyl group, a propyl group, a butyl group, a pentyl group, a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, a nonadecyl group, an eicosanyl group, a heneicosanyl group, and a docosanyl group), a lenar or branched alkenyl group having from 2 to 22 carbon atoms (for example, a vinyl group, a propenyl group, a butenyl group, a pentenyl group, a hexenyl group, an octenyl group, a dodecenyl group, a tirdecenyl group, a tetradecenyl group, a hexadecenyl group, an octadecenyl group, an eicosenyl group, a docosenyl group, a butadienyl group, a pentadienyl group, a hexadienyl group, and an octadienyl group), a linear or branched alkynyl group having from 2 to 22 carbon atoms (for example, an ethynyl group, a propynyl group, a butynyl group, a hexynyl group, an octanyl group, a decanyl group, and a dodecanyl group), and an alicyclic hydrocarbon group having from 5 to 22 carbon atoms (the alicyclic hydrocarbon group includes a monocyclic, polycyclic and crosslinking aliphatic cyclic hydrocarbon groups, and specific examples thereof include ring structure hydrocarbons such as cyclopentane, cyclopentene, cyclopentadiene, cyclohexane, cyclohexene, cyclohexadiene, cycloheptane, cycloheptadiene, cyclooctane, cyclooctene, cyclooctadiene, cyclooctatriene, cyclononane, cyclononene, cyclodecane, cyclodecene, cyclodecanediene, cyclodecatriene, cycloundecane, cyclododecane, bicycloheptane, bicyclohexane, bicyclohexene, tricyclohexene, norcarane, norpinane, norbornane, norbornene, norbornadiene, tricycloheptane, tricycloheptene, decalin, and adamantane).

Of these, linear aliphatic groups having from 1 to 18 carbon atoms, branched aliphatic groups having from 3 to 18 carbon atoms, and cyclic aliphatic groups having from 5 to 16 carbon atoms are more preferable.

As the aryl group, aryl groups having from 6 to 18 carbon atoms (in which examples of the aryl ring include benzene, naphthalene, dihydronaphthalene, indene, fluorene, acenaphthylene, acenaphthene, and biphenylene) are enumerated.

As the heterocyclic group, monocyclic or polycyclic heterocyclic groups containing at least one of an oxygen atom, a sulfur atom, and a nitrogen atom (in which examples of the heterocyclic group include a furanyl group, a tetrahydrofuranyl group, a pyranyl group, a pyrroyl group, a chromenyl group, a phenoxathinyl group, an indazoyl group, a pyrazoyl group, a pyridiyl group, a pyrazinyl group, a pyrimidinyl group, an indoyl group, an isoindoyl group, a quinoniyl group, a pyrrolidinyl group, a pyrrolinyl group, an imidazolinyl group, a pyrazolidinyl group, a piperidinyl group, a piperazinyl group, a morpholinyl group, a thienyl group, and benzothienyl group) are enumerated.

The alkenyl group, alkynyl group, alicyclic hydrocarbon group, aryl group or heterocyclic group as the substituent may further have a substituent. As the substituent, those enumerated above as the substituent capable of being introduced into the alicyclic hydrocarbon group are enumerated.

$R^{41}$ represents an aliphatic group having from 1 to 22 carbon atoms, an aryl group having from 6 to 18 carbon atoms, or a heterocyclic group. The aliphatic group represented by $R^{41}$ is synonymous with the foregoing aliphatic group represented by R. The aryl group represented by $R^{41}$ is the same as the foregoing aryl group. The aryl group may further have a substituent. As the substituent, those enumerated above as the substituent capable of being introduced into the aliphatic group are enumerated. The heterocyclic group represented by $R^{41}$ is the same as the foregoing heterocyclic group.

$R^{42}$ represents a hydrogen atom or is synonymous with the $R^{41}$ group.

The foregoing $R^{43}$ and $R^{44}$ each independently represents a hydrogen atom or is synonymous with $R^{41}$, and $R^{43}$ and $R^{44}$ may be taken together to form an N atom-containing 5-membered or 6-membered ring.

The foregoing $R^{45}$ and $R^{46}$ each independently represents —OH, an aliphatic group having from 1 to 22 carbon atoms, an aryl group having from 6 to 14 carbon atoms, or —$OR^{41}$. The aliphatic group represented by $R^{45}$ and $R^{46}$ is synonymous with the aliphatic group represented by R. As the aryl group represented by $R^{45}$ and $R^{46}$, those enumerated above as the substituent capable of being introduced into the aliphatic group are enumerated. The aryl group may further have a substituent. As the substituent, those enumerated as the substituent capable of being introduced into the aliphatic group represented by R are enumerated. However, in such a polar substituent, both of $R^{45}$ and $R^{46}$ do not represent —OH at the same time.

The foregoing $R^{47}$, $R^{48}$ and $R^{49}$ each independently represents a hydrocarbon group having from 1 to 22 carbon atoms or —$OR^{50}$, and at least one of these substituents represents a hydrocarbon group. The hydrocarbon group represents the same as the aliphatic group or aryl group represented by R, and —$OR^{50}$ is the same as the foregoing —$OR^{41}$.

In the polyester polymer component represented by the foregoing formula (V), in a preferred embodiment in which at least one of $E^1$ and $E^2$ contains an alicyclic hydrocarbon group, the content of the alicyclic hydrocarbon group in the polyester polymer component is preferably from 5 to 100% by mole, more preferably from 20 to 100% by mole, and especially preferably from 50 to 100% by mole.

In the polyester polymer component represented by formula (VI), $E^3$ represents a divalent aliphatic group, specifically, an alkylene group having from 2 to 12 carbon atoms or an alkynyl group having from 3 to 12 carbon atoms.

As specific examples of $E^1$, $E^2$ and $E^3$, the following organic residual groups are enumerated. However, it should not be construed that the invention is limited thereto.

(e-1)

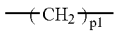

p1: an integer of from 1 to 12

(e-2)

(e-3)

(e-4)

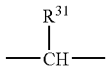

R31: an alkyl group having from 1 to 12 carbon atoms (e-5)

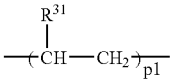

(e-6)

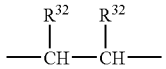

R32: an alkyl group having from 1 to 12 carbon atoms (R32s may be the same or different.)

(e-7)

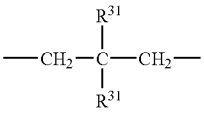

(R31s may be the same or different.)

(e-8)

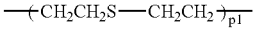

(e-9)

p2: an integer of from 0 to 4

(e-10)

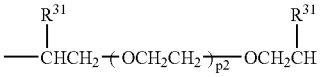

(e-11)

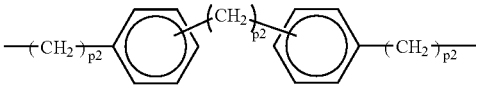

(e-12)

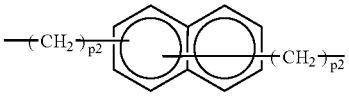

(e-13)

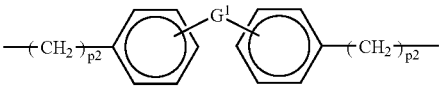

$G^1$: 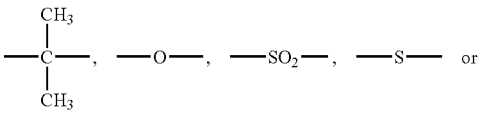 or

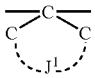

j1: a direct bond or a linear or branched alkylene group having from 1 to 7 carbon atoms -continued (e-14)

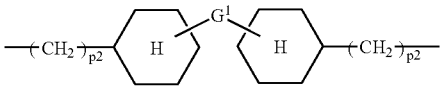

(e-15)

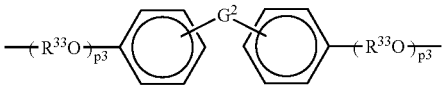

G2: a direct bond, —CH2—, or the same as in $G_1$
G3: an ethylene oxide adduct or a propylenr oxide adduct
p3: an integer of from 1 to 4

(e-16)

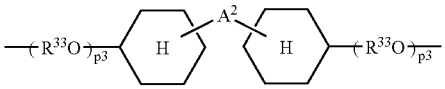

(e-17)

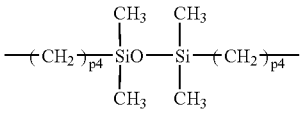

p4: an integer of from 2 to 6

(e-18)

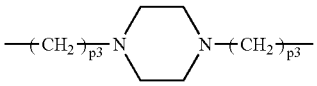

p3: an integer of from 1 to 4

(e-19)

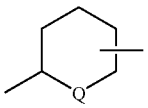

Q; —O—, —S—$CH_2$ or —N—

(e-20)

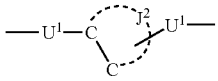

j2: an alicyclic hydrocarbon ring (illustrated ring structure)
U1: a direct bond, —(CH2)p2—, —(OR33)p3— or —CH2—(OR33)p3—

The polyester polymer component is synthesized by the conventionally known polycondensation reaction. Specifically, the polyester polymer component can be synthesized according to methods described in Eiichiro Takiyama, *Polyester Resins Handbook,* published by The Nikkan Kogyo Shimbun, Ltd. (1986), *Polycondensation and Polyaddition*, compiled by The Society of Polymer Science, Japan and published by Kyoritsu Shuppan Co., Ltd., and I. Goodman, *Encyclopedia of Polymer Science and Engineering*, Vol. 12, page 1, published by John Wiley & Sons (1985).

The block B may further contain other copolymerization component. Specifically, those described in the "other copolymerization component to be contained in the block A" are enumerated. Such other copolymerization component is introduced in an amount of preferably not more than 30% by weight, more preferably not more than 20% by weight, and especially preferably in the range of from 5 to 10% by weight of the whole of polymer components. Such other copolymerization component can be adequately chosen from various viewpoints of hardness, adhesion to a substrate, solubility in a solvent, transparency, and others.

(Reactive Group Capable of Contributing to the Crosslinking Reaction)

It is preferable that the block copolymer of the invention contains at least one reactive group capable of contributing to the crosslinking reaction as a side chain substituent or in a terminal of the main chain in the block A.

In order to introduce the reactive group as a side chain substituent, the reactive group is introduced as a polymer component (hereinafter, this polymer component will be referred to as "component H") in the block A. The component H is a repeating unit containing a reactive group capable of contributing to the crosslinking reaction in the substituent and corresponding to the monofunctional monomer copolymerizable with the block A. By introducing the component H, the foregoing reactive group is introduced as a side chain substituent. Specifically, a structure represented by formula (HI) is enumerated.

Formula (HI)

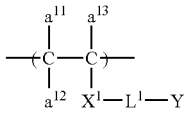

In formula (HI), $a^{11}$, $a^{12}$, $a^{13}$, $X^1$, and $L^1$ are synonymous with those in the foregoing formula (I). In formula (HI), as a preferred embodiment of a structure represented by formula (HI)', there are enumerated those as in the specific embodiments of the foregoing formula (I).

Formula (HI)'

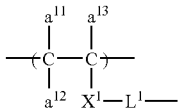

Y represents at least one reactive group capable of contributing to the crosslinking reaction.

Examples of the reactive group (Y) capable of contributing to the crosslinking reaction include an active hydrogen atom-containing group (for example, a hydroxyl group, a carboxyl group, an amino group, a carbamoyl group, a mercapto group, a β-keto ester group, a hydrosilyl group, and a silanol group), a cationic polymerizable group (for example, an epoxy group, an oxetanyl group, an oxazolyl group, and a vinyloxy group), an acid anhydride, a radical polymerizable unsaturated double bond-containing group (for example, an acryloyl group and a methacryloyl group), a hydrolyzable silyl group (for example, an alkoxysilyl group and an acyloxysilyl group), a group capable of being substituted with a nucleating agent (for example, an active halogen atom and a sulfonic ester), and an isocyanate group (a protected block isocyanate group capable of generating an isocyanate group upon heating may be employed).

These reactive groups may be introduced at the monomer stage or by polymeric reaction. The polymeric reaction can be carried out by adequately choosing a combination of the conventionally known functional groups capable of reacting with each other. For example, a method described in *Reactive Polymers*, complied by Yoshio Iwakura and Kei Kurita and published by Kodansha Ltd. (1977) is enumerated.

Of the foregoing crosslinking reactive groups, a hydroxyl group, an epoxy group, a vinyloxy group, a (meth)acryloyl group, and a hydrolyzable silyl group are preferable.

In the case of containing the foregoing component H, its content is preferably in the range of from 1 to 30% by weight, more preferably from 5 to 25% by weight, and especially preferably from 5 to 20% by weight in the whole of polymer components. This range is preferable because the strength of the cured film becomes sufficient, and the anti-fouling property of the surface after the film formation becomes high.

Specific examples of the foregoing component H will be given below, but it should not be construed that the invention is limited thereto.

(h-1)

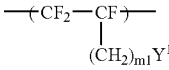

m1: an integer of from 2 to 12

Y1: —OH, —$NH_2$, —COOH, —CH(O)—$CH_2$, —$O(CH_2)_3Si(OR')_3$, —$O(CH_2)_3Si(R'')(OR')_2$ [R', R'': —$CH_3$, —$C_2H_5$]

(h-2)

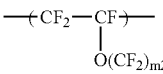

m2: an integer of from 1 to 8

(h-3)

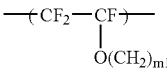

m3: an integer of from 1 to 4

(h-4)

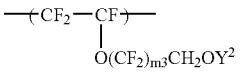

$Y^2$: —H, —$CH_2$CHO$CH_2$ (h-5)

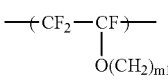

(h-6)

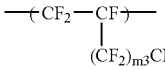

(h-7)

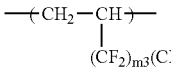

(h-8)

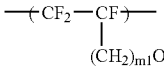

m4: 2 or 3

(h-9)

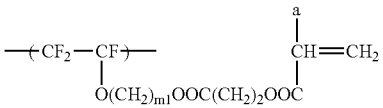

a = H, —$CH_3$ (h-10)

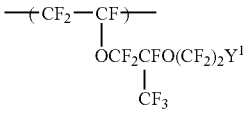

(h-11)

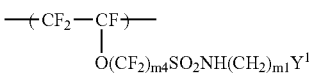

(h-12)

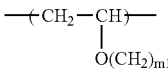

-continued (h-13)

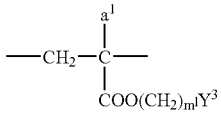

$m^1$: an integer of from 2 to 8

$a^1$: H, $CH_3$, F $Y^3$: —OH, —$NH_2$, —COOH, —NCO, —CH(O)$CH_2$, —$Si(OR')_3$, —$Si(R'')(OR')_2$ [R', R'': —$CH_3$, —$C_2H_5$]

(h-14)

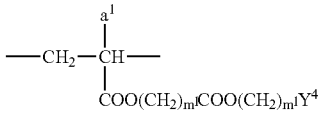

$Y^4$: —H, —$CH_3$, —$C_2H_5$ (h-15)

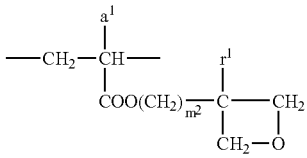

$m^2$: an integer of from 1 to 4

$r^1$: —H, —$CH_3$, —$C_2H_5$ (h-16)

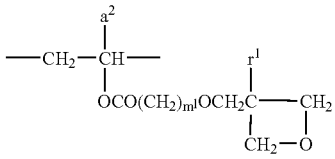

(h-17)

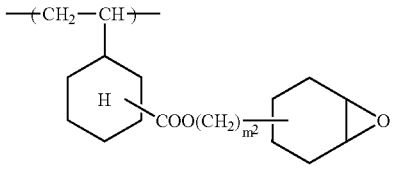

(h-18)

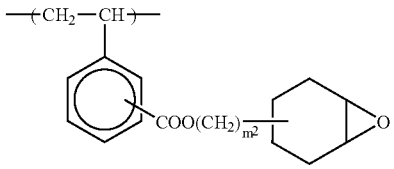

(h-19)

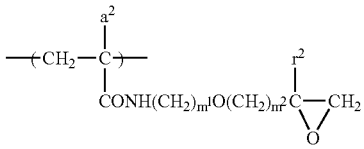

$r^2$: —H, —$CH_3$ (h-20)

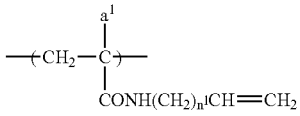

$n^1$: 0 or 1

-continued (h-21)

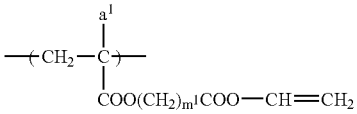

(h-22)

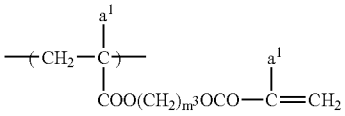

$m^3$: an integer of from 2 to 12

(h-23)

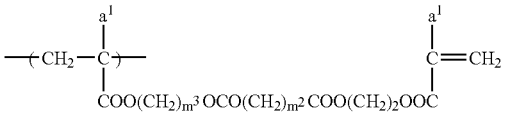

(h-24)

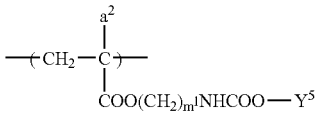

$Y^5$: 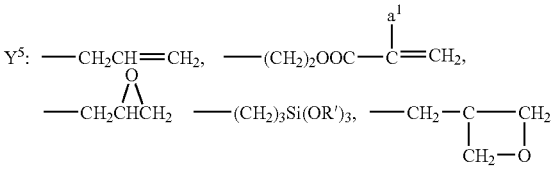

(h-25)

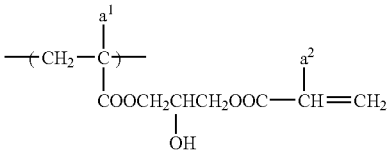

(h-26)

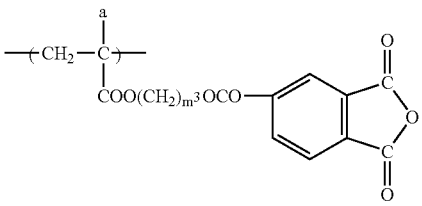

(h-27)

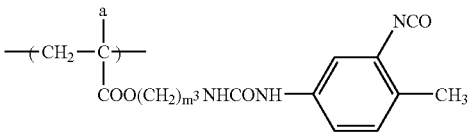

Also, the introduction of the foregoing reactive group into the terminal of the main chain will be described in the following "Production of block copolymer".

Specific examples of the foregoing block copolymer include PI-1, PI-2 and PI-3 (AB type), PII-1 and PII-2 (ABA type), and PIII-1, PIII-2, PIII-3, PIII-4, PIII-5, PIII-6, PIII-7 and PIII-8 (comb type) as described in the working examples described later.

(Production of Block Copolymer)

In the foregoing block copolymers, the block copolymers of an AB type and an ABA type can be produced by radical polymerization reaction of a macromonomer having a radical polymerizable group boned to a terminal of the main chain of each polymer corresponding to the polyester polymer component constituting the block B as a high-molecular initiator with a radical polymerizable monomer constituting the block A.

That is, when a macromonomer having a radical polymerizable group boned to only one terminal of the main chain of each polymer of the polyester polymer component is used as the high-molecular initiator, a block copolymer of an AB type is obtained. Also, when a macromonomer having a radical polymerizable group bonded to the both terminals of the main chain of each polymer of the polyester polymer is used as the high-molecular initiator, a block copolymer of an ABA type is obtained.

Examples of the radical polymerizable group bonding to the terminal of the main chain of each polymer of the polyester polymer component include heat polymerizable groups such as a peroxide group and an azobis group and photopolymerizable groups such as a dithiocarbamate group and a xanthate group.

The high-molecular initiator having a heat polymerizable group bonded to the terminal of a polymer of the polyester polymer component can be produced in the same manner described in, for example, P. S. Anand, et al., *Makromol. Chem.,* 183, 1685 (1982), Akira Ueda, et al., *Japanese Journal of Polymer Scicence and Technology,* 33 (No. 3), 131 (1976), and Yasuo Moriya, et al., *Journal of the Japan Reinforced Plastics Society,* 29 (No. 3), 107.

With respect to the method of performing photo-radical polymerization using a high-molecular initiator having a photopolymerizable group selected from a dithiocarbamate group and a xanthate group bonded to the terminal of each polymer of the polyester polymer component, it is preferable that the block polymerization reaction of the high-molecular initiator completely proceeds.

As specific embodiments of the high-molecular initiator having a photopolymerizable group selected from a dithiocarbamate group and a xanthate group bonded to the terminal of each polymer of the polyester polymer component, structures represented by formulae (Q-1) to (Q-IV) are preferable.

$$T\text{-}L^3\text{-}D^3\text{-}[O\text{-}E^1\text{-}OCO\text{-}E^2\text{-}CO]R^1 \quad \text{(Q-I)}$$

$$T\text{-}L^3\text{-}D^3\text{-}[O\text{-}E^3\text{-}CO]R^1 \quad \text{(Q-II)}$$

$$T\text{-}L^4\text{-}D^4\text{-}[OC\text{-}E^1\text{-}OCO\text{-}E^2\text{-}O]R^2 \quad \text{(Q-III)}$$

$$T\text{-}L^4\text{-}D^4\text{-}[OC\text{-}E^3\text{-}O]R^2 \quad \text{(Q-IV)}$$

In the foregoing formulae (Q-I) to (Q-IV), expressions in the brackets each represents a repeating unit.

$L^3$ represents a divalent connecting group of connecting a radical generating group T to $D^3$.

$L^4$ represents a divalent connecting group of connecting a radical generating group T go $D^4$.

$D^3$ represents —$CH_2$— or —CO—. $D^4$ represents —O— or —NH—. $R^1$ represents —OH, —$OR^5$, or —$N(R^6)(R^7)$ (wherein $R^5$ represents a hydrocarbon group having from 1 to 12 carbon atoms; and $R^6$ and $R^7$ each represents a hydrogen atom or a hydrocarbon group having from 1 to 12 carbon atoms).

$R^2$ represents a hydrogen atom, a hydrocarbon group having from 1 to 12 carbon atoms, —$COR^8$, or —$CONHR^9$ (wherein $R^8$ and $R^9$ each represents a hydrocarbon group having from 1 to 12 carbon atoms).

In formulae (Q-I) to (Q-IV), T represents a dithiocarbamate group or a xanthate group. Specific examples of T will be given below, but it should not be construed that the invention is limited thereto.

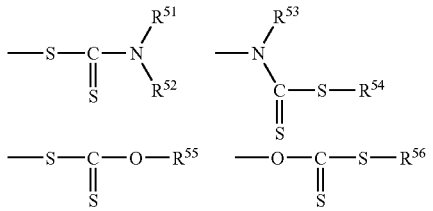

These groups are an example of the radical generating group capable of generating a radical upon irradiation with light. The high-molecular initiators as enumerated herein are a photopolymerization initiator, i.e., a photopolymerization high-molecular initiator, have a radical initiator function, a chain transfer function and a termination reaction function, and cause photo-living radical polymerization reaction (for example, the contents described in Takayuku Otsu, *Polymers,* 37, 248 (1988) are applicable). The radical polymerizable monomer of the block A is inserted between —S— and —C— of the —[C(═S)—S—C]— bond in the photopolymerization high-molecular initiator upon irradiation with light, and the polymerization reaction proceeds by repetition of such insertion, thereby forming an AB block copolymer comprising the block B and the block A.

In the foregoing formulae, $R^{51}$, $R^{52}$ and $R^{53}$ may be the same or different and each represents a hydrogen atom, an aliphatic group, an aryl group, or a heterocyclic group. Also, $R^{51}$ and $R^{52}$ represent a residual group capable of forming a nitrogen atom-containing ring. Here, $R^{51}$ and $R^{52}$ do not represent a hydrogen atom at the same time.

$R^{54}$, $R^{55}$ and $R^{56}$ each represents an aliphatic group, an aryl group, or a heterocyclic group.

In the case where $R^{51}$ to $R^{53}$ and $R^{54}$ to $R^{56}$ each represents an aliphatic group, an aryl group, or a heterocyclic group, examples of the respective organic groups include those enumerated as R in the foregoing formula (I).

Also, each of these organic residual groups may have a substituent. Examples of the substituent to be substituted include those enumerated as the substituent to be substituted on the foregoing R.

The total sum of carbon atoms of $R^{51}$ and $R^{52}$ is preferably not more than 18, and more preferably not more than 12.

$L^3$ and $L^4$ each represents a divalent connecting group of connecting T to $D^3$ or $D^4$ and represents a single bond or a connecting group having the total number of atoms of from 1 to 22 (the total number of atoms as referred to herein excludes a hydrogen atom bonded to the carbon atom, nitrogen atom or silicon atom), and preferably a single bond or a connecting group having the total number of atoms of from 1 to 18.

The connecting group represented by $L^3$ and $L^4$ is constituted of an arbitrary combination of an atomic group constituted of a carbon atom-carbon atom bond (single bond or double bond), a carbon atom-hetero atom bond (examples of the hetero atom include an oxygen atom, a sulfur atom, a nitrogen atom, and a silicon atom), a hetero atom-hetero atom bond, etc. Examples of the atomic group will be given below, but it should not be construed that the invention is limited thereto.

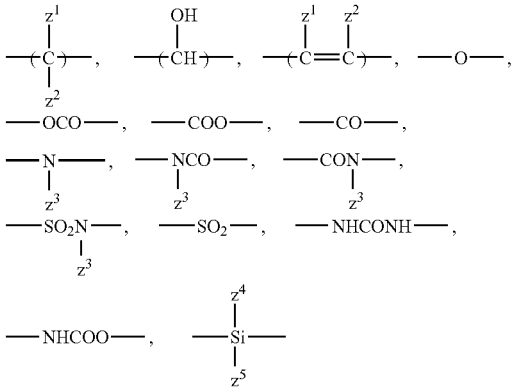

In formulae, $z^1$ and $z^2$ may be the same or different and each represents a hydrogen atom, a halogen atom (for example, a fluorine atom, a chlorine atom, a bromine atom, and an iodine atom), or an optionally substituted alkyl group having from 1 to 6 carbon atoms (for example, a methyl group, an ethyl group, a propyl group, a butyl group, a pentyl group, a hexyl group, a trifluoromethyl group, a methoxyethyl group, a cyanoethyl group, and a chloroethyl group); $Z^3$ represents a hydrogen atom or an optionally substituted hydrocarbon group having from 1 to 12 carbon atoms (for example, a methyl group, an ethyl group, a propyl group, a butyl group, a hexyl group, a cyclohexyl group, a cyclohexylmethyl group, a benzyl group, a phenethyl group, a phenyl group, a chlorophenyl group, a methoxyphenyl group, an acetylphenyl group, and a trifluorophenyl group); and $z^4$ and $z^5$ may be the same or different and each represents an optionally substituted hydrocarbon group having from 1 to 12 carbon atoms (specific examples thereof include those in the hydrocarbon group represented by the foregoing $z^3$).

As the connecting group represented by $L^3$ and $L^4$, those constituted of an arbitrary combination of an atomic group of groups such as a divalent alicyclic group (examples of the hydrocarbon ring of an alicyclic structure include a cycloheptane ring, a cyclohexane ring, a cyclooctane ring, a bicyclopentane ring, a tricyclohexane ring, a bicyclooctane ring, a bicyclononane ring, and a tricyclodecane ring) and a divalent aryl ring group (examples of the aryl ring include a benzene ring and a naphthalene ring) are further included.

Specific examples of the divalent groups $L^3$ and $L^4$ will be given below, but it should not be construed that the invention is limited thereto.

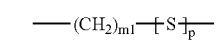

(X-1)

m1: an integer of from 1 to 12,
p1: 0 to 1

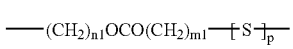

(X-2)

n1: an integer of from 2 to 12

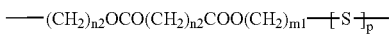

(X-3)

n2: an integer of from 2 to 4

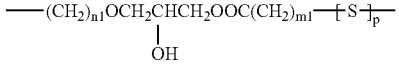

(X-4)

-continued (X-5)

$$-(CH_2)_{n1}NHCOO(CH_2)_{m1}-[S]_p-$$

(X-6)

$$-(CH_2)_{n2}NH(CH_2)_{n2}NHOC(CH_2)_{m1}-[S]_p-$$

(X-7)

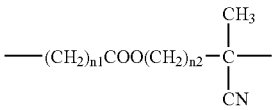

(X-8)

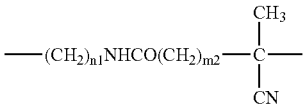

m2: 2 or 3

(X-9)

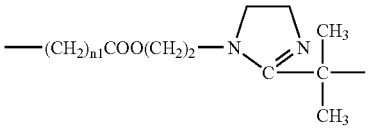

(X-10)

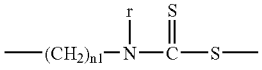

r: —H, —$C_nH_{2n+1}$
(n: an integer of from 1 to 3)

As described previously, the block copolymer of an ABA type is obtained using a macromonomer having a radical polymerizable group bonded to the both terminals of the main chain of each polymer of the polyester polymer as a high-molecular initiator. According to a preferred embodiment, the block copolymer of an ABA type is produced by photo-radical polymerization reaction between a photopolymerization high-molecular initiator having a photopolymerizable group bonded thereto as a terminal radical polymerizable group and a radical polymerizable monomer.

Specific examples include those resulting from bonding $R^1$ or $R^2$ in the foregoing formula (Q-I), (Q-II), (Q-III) or (Q-IV) to a group represented by formula (S-I) or (S-II).

(S-I)

$$[T-L^5-D^5]-$$

(S-II)

$$[T-L^5-D^5]-$$

In the foregoing formulae, $L^5$, $L^6$, $D^5$, and $D^6$ are synonymous with $L^3$, $L^4$, $D^3$, and $D^4$, respectively.

Specific examples of such high-molecular polymerization initiators include high-molecular polymerization initiators Q-1 to Q-5 as described in the working examples described later.

Next, the synthesis method of the photopolymerization high-molecular initiator will be described.

As the method of introducing a functional group (T) into the terminal hydroxyl group of the main chain of each polymer of the polyester polymer component, there can be employed the conventionally known methods such as a reaction for esterification from an alcohol in a low-molecular compound and a reaction for forming a urethane from an alcohol. That is, the synthesis can be achieved by a method of esterification by reaction with a carboxylic acid, a carboxylic acid ester, a carboxylic acid halide, or a carboxylic acid anhydride, each containing a dithiocarbamate group or a xanthate group in the molecule, to synthesize the photopolymerization high-molecular initiator in the invention; and a method of reaction with a monoisocyanate containing a dithiocarbamate group or xanthate group in the molecule to form a urethane. Specifically, the synthesis can be carried out using methods described in detail in *Shin-Jikken Kagaku Koza* 14, *Yukikagoubutsu No Gosei to Hanno [II]*, Chapter 5, compiled by The Chemical Society of Japan and published by Maruzen Co., Ltd. (1977) and ibid., *Yukikagoubutsu No Gosei to Hanno [III]*, page 1652, published by Maruzen Co., Ltd. (1978).

The high-molecular initiator having a photo-polymerizable group selected from a dithiocarbamate group or a xanthate group represented by the foregoing formula (Q-I), (Q-II), (Q-III) or (Q-IV) bonded to the terminal of the main chain of each polymer of the polyester polymer component, that is, the photopolymerization high-molecular initiator, can be synthesized by introducing a functional group (T) into the terminal carboxyl group of the main chain of each polymer of the polyester polymer component in the manner as described previously. As the introduction method, there can be employed the conventionally known methods such as a reaction of esterification from a carboxylic acid in a low-molecular compound and a reaction of acid amidation from a carboxylic acid. That is, the foregoing photopolymerization high-molecular initiator is synthesized by polymeric reaction of a compound containing a dithiocarbamate group or xanthate group in the molecule and containing a functional group capable of chemically reacting a carboxyl group, such as an —OH group, a halogen body (for example, chlorides, bromides, and iodides), —$NH_2$, —$COOR^{31}$ (wherein $R^{31}$ represents a methyl group, a trifluoromethyl group, a 2,2,2-trifluoroethyl group, etc.), and a group shown below with a polymer corresponding to the polyester polymer component.

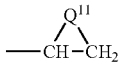

$Q^{11}$; —S—, —O—, —$N(R^{30})$—
R30: a hydrogen atom or an alkyl group having from 1 to 12 carbon atoms The photo-radical polymerization reaction is known as a photoiniferter reaction, and the photoiniferter can be synthesized by methods described in, for example, T. Otsu and M. Yoshida, *Polym. Bull.*, 7, 197 (1982) and Takayuku Otsu, *Polymers*, 37, 248 (1988).

Next, the block copolymer of a comb type and the process of producing the same will be described.

The foregoing block copolymer of a comb-type is constituted of the polymer component in which the comb portion is the block B. It is preferable that this block copolymer is a copolymer obtained by radical polymerization of a radical polymerizable monomer and a monofunctional macromonomer having a radical polymerizable group bonded to only one terminal of the main chain of each polymer of the polyester polymer component of the invention.

As the foregoing monofunctional macromonomer, those represented by formula (Q-I), (Q-II), (Q-III) or (Q-IV) wherein T represents $CH(d^1)=C(d^2)-V^3$—, which are a high-molecular initiator having a photopolymerizable group selected from a dithiocarbamate group and a xanthate group bonded to the terminal of the main chain of each polymer of the polyester polymer component. Here, $d^1$, $d^2$, and $V^3$ are synonymous with $b^1$, $b^3$, and $U^1$ of the foregoing formula (A-1), respectively.

As the method of introducing a radical polymerizable group into only the one-terminal hydroxyl group of the main chain of each polymer of the polyester polymer component, there can be employed the conventionally known methods such as a reaction for esterification from an alcohol in a low-molecular compound and a reaction for forming a urethane from an alcohol. That is, the synthesis can be achieved by a method of esterification by reaction with a carboxylic acid, a carboxylic acid ester, a carboxylic acid halide, or a carboxylic acid anhydride, each containing a polymerizable double bonding group in the molecule, to synthesize a macromonomer; and a method of reaction with a monoisocyanate containing a polymerizable double bonding group in the molecule to form a urethane to synthesize a macromonomer. Specifically, the synthesis can be carried out using methods described in detail in *Shin-Jikken Kagaku Koza* 14, *Yukikagoubutsu No Gosei to Hanno [II]*, Chapter 5, compiled by The Chemical Society of Japan and published by Maruzen Co., Ltd. (1977) and ibid., *Yukikagoubutsu No Gosei to Hanno [III]*, page 1652, published by Maruzen Co., Ltd. (1978).

The macromonomer represented by formula (Q-I), (Q-II), (Q-III) or (Q-IV) wherein T represents $CH(d^1)=C(d^2)-V^3$—, which is a high-molecular initiator having a photopolymerizable group selected from a dithiocarbamate group and a xanthate group bonded to the terminal of the main chain of each polymer of the polyester polymer component can be synthesized by a method of introducing a polymerizable double bonding group into only the one-terminal carboxyl group of the main chain of each polymer of the polyester polymer component in the manner as described previously. As the introduction method, there can be employed the conventionally known methods such as a reaction of esterification from a carboxylic acid in a low-molecular compound and a reaction of acid amidation from a carboxylic acid. That is, the foregoing macromonomer is synthesized by polymeric reaction of a compound containing a polymerizable double bonding group in the molecule and containing a functional group capable of chemically reacting a carboxyl group, such as an —OH group, a halogen body (for example, chlorides, bromides, and iodides), —$NH_2$, —$COOR^{31}$ (wherein $R^{31}$ represents a methyl group, a trifluoromethyl group, a 2,2,2-trifluoroethyl group, etc.), and a group shown below with a polyester oligomer.

As the block copolymer of the invention, an embodiment in which a crosslinking group is bonded to the terminal of the main chain of each polymer of the polymer is also preferable. Examples of the crosslinking group include those as in Y of the polymerization component represented by the foregoing formula (HI). Though the embodiment of bonding to the terminal of the main chain of the polymer is not particularly limited, examples include groups represented by formula (Z):

$$Y\text{-}L^5\text{-}[B]—$$

wherein, Y is synonymous with Y in formula (HI); $L^5$ is synonymous with the foregoing $L^3$; and [B] represents the block copolymer component of the invention.

Such a crosslinking group can be introduced according to the conventionally known methods. Examples thereof include (i) a method of polymerizing a mixture of chain transfer agents containing a specific polar group (for example, a hydroxyl group, a carboxy group, an amino group, a halogen atom, an epoxy group, and an acid halide group) by a polymerization initiator (for example, azobis based compounds and peroxides); (ii) a method in which a compound containing the foregoing polar group is used in all of the chain transfer agent and the polymerization initiator; and (iii) a method in which in the foregoing two methods, after polymerization reaction using the chain transfer agent or polymerization initiator, these functional groups are further reacted by polymeric reaction to introduce a crosslinking reactive group. In particular, in the case where the crosslinking reactive group is a radical polymerizable double bonding group, it is preferred to introduce the crosslinking reactive group into the polymer by these methods. Specifically, the production can be carried out according to methods described in general remarks and citations of, for example, P. Dreyfuss & R. P. Quirk, *Encycl. Polym. Sci. Eng.,* 7, 551 (1987), Yoshiki Nakajo and Tatsuya Yamashita, *Dyes and Chemicals,* 30, 232 (1985), Akira Ueda and Susumu Nagaki, *Kakaku To Kogyo,* 60, 57 (1986).

The polyester polymer component that is provided for the block copolymer of an AB type or ABA type has a weight average molecular weight of from $2\times10^3$ to $5\times10^4$, preferably from $3\times10^3$ to $4\times10^4$, and more preferably from $3\times10^3$ to $4\times10^4$.

The polyester polymer component that is provided for the block copolymer of a comb type preferably has a weight average molecular weight of from 2,000 to 20,000, and more preferably from 3,000 to 15,000. When the weight average molecular weight falls within this range, the resulting polymer has good radical polymerization reactivity and good film characteristic.

(Solvent)

Since the foregoing cured film-forming composition is usually used in the liquid state, it is preferred to use a solvent capable of dissolving the foregoing block copolymer therein.

Examples of the solvent include alcohols, ketones, esters, amides, ethers, ether esters, hydrocarbons, and halogenated hydrocarbons. Specific examples include alcohols (for example, methanol, ethanol, propanol, butanol, benzyl alcohol, ethylene glycol, propylene glycol, and ethylene glycol monoacetate), ketones (for example, methyl ethyl ketone, methyl isobutyl ketone, cyclohexanone, and methylcyclohexanone), esters (for example, methyl acetate, ethyl acetate, propyl acetate, butyl acetate, ethyl formate, propyl formate, butyl formate, and ethyl lactate), aliphatic hydrocarbons (for example, hexane and cyclohexane), halogenated hydrocarbons (for example, methylchloroform), aromatic hydrocarbons (for example, benzene, toluene, and xylene), amides (for example, dimethylformamide, dimethylacetatamide, and n-methylpyrrolidone), ethers (for example, dioxane, tetrahydrofuran, ethylene glycol dimethyl ether, and propylene glycol dimethyl ether), and ether alcohols (for example, 1-methoxy-2-propanol, ethyl cellosolve, and methyl carbinol). These solvents may be used singly or in admixture of two or more thereof.

In the case where the foregoing cured film-forming composition is used in the liquid state, the solids content is preferably from 0.5 to 50% by weight, and more preferably from 1 to 30% by weight.

(Curing Agent and Curing Accelerator)

The cured film-forming composition to be used in the invention is used together with at least one of a curing agent and a curing accelerator. They can be adequately chosen and used among the conventionally known materials according to the curing reaction of the crosslinking reactive group in the foregoing block copolymer.

For example, compounds described in *Crosslinking Agents Handbook*, compiled by Shinzo Yamashita and Tosuke Kaneko and published by Taseisha (1981) and *Polymer Data Handbook: Basic Compilation*, compiled by The Society of Polymer Science, Japan and published by Baifukan Co., Ltd. (1986) can be used.

Examples include organic silane based compounds, polyisocyanate based compounds, polyol based compounds, polyamine based compounds, acid anhydride compounds, polyepoxy group-containing compounds and epoxy resins (for example, compounds described in *New Epoxy Resins*, compiled and written by Hiromu Horiuchi and published by Shokodo Co., Ltd. (1985) and *Epoxy Resins*, compiled and written by Kuniyuki Hashimoto and published by The Nikkan Kogyo Shimbun, Ltd. (1969)), melamine resins (for example, compounds described in *Urea and Melamine Resins*, compiled and written by Ichiro Miwa and Hideo Matsunaga and published by The Nikkan Kogyo Shimbun, Ltd. (1969)), and poly(meth)acrylate based compounds (for example, compounds described in Oligomers, compiled by Shin Ogawara, Takeo Saegusa and Toshinobu Higashimura and published by Kodansha Ltd. (1976) and *Functional Acrylic Resins*, written by Eizo Ohmori and published by Techno Systems (1985)).

For example, in the case where the crosslinking reactive group is a hydrolyzable silyl group, acid or base catalysts, or metal chelate compounds known as a catalyst in sol-gel reaction can be used as the curing accelerator.

Examples of the acid include Bronsted acids such as inorganic acids (for example, hydrochloric acid, sulfuric acid, nitric acid, and phosphoric acid) and organic acids (for example, acetic acid, formic acid, methanesulfonic acid, trifluoromethylsulfonic acid, and p-toluenesulfonic acid); and Lewis acids (for example, dibutyltin dilaurate, dibutyltin diacetate, dibutyltin dioctate, triisopropoxy aluminum, tetrabutoxy zirconium, and tetrabutoxy titanate).

Examples of the base include inorganic or organic compounds such as ammonia, triethylamine, pyridine, and tetramethylethylenediamine.

Examples of the metal chelate compound include chelate compound of an active methylene compound (for example, ketones and β-keto esters) with a metal atom (for example, Al, Ti, and Zr). For example, compounds described in paragraph Nos. (0044) to (0046) of JP-A-11-106704 are enumerated.

Of these, tri-n-butoxyethyl acetoacetate zirconium, diisopropoxy bis(acetylacetonato)titanium, diisopropoxy-ethyl acetoacetate aluminum, and tri(ethylacetoacetonato)-aluminum are preferable.

The amount of the curing accelerator to be used varies depending upon the kind of the compound and a difference of the crosslinking reactive group. However, in general, it is preferably from about 0.1 to 15% by weight, and more preferably from 0.5 to 5% by weight based on the whole of solids of the cured film-forming composition.

Also, from the viewpoint of the storage stability of the cured film-forming composition, a compound capable of generating a curing accelerator such as acids and bases by the action of light may be used. In the case where such a compound is used, curing of the coating becomes possible upon irradiation of active energy rays.

As the compound capable of generating an acid by the action of light, various examples are described in, for example, *Imaging Organic Materials*, compiled by The Japanese Research Association for Organic Electronics Materials (Bun-Shin Shuppan), pp.187–198 and JP-A-10-282644, and theses known compounds can be used. Specific examples include various onium salts (for example, diazonium salts, ammonium salts, phosphonium salts, iodonium salts, sulfonium salts, selenonium salts, and arsonium salts) containing $RSO_3^-$ (wherein R represents an alkyl group or an aryl group), $AsF_6^-$, $SbF_6^-$, $PF_6^-$, $BF_4^-$, etc. as a counter ion; organic halides such as trihalomethyl group-substituted oxadiazole derivatives or s-triazine derivatives; o-nitrobenzyl esters, benzoin esters, and imino esters of organic acids; and disulfone compounds. Of these, onium salts are preferable, and sulfonium salts and iodonium salts are especially preferable. As the compound capable of generating a base by the action of light, known compounds can be used. Specific examples include nitrobenzyl carbamates and dinitrobenzyl carbamates.

In the invention, it is especially preferred to use the foregoing compound capable of generating an acid by the action of light. A sensitizing dye can be preferably used together with the compound capable of generating an acid or a base. The addition amount of the compound capable of accelerating curing reaction by the action of light according to the invention is preferably from 0.1 to 15% by weight, and more preferably from 0.5 to 5% by weight based on the whole of solids of the cured film-forming composition.

Further, a dehydrating agent may be used as other curing accelerator capable of accelerating curing. Examples of the dehydrating agent include orthocarboxylic esters (for example, methyl orthoformate, ethyl orthoformate, and methyl orthoacetate) and acid anhydrides (for example, acetic anhydride).

Also, it is preferred to use an organometallic compound as the curing agent. Examples thereof include organometallic compounds of Si, Al, Ti, Zr, etc.

Specific examples include tetramethoxysilane, tetraethoxysilane, tetraisopropoxysilane, tetra-n-butoxysilane, methyltrimethoxysilane, methyltriethoxysilane, ethyltrimethoxysilane, vinyltrimethoxysilane, vinyltriethoxysilane, phenyltrimethoxysilane, phenyltriethoxysilane, $CF_3CH_2CH_2Si(OCH_3)_3$, $CF_3(CF_2)_5CH_2CH_2Si(OCH_3)_3$, γ-glycidoxypropyltrimethoxysilane, γ-glydioxypropyltriethoxysilane, γ-aminopropyltrimethoxysilane, γ-trimethoxysilylpropyl isocyanate, γ-methylmercaptopropyltrimethoxysilane, γ-methacryloxypropyltrimethoxysilane, γ-acryloxypropyltrimethoxysilane, dimethyldimethoxysilane, dimethyldiethoxysilane, γ-glycidoxypropylmethyldimethoxysilane, γ-aminopropylmethyltriethoxysilane, γ-mercaptopropylmethyldimethoxysilane, γ-methacryloxypropylmethyldimethoxysilane, tetrabutoxytitanium, and tripropoxy aluminate. However, it should not be construed that the invention is limited thereto.

More preferably, organosilane compounds represented by formula $(R^{61})Si(OR^{71})_3$ or $(R^{61})(R^{62})Si(OR^{71})_2$, wherein at least one of the substituents $R^{61}$ and $R^{62}$ contains a fluorine atom are enumerated.

Here, $R^{61}$ represents an organic group having from 1 to 10 carbon atoms, and examples thereof include $CF_3CH_2$—, $(CF)_2CH$—, $CF_2{=}CF$—, $CF_3CH_2CH_2CH_2$—, $C_2F_5CH_2CH_2CH_2$—, $C_3F_7CH_2CH_2CH_2$—, $C_2F_5CH_2CH_2$—, $CF_3OCH_2CH_2CH_2$—, $C_2F_5OCH_2CH_2CH_2$—, $C_3F_7OCH_2CH_2CH_2$—, $(CF_3)_2CHOCH_2CH_2CH_2$—, $C_4F_9CH_2OCH_2CH_2CH_2$—, 3-(perfluorocyclohexyloxy) propyl, $H(CF_2)_4CH_2OCH_2CH_2CH_2$—, and $H(CF_2)_4CH_2CH_2CH_2$—.

In the organosilanes, $R^{71}$ represents an alkyl group having from 1 to 5 carbon atoms or an acyl group having from 1 to 4 carbon atoms, and examples thereof include a methyl group, an ethyl group, a propyl group, a butyl group, a pentyl group, and an acetyl group. Also, $R^{62}$ represents an organic group having from 1 to 10 carbon atoms, and examples thereof include an alkyl group (for example, a methyl group, an ethyl group, a propyl group, a butyl group, a cyclohexyl group, and a cyclohexylmethyl group), an organic group (for example, a γ-chloropropyl group, a vinyl group, a γ-glycidoxypropyl group, a γ-methacryloyloxypropyl group, a γ-mercaptopropyl group, a phenyl group, and a 3,4-epoxycyclohexylethyl group), or a fluorine-containing organic group the same as in $R^{61}$.

The addition amount of the foregoing silane compound as the curing agent is preferably from about 0.5 to 300 parts by weight, and especially preferably from about 5.0 to 100 parts by weight based on 100 parts by weight of the block copolymer.

On the other hand, in the case where the foregoing reactive group represents an active hydrogen-containing group such as an amino group and a mercapto group, examples of the curing agent to be used include polyisocyanate based curing agents, aminoplasts, and polybasic acids or anhydrides thereof.

Examples of the polyisocyanate based curing agent include polyisocyanate compounds (for example, m-xylylene diisocynate, toluene-2,4-diisocynate, hexamethylene diisocyanate, and isophorone diisocyanate); silyl isocyanate compounds (for example, methylsilyl triisocyanate) and partial condensates, polymers, and adducts with a polyhydric alcohol, a low-molecular weight polyester coating, etc. of these isocyanate compounds; and block polyisocyanate compounds resulting from blocking the isocyanate group by a blocking agent such as phenol.

Examples of the aminoplast include melamine coatings, guanamine coatings, and urea coatings. Of these, methylolmelamines at least partially etherified with one or two or more kinds of lower alcohols (for example, methanol, ethanol, propanol, and butanol) (for example, hexamethyl etherified methylolmelamine, hexabutyl etherified methylolmelamine, methyl/butyl mixture etherified methylolmelamine, methyl etherified methylolmelamine, and butyl etherified methylolmelamine) or condensates thereof are preferable.

Examples of the polybasic acid or its anhydride include aromatic polyhydric carboxylic acids or anhydrides thereof (for example, pyromellitic acid, pyromellitic anhydride, trimellitic acid, trimellitic anhydride, phthalic acid, and phthalic anhydride) and aliphatic polyhydric carboxylic acids or anhydrides thereof (for example, maleic acid, maleic anhydride, succinic acid, and succinic anhydride).

On the other hand, in the case where the crosslinking reactive group is an epoxy group or an oxetanyl group, the curing can be carried out by chemical reaction with an active hydrogen-containing reactive group (for example, a hydroxyl group, a carboxyl group, and an amino group) or a cyclic acid anhydride-containing group.

In this regard, the foregoing both reactive groups may be contained as a copolymer component in the block copolymer, or block copolymers each containing at least one kind of the respective reactive groups may be used together.

In this case, likewise the foregoing case, an acid, a base, or a compound capable of generating an acid or a base by light and/or heat is used as the curing accelerator.

As other preferred embodiment, curing agents comprising a polyfunctional compound containing at least two of the foregoing active hydrogen-containing reactive group or cyclic acid anhydride-containing group capable of reacting with an epoxy group or an oxetanyl group in the molecule are enumerated.

Also, in the case of a cationic polymerizable group (the cationic polymerizable group means a reactive group capable of causing polymerization reaction and/or crosslinking reaction when active energy rays are irradiated in the presence of an active energy ray-sensitive cationic polymerization initiator), representative examples of the cationic polymerizable group include an epoxy group, an oxetanyl group, a cyclic acetal group, a cyclic lactone group, a cyclic thioether group, a spiroorthoester group, and a vinyl ether group. In the invention, these cationic polymerizable group-containing compounds may be used singly or in combinations of two or more thereof.

Specific examples of the cationic polymerizable compound are as follows.

(1) Epoxy group-containing compounds such as alicyclic epoxy resins, aliphatic epoxy resins, and aromatic epoxy resins.
(2) Oxetane compounds such as trimethylene oxide, 3,3-dimethyloxetane, 3,3-dichloromethyloxetane, 3-methyl-3-phenoxymethyloxetane, and 1,4-bis[(3-ethyl-3-oxetanylmethoxy)methyl]benzene; oxolane compounds such as tetrahydrofuran and 2,3-dimethyltetrahydrofuran; and cyclic ether or cyclic acetal compounds such as trioxane, 1,3-dioxolane, 1,3,6-trioxane, and cyclooctane.
(3) Cyclic lactone compounds such as β-propiolactone and ε-caprolactone.
(4) Thiirane compounds such as ethylene sulfide and thioepichlorohydrin.
(5) Thiethane compound such as 1,3-propyne sulfide and 3,3-dimethylthiethane.
(6) Vinyloxy group-containing vinyl ether compounds.
(7) Spiroorthoester compounds obtained by reaction of an epoxy compound and a lactone.
(8) Bicycloorthoester compounds.

Above all, in the invention, epoxy group-containing compounds and vinyloxy group-containing compounds (hereinafter referred to as "epoxy compounds" and "vinyloxy compounds", respectively) are preferably used as the cationic polymerizable organic compound. Of these, polyepoxy compounds having two or more epoxy groups in one molecule, polyvinyloxy compounds having two or more vinyloxy groups in one molecule, and compounds at least having one or more of each of an epoxy group and a vinyloxy group in one molecule are more preferable. Especially, when an epoxy compound (a mixture of epoxy compounds) containing an alicyclic polyepoxy compound having two or more epoxy groups in one molecule, with the content of the alicyclic polyepoxy compound being 30% by weight or more, and more preferably 50% by weight or more based on the total weight of the epoxy compound, is used, the cationic polymerization rate, thick film curing property, resolution, ultraviolet permeability, and other properties become better. Further, the viscosity of the cured film-forming composition becomes low so that the film formation can be carried out smoothly.

Examples of the foregoing aliphatic epoxy resin include cyclohexene oxide-containing compounds and cyclopentene oxide-containing compound obtained by epoxidizing a polyglycidyl ether of a polyhydric alcohol having at least one alicyclic ring or a compound containing an unsaturated alicyclic ring (for example, cyclohexene, cyclopentene, dicyclooctene, and tricyclodecene) with an adequate oxidizing agent such as hydrogen peroxide and peracids.

Also, examples of the foregoing aliphatic epoxy resin include polyglycidyl ethers of an aliphatic polyhydric alcohol or an alkylene oxide thereof, polyglycidyl esters of an aliphatic long-chain polybasic acid, and a homopolymer or copolymers of glycidyl acrylate or glycidyl methacrylate. Further, besides the foregoing epoxy compounds, monoglycidyl ethers of an aliphatic higher alcohol, glycidyl esters of a higher fatty acid, epoxidized soybean oil, butyl epoxystearate, octyl epoxystearate, epoxidized linseed oil, and epoxidized polybutadiene are enumerated. Polyfunctional epoxy silicones such as K-62-722, manufactured by Shin-Etsu Silicones and UV9300, manufactured by GE Toshiba Silicones and silicone-containing epoxy compounds described in *Journal of Polymer Science: Part A: Polymer Chemistry*, Vol. 28, 497 (1990) can be enumerated.

Also, examples of the foregoing aromatic epoxy resin include mono- or polyglycidyl ethers of a monovalent or polyvalent phenol having at least one aromatic nucleus or an alkylene oxide adduct.

Specific examples thereof include compounds described in paragraph Nos. (0084) to (0086) of JP-A-11-242101.

Of these epoxides, taking into consideration fast curing property, aromatic epoxides and alicyclic epoxides are preferable, and alicyclic epoxides are especially preferable. In the invention, the foregoing epoxides may be used singly or in adequate combinations of two or more thereof.

With respect to the oxetanyl group-containing compound, the number of the oexcetanyl groups to be contained in the molecule is from 1 to 10, and preferably from 1 to 4. It is preferable that the oxetanyl group-containing compound is used together with the epoxy group-containing compound. Specific examples thereof include compounds described in paragraph Nos. (0024) to (0025) of JP-A-2000-239309 and silicon-containing oxetane compounds described in J. V. CRIVELLO, et al., *J.M.S.-PUREAPPL. CHEM., A*30, pp.173–187 (1993).

Examples of the bicycloorthoester compound include compounds described in JP-T-2000-506908, such as 1-phenyl-4-ethyl-2,6,7-trioxabicyclo[2,2,2]octane and 1-ethyl-4-hydroxymethyl-2,6,7-trioxabicyclo[2,2,2]octane.

Examples of the spiroorthoester compound include compounds such as 1,5,7,11-tetraoxaspiro[5,5]undecane, 3,9-dibenzyl-1,5,7,11-tetraoxaspiro[5,5]undecane, 1,4,6-trioxaspiro[4,4]nonane, 2-methyl-1,4,6-trioxaspiro-[4,4]nonane, and 1,4,6-trioxaspiro[4,5]decane.

Examples of the vinyloxy compound include alkenyl vinyl ether compounds such as 2-methacryloyloxyethyl vinyl ether and 2-acryloyloxyethyl vinyl ether; cationic polymerizable nitrogen-containing compounds such as N-vinylcarbazole and N-vinylpyrrolidone; polyfunctional vinyl compounds such as butanediol divinyl ether, triethylene glycol divinyl ether, cyclohexanediol vinyl ether, 1,4-benzenedimethanol divinyl ether, hydroquinone divinyl ether, and resorcinol divinyl ether; propenyl compounds described in *Journal of Polymer Science: Part A: Polymer Chemistry*, Vol. 32, 2895 (1994); alkoxyallene compounds described in *Journal of Polymer Science: Part A: Polymer Chemistry*, Vol. 33, 2493 (1995); vinyl compounds described in *Journal of Polymer Science: Part A: Polymer Chemistry*, Vol. 34, 1015 (1996); and isopropenyl compounds described in *Journal of Polymer Science: Part A: Polymer Chemistry*, Vol. 34, 2051 (1996). Specific examples thereof include compounds described in paragraph Nos. (0022) to (0029) of JP-A-2002-29162.

Of these vinyloxy compounds, taking into consideration the curing property, adhesion and surface hardness, di- or trivinyl ether compounds are preferable. In the invention, the foregoing vinyl ether compounds may be used singly or in adequate combinations of two or more thereof.

In the case where these curing agents are added, the addition amount is preferably from about 0.5 to 300 parts by weight, and especially preferably from about 5.0 to 100 parts by weight based on 100 parts by weight of the foregoing block copolymer. Also, a curable compound comprising such a cationic polymerizable reactive group, an acid, or a photo acid-generating compound is used as the curing accelerator.

There are enumerated known compounds and mixtures thereof such as photo initiators of photo cationic polymerization, photo color fading agents of dyes, photo discoloring agents, or known acid generators to be used in micro resists. Also, examples of the acid generator include organic halides and disulfone compounds. Specific examples of the organic halides and disulfone compounds include those the same as in the foregoing compounds capable of generating a radical.

Examples of the onium compound include diazonium salts, ammonium salts, iminium salts, phosphonium salts, iodonium salts, sulfonium salts, arsonium salts, and selenonium salts. For example, compounds described in paragraph Nos. (0058) to (0059) of JP-A-2002-29162 are enumerated.

In the invention, onium salts are enumerated as the acid generator to be especially preferably used. Above all, diazonium salts, iodonium salts, sulfonium salts, and iminium salts are preferable from the standpoints of photosensitivity to photopolymerization initiation and material stability of compound. Specific examples of the onium salt that can be suitably used in the invention include amylated sulfonium satls described in paragraph No. (0035) of JP-A-9-268205, diaryl iodonium salts or triaryl sulfonium salts described in paragraph Nos. (0010) to (0011) of JP-A-2000-71366, sulfonium salts of thiobenzoic acid S-phenyl ester described in paragraph No. (0017) of JP-A-2001-288205, and onium salts described in paragraph Nos. (0030) to (0033) of JP-A-2001-133696.

Other examples of the acid generator include compounds such as organometallic/organic halogenated compounds described in paragraph Nos. (0059) to (0062) of JP-A-2002-29162, photo acid generators having an o-nitrobenzyl type protective group, and compounds that are photodecomposed to generate sulfonic acid (for example, iminosufonates).

On the other hand, in the case where the foregoing reactive group has a radical polymerizable unsaturated double bond (for example, an acryloyl group, a methacryloyl group, and a styryl group), it is preferable that a radical polymerizable compound is used as the curing agent and that a compound capable of generating a radical by light and/or heat is used as the curing accelerator. The radical polymerizable compound is preferably a polyfunctional compound containing from 2 to 10 polymerizable groups, and more preferably a polyfunctional compound containing from 2 to 6 polymerizable groups. That is, it is preferable that a polymerizable compound containing a polymerizable group capable of undergoing well copolymerization with a radical polymerizable group as the foregoing reactive group is adequately chosen and combined.

Examples of the polymerizable compound that can be used include unsaturated carboxylic acids (for example, acrylic acid, methacrylic acid, itaconic acid, crotonic acid, isocrotonic acid, and maleic acid) and esters and amides thereof. Above all, esters of an unsaturated carboxylic acid and an aliphatic polyhydric alcohol and amides of an unsaturated carboxylic acid and an aliphatic polyhydric amine compound are preferably used. Also, addition reaction products of an unsaturated carboxylic acid ester or amide having a nucleating substituent (for example, a hydroxyl group, an amino group, and a mercapto group) with a monofunctional or polyfunctional isocyanate or an epoxy compound, or dehydration condensation reaction products thereof with a polyfunctional carboxylic acid are suitably used. Also, addition reaction products of an unsaturated carboxylic acid ester or amide having a nucleophilic substituent (for example, an isocyanate group and an epoxy group) with a monofunctional or polyfunctional alcohol, amide and a thiol, and substitution reaction products of an unsaturated carboxylic acid ester or amide having an eliminating substituent (for example, a halogen group and a tosyloxy group) with a monofunctional or polyfunctional alcohol, an amine and a thiol are suitable. Also, as other examples, a group of compounds in which the forgoing unsaturated carboxylic acids are substituted with an unsaturated phosphonic acid, styrene, or the like can be used.

As the ester of an unsaturated carboxylic acid and an aliphatic polyhydric alcohol compound, polymeric compounds obtained by using ethylene glycol, propylene glycol, 1,4-butanedil, neopentyl glycol, trimethylolpropane, hexanediol, cyclohexyl diol, cyclohexanedimethanol, pentaerythritol, dipentaerythritol, digylcerol, sorbitol, etc. as the aliphatic polyhydric alcohol compound and subjecting the aliphatic polyhydric alcohol compound to mono-substitution or poly-substitution with an unsaturated carboxylic acid (for example, crotonic acid, acrylic acid, methacrylic acid, itaconic acid, and maleic acid) are enumerated.

As other examples of the ester, vinyl methacrylate, allyl methacrylate, allyl acrylate, aliphatic alcohol based esters described in JP-B-46-27926, JP-B-51-47334, and JP-A-57-196231, esters having an aromatic based skeleton described in JP-A-59-5240, JP-A-59-5241, and JP-A-2-226149, and esters having an amino group described in JP-A-1-165613 are suitably used.

Also, specific examples of amide monomers between an aliphatic polyhydric amine compound and an unsaturated carboxylic acid include methylene bis(meth)acrylamide, 1,4-tetramethylene bis (meth)acrylamide, 1,6-hexamethylene bis(meth)acrylamide, diethylenetriamine tris(meth)acrylamide, and xylylene bis(meth)acrylamide.

As other preferred examples of the amide based monomer, those having a cyclohexylene structure described in JP-B-54-21726 can be enumerated.

Also, urethane based addition polymerizable compounds produced using addition reaction between an isocyanate and a hydroxyl group are suitable. Specific examples thereof include vinyl urethane compounds containing two or more polymerizable vinyl groups in one molecule resulting from addition of a hydroxyl group-containing vinyl monomer having two or more isocyanate groups in one molecule as described in JP-B-48-41708.

Also, urethane acrylates described in JP-A-51-37193, JP-B-2-32293, and JP-B-2-16765 and compounds having an ethylene oxide based skeleton described in JP-B-58-49860, JP-B-56-17654, JP-B-62-39417, and JP-B-62-39418 are enumerated.

Further, radical polymerizable compounds having an amino structure or a sulfide structure in the molecule, as described in JP-A-63-277653, JP-A-63-260909, and JP-A-1-105238 may be used.

As other examples, polyfunctional acrylates or methacrylates such as polyester acrylates and epoxy acrylates resulting from reaction of an epoxy resin and (meth)acrylic acid, as described in JP-A-48-64183, JP-B-49-43191, and JP-B-52-30490, can be enumerated. Also, specific unsaturated compounds described in JP-B-46-43946, JP-B-1-40337, and JP-B-1-40336 and vinylsulfonic acid based compounds described in JP-A-2-25493 can be enumerated. Also, in some case, perfluoroalkyl group-containing structures described in JP-A-61-22048 are suitably used. Further, compounds introduced as a photo-curable monomer or oligomer in *Nippon Setchaku Kyoukaishi*, Vol. 20, No. 7, pp.300–308 (1984) can be used.

Further, fluorine atom-containing monofunctional or polyfunctional compounds are also preferable, and examples include compounds described in paragraph Nos. (0059) to (0066) of JP-A-2000-275403.

The compound capable of generating a radical, which is suitably used in the invention, means a compound that generates a radical upon irradiation with light and/or heat to initiate and accelerate the polymerization of a polymerizable unsaturated group-containing compound.

Known polymerization initiators and compounds having a bond with small bond dissociation energy can be adequately chosen and used. Also, the compound capable of generating a radical can be used singly or in combinations of two or more thereof.

Examples of the compound capable of generating a radical include conventionally known heat radical polymerization initiators such as organic peroxides and azo based polymerization initiators, amine compounds (for example, those described in JP-B-44-20189); and photo radical polymerization initiators such as organic halides, carbonyl compounds, metallocene compounds, hexaaryl biimidazole compounds, organic boric acid salt compounds, and disulfone compounds.

Specific examples of the foregoing organic halide include compounds described in Wakabayashi, et al., *Bull. Chem. Soc. Japan,* 42, 2924 (1969), U.S. Pat. No. 3,905,815, JP-A-63-298339, and M. O. Hutt, *Journal of Heterocyclic Chemistry,* 1 (No. 3), (1970), especially, trihalomethyl group-substituted oxazole compounds and s-triazine compounds.

More suitably, s-triazine derivatives having at least one mono-, di- or trihalogen-substituted methyl group bonded on the s-triazine ring are enumerated.

Other examples of the organic halide include ketones, sulfides, sulfones, and nitrogen atom-containing heterocyclic compounds described in paragraph Nos. (0039) to (0048) of JP-A-5-27830.

Examples of the foregoing carbonyl compound include compounds described in Latest *UV Curing Technologies*, pages 60 to 62 (published by Technical Information Institute Co., Ltd., 1991), paragraph Nos. (0015) to (0016) of JP-A-8-134404, and paragraph Nos. (0029) to (0031) of JP-A-11-217518, and specific examples include acetophenone based compounds, hydroxyacetophenone based compounds, benzophenone based compounds, thioxathane based compounds, benzoin compounds (for example, benzoin ethyl ether and benzoin isobutyl ether), benzoic ester derivatives (for example, ethyl p-dimethylaminobenzoate and ethyl p-diethylaminobenzoate), benzyl dimethyl ketal, and acyl phosphine oxide.

Examples of the foregoing organic peroxide include compounds described in paragraph No. (0019) of JP-A-2001-139663.

Examples of the foregoing metallocene compound include various titanocene compounds described in JP-A-2-4705 and JP-A-5-83588 and iron-arene complexes described in JP-A-1-304453 and JP-A-1-152109.

Examples of the foregoing hexaaryl biimidazole compound include various compounds described in JP-B-6-29285 and U.S. Pat. Nos. 3,479,185, 4,311,783 and 4,622,286.

Examples of the foregoing organic boric acid salt compound include compounds described in Japanese Patent No.

2,764,769, JP-A-2002-116539, and Kunz, Martin, *Rad Tech '98: Proceeding April*, pp.19–22, 1998, Chicago. Specific examples include compounds described in paragraph Nos. (0022) to (0027) of the above-cited JP-A-2002-116539.

As other organoboron compounds, specific examples include organoboron transition metal coordinated complexes described in JP-A-6-348011, JP-A-7-128785, JP-A-7-140589, JP-A-7-306527, and JP-A-7-292014.

Examples of the foregoing sulfone compound include compounds described in JP-A-5-239015; and examples of the foregoing disulfone compound include compounds represented by formulae (II) and (III) described in JP-A-61-166544.

These radical generating compounds may be added singly or in combinations of two or more thereof. The addition amount is from 0.1 to 30% by weight, preferably from 0.5 to 25% by weight, and especially preferably from 1 to 20% by weight based on the total amount of the radical polymerizable monomers. When the addition amount falls within this range, the cured film-forming composition becomes highly polymerizable so that there is no problem in elapsing stability.

A sensitizing dye can also be preferably used in combination with the photo radical polymerization initiator.

In the case where the compound capable of initiating the radical polymerization by the action of heat or light is used as the curing agent, its addition amount may be an amount in which polymerization of the carbon-carbon double bond initiates. In general, it is preferably from 0.1 to 15% by weight, and more preferably from 0.5 to 5% by weight based on the whole of solids in the cured film-forming composition.

In the case where such a curing agent is added, likewise other curing agents, the addition amount is preferably from about 0.5 to 300 parts by weight, and especially preferably from about 5.0 to 100 parts by weight based on 100 parts by weight of the foregoing block copolymer.

Also, it is preferred to use a compound containing at least one of the respective radical polymerizable group and cationic polymerizable group in the molecule as the curing agent. Examples include compounds described in paragraph Nos.

(0031) to (0052) of JP-A-8-277320 and compounds described in paragraph No. (0015) of JP-A-2000-191737, but it should not be construed that the invention is limited thereto.

The foregoing radical polymerizable compound and cationic polymerizable compound are preferably contained in a proportion of from 90/10 to 20/80, and more preferably from 80/20 to 30/70 in terms of a weight ratio of the radical polymerizable compound to the cationic polymerizable compound.

In the case where the foregoing radical polymerizable compound and the foregoing cationic polymerizable compound are used as the curing agent, it is preferable that the radical polymerization initiator and the cationic polymerization initiator are used as the curing accelerator in amounts of from 0.5 to 10 parts by weight (more preferably from 1 to 5 parts by weight) and from 1 to 10 parts by weight (more preferably from 2 to 6 parts by weight), respectively based on 100 parts by weight of the total sum of the curing agents.

Also, in the case where the polymerization reaction is carried out upon irradiation of ultraviolet rays, the conventionally known ultraviolet spectral sensitizer and chemical sensitizer may be used jointly as the curing accelerator. Examples include Michler's ketone, amino acids (for example, glycine), and organic amines (for example, butylamine and dibutylamine).

Also, in the case where the polymerization reaction is carried out upon irradiation with near infrared rays, it is preferred to use jointly a near infrared spectral sensitizer as the curing accelerator. Any light absorbing substance having an absorption band in at least a part of the wavelength region of 700 nm or longer may be used as the near infrared spectral sensitizer to be used jointly, and compounds having a spectral absorptivity coefficient of 10,000 or more. Further, compounds having absorption in the region of from 750 to 1,400 nm and having a spectral absorptivity coefficient of 20,000 or more are preferable. Also, compounds that have a valley in the visible light wavelength region of from 420 nm to 700 nm and are optically transparent are more preferable. As the near infrared spectral sensitizer, various pigments and dyes known as near infrared absorbing pigments and near infrared absorbing dyes can be used. Above all, the conventionally known near infrared absorbers are preferably used.

Commercially available dyes and known dyes described in documents (for example, "Near Infrared Absorbing Dyes" of *Kagaku Kogyo*, May 1986, pages 45 to 51, *Development and Market Trend of Functional Dyes in the* 1990's, Chapter 2, Paragraph 2.3 (1990), CMC Publishing Co., Ltd., *Special Functional Dyes* (compiled by Ikemori and Hashiradani, 1986, CMC Publishing Co., Ltd.), J. FABRIAN, *Chem. Rev.*, 92, pp.1197–1226 (1992), the Catalog published by Nippon Kanko Shikiso Kenkyusho K.K. (1995), and the Laser Dye Catalog published by Exciton Inc. (1989)) or patents can be applied.

(Fine Particle)

In the invention, in order to enhance the strength of cured film constituting the ink repelling treated portion, it is preferable that inorganic particles or organic particles having a mean particle size smaller than the cured film thickness are contained. In particular, inorganic particles having a Moh's hardness of 2 or more are preferable. The size of the particles is preferably from 0.003 to 5 μm, more preferably from 0.005 to 1 μm, especially preferably not more than 100 nm, and most preferably from 0.05 to 0.1 μm. In summary, in the invention, it is preferable that the foregoing cured film-forming composition contains inorganic particles having a mean particle size of not more than 100 nm.

The addition amount of these fine particles is preferably from 1 to 90% by weight, more preferably from 3 to 80% by weight, and further preferably from 5 to 60% by weight in the whole of solids of the cured film-forming composition. When the addition amount of the fine particles falls within this range, mechanical strengths of the film such as strength, hardness and abrasion resistance of the cured film are enhanced.

Also, an embodiment in which ultra-fine particles having a mean particle size of from 5 to 100 nm and fine particles having a mean particle size of from 0.15 to 5 μm are used jointly. It is more preferable that ultra-fine particles having a mean particle size of from 5 to 80 nm and fine particles having a mean particle size of from 0.15 to 3 μm are used jointly.

In the case where ultra-fine particles and fine particles are used jointly, the total sum of the both particles is preferably from 0.05 to 85% by weight, more preferably from 1 to 75% by weight, and further preferably from 3 to 65% by weight in terms of the amount of the ultra-fine particles to be used. When the total sum of the both particles falls within this range, it is possible to enhance the strength of the cured film and to control the surface shape of the cured film in the irregular state.

The shape of the foregoing inorganic particle is not particularly limited but is preferably in the rice grain shape, spherical shape, cubic shape, spindle shape, or amorphous shape. The inorganic particles can be used singly or in admixture of two or more thereof.

Examples of the foregoing inorganic particle include metal grains (for example, iron, copper, nickel, stainless steel, tin, gold, and silver), metal nitrides (for example, silicon nitride, boron nitride, and titanium nitride), metal oxides (for example, oxides of Mg, Ca, Si, Al, Ti, Zr, V, Nb, La, In, Ce, La, Ta, Y, Zn, Sb, B, Sn, Fe, W, Ir, Cr, Mo, Sr, and Pt), composite metal oxides (for example, composite oxides of the foregoing metals), metal carbonates (for example, carbonate of Ca, Ba, and Mg), metal sulfides (for example, zinc sulfide), metal sulfates (sulfates of Ba, Ca, and Sr), metal halides (for example, magnesium fluoride and calcium fluoride), metal carbides (for example, tungsten carbide, molybdenum carbide, and silicon carbide), and carbon allotropes (for example, graphite and diamond).

Of these, metal nitrides, metal oxides, and composite metal oxides are preferable in view of durability to an ink solution, etc. Metal oxides and composite metal oxides are more preferable, and silicon oxide, titanium oxide, aluminum oxide, and zirconium oxide are further preferable.

In general, since the inorganic particle is poor in affinity with a binder polymer, when the both are merely mixed with each other, the interface is liable to break, and the resulting film is liable to break so that it is difficult to improve the strength and scratch resistance of the film. Now, for the sake of improve the affinity between the inorganic particle and the binder polymer, it is possible to treat the surface of the inorganic particle with a surface modifier containing an organic segment. It is preferable that the surface modifier not only forms a bond with the inorganic particle but also has high affinity with the binder polymer. As organic compounds to be used for the surface treatment, surface modifiers for inorganic fillers such as the conventionally known metal oxides and inorganic pigments can be used. For example, they are described in *Stabilization of Pigment Dispersion and Surface Treatment Technologies and Evaluation*, Chapter 1 (published by Technical Information Institute Co., Ltd. (2001)).

Specific examples include organic compounds having a polar group having affinity with the surface of the inorganic particle and coupling compounds. Examples of the polar group having affinity with the surface of the inorganic particle include a carboxy group, a phosphono group, a hydroxyl group, a mercapto group, a cyclic acid anhydride group, and an amino group, and compounds having at least one of these groups in the molecule are preferable. For example, there are enumerated long chain aliphatic carboxylic acids (for example, stearic acid, lauric acid, oleic acid, linolic acid, and linoleic acid), polyol compounds (for example, pentaerythritol triacrylate, dipentaerythritol pentaacrylate, and ECH-modified glycerol triacrylate), phosphono group-containing compounds (for example, EO (ethylene oxide) modified phosphoric acid triacrylate), and alkanolamines (for example, ethylenediamine EO adduct (5 moles)).

As the coupling compound, the conventionally known organometallic compounds are enumerated, and examples thereof include silane coupling agents, titanate coupling agents, aluminate coupling agents, and zirconate coupling agents. Specific examples include compounds described in JP-A-2002-9908 and paragraph Nos. (0011) to (0015) of JP-A-2001-310423.

These surface treating agents can be used in combinations of two or more thereof.

Examples of the foregoing organic particle include higher fatty acid metal salts (for example, zinc stearate), (meth) acrylate resins, (meth)acrylamide resins, polystyrene based resins, polysiloxanes, melamine resins, benzoguanamine resins, fluorine resins such as polytetrafluoroethylene, vinylidene fluoride resins, epoxy resins, phenol resins, polyurethane resins, cellulose acetate, polycarbonates, nylon resins, and resin fine particles such as crosslinked rubber fine particles of SBR and NBR. Also, fine particles composed of a composite of these organic particles are preferable. Organic crosslinked particles resulting from internal crosslinking by copolymerization with a monomer having a bifunctional or polyfunctional polymerizable group are also preferably used.

The foregoing organic crosslinked particles can be arbitrarily chosen from soft rubber fine particles until hard fine particles. For example, with respect to the foregoing inorganic crosslinked fine particles having a high hardness, when the addition amount is increased in the curing resin layer, the curing shrinkage amount and hardness are enhanced, but there is some possibility that the resulting film is brittle and tends to break. In such case, by simultaneously adding organic crosslinked particles whose hardness has been arbitrarily adjusted, it is possible to make the resulting film hardly break, and hence, such is preferable. Also, core-shell particles comprising a core having a high hardness and a shell having a low hardness, or a core having a low hardness and a shell having a high hardness can be employed. Also, for the purpose of ensuring dispersion stability in the curing resin layer or coating solvent, it is also preferred to employ core-shell particles whose hydrophilicity or hydrophobicity has been changed. Also, it is possible to employ organic-inorganic composite fine particles using fine particles composed of inorganic crosslinked particles in the core. In the case where such crosslinked fine particles are employed as core-shell particles, both or either one of the core portion and the shell portion may be crosslinked.

(Conductive Fine Particle)

It is preferable that the foregoing cured film-forming composition further contains conductive ultra-fine particles. In this way, in particular, in the case where a fluorine-containing polymer component is used, easiness of electrification of the surface of the film caused by the fluorine-containing polymer is suppressed, and in the case where the head portion does not come into contact with the ink solution, attachment of dusts such as paper powders is suppressed.

As the conductive ultra-fine particles, inorganic compounds described in *The State and Prospect of Transparent Conductive Films*, Chapters 3 to 4, compiled by the Search Department of Toray Research Center, Inc. (published by Toray Research Center, Inc., 1997) and Development and Application of Conductive Fillers, compiled by Technical Information Institute Co., Ltd. (published by Technical Information Institute Co., Ltd., 1997) are enumerated. Specific examples thereof include conductive metal oxide fine particles such as ITO, ATO, $Sb_2O_3$, $SbO_2$, $In_2O_3$, $SnO_2$, conductive ZnO, AZO (Al-doped zinc oxide), and antimony pentoxide zinc; conductive nitrides such as titanium nitride, zirconium nitride, and hafnium nitride; and metal particles such as gold, silver, and copper. Of these, conductive oxide particles such as ITO and ATO are preferable.

The foregoing conductive ultra-fine particles preferably have a mean particle size of from 0.001 to 5 μm, and more preferably from 0.005 to 1 μm.

(Dispersion Medium)

In the invention, a dispersion medium that is provided for wet dispersion of the inorganic particles can be used by adequately choosing from water and organic solvents. Liquids having a boiling point of 50° C. or higher are preferable, and organic solvents having a boiling point ranging from 60° C. to 180° C. are more preferable.

The dispersion medium is preferably used in a proportion of from 0.5 to 50% by weight, and more preferably from 1 to 30% by weight in terms of solids content of the whole of the dispersing composition containing the inorganic particles and a dispersant. When the proportion of the dispersion medium falls within this range, dispersion easily proceeds, whereby the resulting dispersion has a viscosity range where the workability is good.

Examples of the dispersion medium include alcohols, ketones, esters, amides, ethers, ether esters, hydrocarbons, and halogenated hydrocarbons. Specific examples include alcohols (for example, methanol, ethanol, propanol, butanol, benzyl alcohol, ethylene glycol, propylene glycol, and ethylene glycol monoacetate), ketones (for example, methyl ethyl ketone, methyl isobutyl ketone, cyclohexanone, and methylcyclohexanone), esters (for example, methyl acetate, ethyl acetate, propyl acetate, butyl acetate, ethyl formate, propyl formate, butyl formate, and ethyl lactate), aliphatic hydrocarbons (for example, hexane and cyclohexane), halogenated hydrocarbons (for example, methylchloroform), aromatic hydrocarbons (for example, benzene, toluene, and xylene), amides (for example, dimethylformamide, dimethylacetatamide, and n-methylpyrrolidone), ethers (for example, dioxane, tetrahydrofuran, ethylene glycol dimethyl ether, and propylene glycol dimethyl ether), and ether alcohols (for example, 1-methoxy-2-propanol, ethyl cellosolve, and methyl carbinol). These solvents may be used singly or in admixture of two or more thereof. Of these dispersion media, toluene, xylene, methyl ethyl ketone, methyl isobutyl ketone, cyclohexanone, and butanol are preferable. Also, coating solvents composed mainly of a ketone solvent (for example, methyl ethyl ketone, methyl isobutyl ketone, and cyclohexanone) are preferably used. The content of the ketone based solvent is preferably 10% by weight or more, more preferably 30% by weight or more, and further preferably 60% by weight or more based on the whole of solvents contained in the coating composition.

(Conversion of Inorganic Particle into Ultra-fine Particle)

When the foregoing inorganic particles are formed into a dispersion by the wet dispersion method, the stability of a liquid of the composition is enhanced. In a cured film formed from the cured film-forming composition, the inorganic particles are uniformly dispersed and exist in the ultra-fine particle state in a matrix of the cured film, whereby the strength of the film can be uniformly enhanced. The size of the inorganic particles present in the matrix of the cured film is preferably not larger than 100 nm, more preferably from 10 to 100 nm, and specially preferably from 10 to 80 nm in terms of mean particle size.

Further, it is preferable that large particles having a mean particle size of 500 nm or more be not present in the cured film, and it is especially preferable that large particles having a mean particle size of 300 nm or more be not present in the cured film. In this way, monodispersibility of the particle size distribution of the dispersed particles is enhanced. As a result, the foregoing film strength becomes good. Also, it is possible to form the surface of the cured film in the specific irregular shape.

For the sake of dispersing the inorganic particles into a size of ultra-fine particles free from coarse particles having the foregoing range, it is preferable that the inorganic particles are dispersed together with the foregoing dispersion medium using media having a mean particle size of smaller than 0.8 mm by the wet dispersion method.

Examples of wet dispersion machines include the conventionally known devices such as a sand grinder mill (for example, a bead mill with pin), a Dyno mill, a high-speed impeller mill, a pebble mill, a roll mill, an attritor, and a colloid mill. In particular, for the purpose of dispersing the oxide fine particles of the invention into ultra-fine particles, a sand grinder mill, a Dyno mill, and a high-speed impeller mill are preferable.

As the media to be used in combination with the foregoing dispersion machine, those having a mean particle size of smaller than 0.8 mm are preferable. In this way, the mean particle size of the inorganic particles becomes not larger than 100 nm, and the particle size can be made uniform. The mean particle size of the media is preferably not larger than 0.5 mm, and more preferably from 0.05 to 0.3 mm.

As the foregoing media, beads are preferable. Specific examples thereof include zirconia beads, glass beads, ceramics beads, and steel beads. Of these, zirconia beads having a mean particle size of from 0.05 to 0.2 mm are especially preferable from the standpoints of durability such that breakage of beads in the dispersion hardly occurs and conversion into ultra-fine particles.

In the dispersion step, the dispersion temperature is preferably from 20 to 60° C., and more preferably from 25 to 45° C. When the inorganic particles are dispersed into ultra-fine particles at a temperature of this range, recoagulation and precipitation of the dispersed particles are not caused. It may be considered that this is caused by the matter that adsorption of the dispersant onto the inorganic compound particles is adequately carried out, whereby dispersion stability failure caused by desorption of the dispersant from the particles at the ambient temperature does not occur.

Only in such range, it is possible to form a cured film that is excellent in film strength and adhesion onto the coating surface.

Also, a preliminary dispersion treatment may be carried out prior to the foregoing wet dispersion step. Examples of dispersion machines to be used for the preliminary dispersion treatment include a ball mill, a three-roll mill, a kneader, and an extruder.

Further, from the standpoint that the dispersed particles in the dispersion are satisfied with the foregoing ranges with respect to the mean particle size and monodispersibility of the particle size, it is preferred to align a filter medium such that precise filtration be carried out in the separation treatment from the beads for the purpose of removing coarse coagulated materials in the dispersion. It is preferable that the filter medium for carrying out precise filtration has a filtered particle size of not larger than 25 μm. The type of the filter medium for carrying out precise filtration is not particularly limited so far as it has the foregoing performance, and examples thereof include a filament type, a felt type, and a mesh type. The material quality of the filter medium for carrying out precise filtration of the dispersion is not particularly limited so far as it has the foregoing performance and does not adversely affect a coating solution, and examples thereof include stainless steel, polyethylene, polypropylene, and nylons.

(Other Components of Cured Film-forming Composition)

Other compounds can be adequately added to the cured film of the invention according to the utility and purpose. For example, besides the foregoing components (such as a curing agent, a curing accelerator, and inorganic particles), resins, surfactants, antistatic agents, coupling agents, thickening agents, antifoaming agents, leveling agents, flame retardants, tackifiers, polymerization inhibitors, antioxidants, and surface modifiers, and the like can be added.

(Formation of Ink Repelling Treated Portion)

In the inkjet recording head of the invention, an ink repelling treated portion (i.e., a portion capable of repelling an ink) is provided by the foregoing cured film-forming composition on a substrate of the ink-jet recording head, followed by curing or other means to form a cured film.

Specifically, as shown in the FIGURE, the ink-jet recording head of the invention comprises a nozzle having a nozzle plate 1 and a nozzle hole 2 (or an discharge opening) in the nozzle plate 1. A cured film is formed at the periphery of the nozzle hole 2, thereby forming an ink repelling treated portion 3.

A method of forming the ink repelling treated portion will be described below. That is, it is preferable that the ink repelling treated portion is constructed by coating a coating solution made of the foregoing cured film-forming composition on a substrate as described later directly or via other layer.

The foregoing coating solution is prepared by mixing and diluting a matrix binder solution containing the block copolymer and the foregoing curing agent and the foregoing curing accelerator to be optionally used, the foregoing fine particles (in particular, the foregoing inorganic particles), and additives in prescribed concentrations, respectively in a coating dispersion medium.

It is preferable that the coating solution to be used for coating is subjected to filtration before coating. It is preferred to use a filter for filtration having a pore size as small as possible within the range where the components in the coating solution are not removed. A filter having an absolute filtration accuracy of from 0.1 to 100 μm is used for the filtration. Further, a filter having an absolute filtration accuracy of from 0.1 to 25 μm is preferably used. The thickness of the filter is preferably from 0.1 to 10 mm, and more preferably from 0.2 to 2 mm. In that case, the filtration is preferably carried out under a filtration pressure of not more than 15 kgf/cm$^2$, more preferably not more than 10 kgf/cm$^2$, and further preferably not more than 2 kgf/cm$^2$.

The filtration filter member is not particularly limited so far as the coating solution is not adversely affected. Specifically, those the same as in the foregoing filter member for the wet dispersion of inorganic compounds are enumerated.

Also, it is preferable that the filtered coating solution is subjected to ultrasonic dispersion immediately before coating to assist defoaming and keeping the dispersion.

The thickness of the ink repelling treated portion (cured film) of the invention is not particularly limited and is preferably from 0.01 to 100 μm, more preferably from 0.1 to 10 μm, and especially preferably from 0.5 to 5 μm.

The cured film-forming composition is coated by the known thin film formation method such as dip coating, air knife coating, curtain coating, roller coating, wire bar coating, gravure coating, micro-gravure coating, and extrusion coating, followed by drying and irradiation with light and/or heat. Preferably, curing upon irradiation with light is advantageous in view of rapid curing. Further, it is preferred to perform a heat treatment in the latter half of the light curing treatment.

As a light source of the light irradiation, any of ultraviolet rays or near infrared rays are employable. Examples of the light source of ultraviolet rays include ultra-high pressure, high pressure, medium pressure, and low pressure mercury vapor lamps, chemical lamps, carbon arc lamps, metal halide lamps, xenon lamps, and sunlight. Commercially available various laser sources having a wavelength of from 350 to 420 nm may be irradiated after conversion into multi-beams. Also, examples of the light source of near infrared rays include halogen lamps, xenon lamps, and high pressure sodium vapor lamps. Commercially available various laser sources having a wavelength of from 750 to 1,400 nm may be irradiated after conversion into multi-beams.

In the case where the near infrared light source is used, the ultraviolet light source may be used in combination, or the light irradiation may be carried out from the substrate surface side opposite to the side at which the cured film is provided. Film curing proceeds in the depth direction in the coating layer without any delay similarly in the vicinity of the surface, whereby a cured film in the uniform cured state is obtained.

In the case of radical polymerization, the radical polymerization can be carried out in air or an inert gas. However, for the purpose of shortening the introduction period of polymerization of a radical polymerizable monomer or sufficiently enhancing the polymerization rate, an atmosphere where the oxygen concentration is made low as far as possible is preferable. In the case of photopolymerization, the irradiation intensity of ultraviolet rays to be irradiated is preferably from about 0.1 to 100 mW/cm$^2$, and the light irradiation amount on the surface of the coating is preferably from 100 to 1,000 mJ/cm$^2$. Also, it is preferable that the temperature distribution of the coating in the light irradiation step is uniform as far as possible, and the temperature distribution is preferably controlled within ±3° C., and more preferably within ±1.5° C. In this range, the polymerization reaction uniformly proceeds in the surface of the coating and in the depth direction in the layer, and therefore, such is preferable.

(Substrate of Inkjet Recording Head)

With respect to a substrate of the inkjet recording head to be used in the invention, the conventionally known liquid discharge heads capable of injecting fine droplets are employable. Examples include heads of various recording systems described in Pond Stephen F., *Inkjet Technology and Product Development Strategies* (published by Torrey Pines (2000)), *Inkjet Printer Technologies and Materials*, supervised by Takeshi Amari (published by CMC Publishing Co., Ltd. (1998)), and *Inkjet Recording and Printer Recording System, and Development of Print Head* (published by CMC Publishing Co., Ltd. (2000)). Specific examples include on-demand systems such as continuous systems (for example, an electrostatic control type and a pressure vibration type), electromechanical transduction systems (for example, a piezo type), electro-thermal transduction systems (for example, a bubble jet type), electrostatic suction systems, and ultrasonic systems.

It is preferable that the ink repelling treatment is carried out at the periphery of the ink discharge portions of various recording heads as described previously. For example, while not specifically illustrated, in an inkjet recording head provided with a recording head unit: having an ink-jet recording head that has a nozzle having a discharge opening from which an ink is discharged and that has an ink passage portion connected to this discharge opening; and an ink feed member for feeding an ink into the foregoing ink passage, and an ink tank portion for storing an ink to be fed into the foregoing ink passage by the foregoing ink feed member, it is preferable that the periphery of the tip of a nozzle hole of a discharge portion (nozzle)-forming member (or the outer surface of the nozzle plate) as shown in the FIGURE is subjected to an ink repelling treatment. However, it should not be construed that the recording system and the head structure are limited thereto.

The ink repelling treatment may be carried out before or after boring a nozzle in the nozzle plate.

With respect to the size of the nozzle to be bored in the nozzle plate, the size of the tip from which ink droplets are discharged is preferably from 15 to 100 μm, and more preferably from 20 to 60 μm in terms of its diameter.

Examples of boring the nozzle include press processing, electrocasting processing, excimer laser processing, and photo-fabrication.

Also, in the case where the ink repelling treatment is carried out after boring the nozzle, a method in which the pore inside is plugged with a resist, and after the treatment, the resist is removed; and a method in which the treatment is carried out while flowing a gas flow through the nozzle are preferably employed. Also, a masking method is preferable as a method of precisely controlling the position and amount of the liquid repelling coating to be incorporated into the inside of the ink discharge hole.

Also, in the case where the nozzle plate is adhered to the head portion after the ink repelling treatment, the back surface of the plate is not subjected to a liquid repelling treatment.

As the nozzle plate to be provided in the invention, the conventionally known substrates are used. For example, the nozzle plate is formed of a metal, a ceramic, silicon, glass, a plastic, etc. Examples include single metals (for example, titanium, chromium, iron, cobalt, nickel, copper, zinc, tin, and gold), alloys (for example, nickel-phosphorous alloys, tin-copper-phosphorous alloys (phosphor bronze), copper-zinc alloys, and stainless steel 40), and organic resin materials having heat curability, solvent resistance, chemical resistance, or heat resistance (for example, heat curable polyimides, polyether sulfones, polyphenylenes, polycarbonates, polysulfones, ABS resins (acrylonitrile-butadiene-styrene copolymers), polyethylene terephthalate, polyethylene naphthalate, polyacetals, and sulfides).

Also, these materials can be laminated and then used. For example, by bonding an organic resin material to an inorganic material having high stiffness, such as metals and ceramics, the stiffness of the whole of nozzle plate can be enhanced. That is, the Young's modulus of organic resin materials is from about 100 to 300 kg/mm$^2$, a value of which is far small in comparison with that of metals (from 8,000 to 15,000 kg/mm$^2$) or ceramics (from 10,000 to 20,000 kg/mm$^2$). Accordingly, when the plate is made of only an organic resin material, there is some possibility that it follows a drive pressure of the ink-jet to cause deformation and that it generates a pressure loss, resulting in a lowering of the ink droplet rate Vj. By laminating a high-rigidity material beneath the resin material with a thin film adhesive (adhesive layer), the stiffness of the whole is enhanced.

The thickness of the plate is preferably from about 30 to 50 μm in view of processing strength, energy load required for the processing, light weight as a head, etc.

It is preferable that irregularities are formed on the surface of the substrate on which the cured film of the ink repelling treated portion of the invention is formed.

The adhesion to the cured film is kept by an anchor effect with the cured film of the ink repelling treated portion, whereby the strength of the cured film is enhanced.

It is preferable that the surface of the substrate on which the cured film of the ink repelling treated portion is formed has a surface shape such that an arithmetical mean roughness (Ra) of surface irregularities, based on JIS B0601-1994, is not more than 0.5 μm, that a ratio (Ra/Rz) of an arithmetical mean roughness (Ra) to a ten-point mean roughness (Rz) is 0.1 or more, that a maximum height (Ry) is not more than 0.5 μm, and that a mean space of surface irregularities (Sm) is in the range of from 0.005 to 1 μm. It is more preferable that Ra is from 0.01 to 0.3 μm, that the ratio (Ra/Rz) of Ra to the ten-point mean roughness (Rz) is 0.15 or more, that the maximum height (Ry) is not more than 0.3 μm, and that the mean space of surface irregularities (Sm) is from 0.001 to 0.5 μm.

When the surface shape falls within the foregoing range, the cured film of the ink repelling portion can be kept uniform in coating property and good in adhesion, and hence, such is preferable.

Further, instead the formation of the cured film of the ink repelling treated portion directly on the substrate, when an interlayer as described later is provided, it is preferable that after imparting an irregular shape to the surface of an interlayer on which the cured film of the ink repelling treated portion is formed, the cured film-forming composition is coated thereon. The preferred surface irregular state is the same as in the foregoing range.

(Interlayer)

In the invention, at least one interlayer may be provided between the foregoing nozzle plate (substrate) and the cured film. It is preferred to make the interlayer have functions such as adhesion, hard coating property, primer property, and conductivity.

The interlayer preferably has adhesion and may be made of any of an inorganic layer, an organic layer, or an inorganic-organic hybrid layer. The interlayer is adequately chosen according to a combination of the substrate and the ink repelling treated portion from the viewpoint of adhesion. It is preferable that the interlayer also has hard coating property (a layer having a pencil hardness of 2 or more, and preferably 3 or more). Further, it is preferred to impart conductivity to the interlayer.

In the case where the interlayer is made of an organic layer or an inorganic-organic hybrid layer, it is preferable that the interlayer is formed by crosslinking reaction or polymerization reaction of a light and/or heat curable compound. For example, the interlayer can be formed by coating a coating composition containing a polyester (meth) acrylate, a polyurethane (meth)acrylate, a polyfunctional monomer or polyfunctional oligomer, or a hydrolyzable functional group-containing organometallic compound on a transparent support and subjecting to crosslinking reaction or polymerization reaction.

Photopolymerizable functional groups are preferable as the curable functional group. Also, organic alkoxysilyl compounds are preferable as the hydrolyzable functional group-containing organometallic compound. Further, by adequately jointly using the foregoing fine particles of the cured film-forming composition of the ink repelling treated portion, the hard coating property is enhanced. Further, it is possible to impart conductivity by containing the foregoing conductive fine particles.

In the case where the interlayer is a layer to be provided directly under the ink repelling treated portion of the invention, it is preferable that irregularities are formed on the surface of the foregoing layer.

The adhesion to the cured film is kept by an anchor effect with the cured film of the ink repelling treated portion, whereby the strength of the cured film is enhanced.

The preferred surface shape of the interlayer is the same range as in the values of the surface shape of the surface of the substrate on which the foregoing cured film of the ink repelling treated portion is formed.

(Method of Imparting Irregular Shape)

As a method of forming the foregoing fine irregular shape on the surface of the substrate or interlayer on which the cured film of the ink repelling portion is formed, a method of modifying the shape of the surface of the conventionally known substrate, a method in which the interlayer itself has the surface state of a fine irregular shape when formed, or a combination thereof can be employed.

Examples of the shape modification method of the substrate surface include a dry etching method and an embossing method in which in the case where the substrate is an organic layer, irregularities are transferred onto the film surface from an embossing plate or sticking sheet.

Examples of the dry etching method include glow discharge etching, flame plasma etching, corona discharge etching, and electron beams energy irradiation etching described in *Surface Treatment Technology Handbook—From Adhesion and Coating Until Electronic Materials*—, Second Edition, Third Section, supervised by Hiroshi Mizumachi and Mitsuru Tobayama (published by NTS Inc. (2000)), *Beam Processing of Polymers—Utilization of Light*, Plasma and Radiation—, compiled by Shigeo Tadzuki (published by CMC Publishing Co., Ltd. (1986)), and *Application of Plasma Ion Beam and Nanotechnology*, Chapters 1 to 4, compiled by Eiji Kamijo (published by CMC Publishing Co., Ltd. (2002)).

Also, as the embossing method, all of flat plate press, continuous belt plate press, and roll plate press can be employed. Of these, continuous belt plate press and roll plate press are preferable as continuous processing of stripe materials, and roll plate press is most preferable from the viewpoint of degree of freedom of press pressure and press temperature.

Examples of the interlayer having surface irregularities include metal oxide films obtained by coating a sol-gel reaction product obtained from a hydrolyzate of a hydrolyzable group-containing organometallic compound, followed by heating or plasma irradiation; and cured films obtained by coating a composition containing a light and/or heat curable compound and fine particles.

(Characteristic of Ink Repelling Treated Portion)

(Shape of Surface)

It is preferable that the surface of the ink repelling treated portion, namely, the surface on which a discharge opening of the nozzle hole is provided, has a shape such that an arithmetical mean roughness (Ra) of surface irregularities is not more than 1 μm, that a maximum height (Ry) is not more than 3 μm, and that a mean space of surface irregularities (Sm) is not more than 15 μm. It is more preferable that (Ra) is in the range of from 0.01 to 0.5 μm, that a maximum height (Ry) is not more than 2 μm, and that a mean space of surface irregularities (Sm) is in the range of from 0.02 to 10 μm.

When the surface has the foregoing surface state, the ink repelling property of the ink repelling treated portion is kept satisfactorily against wiping of the surface of a nozzle opening using a wiper made of a rubber or cloth.

(Antistatic Property)

It is preferable that when a charge voltage is given to the surface of the ink repelling treated portion to measure its decay, a time required such that the charge amount becomes ½ of the initial value (hereinafter referred to as "charge voltage half life") is not longer than 60 seconds. In the case where the charge voltage half life is not longer than 30 seconds, the effect is high, and hence, such is preferable. When the charge voltage half life is not longer than 60 seconds, the antistatic effect after providing the ink repelling treated portion is satisfactory, and the effect of preventing the attachment of dusts by wiping operation or the like is reduced. Thus, such is preferable.

A specific method of measuring the charge voltage half life will be described below. First of all, the surface is electrified by direct current corona discharge while monitoring the charge voltage of the surface of an article using an electrostatic potentiometer. The charge voltage increases with the progress of discharge and becomes saturated at a certain potential. At this moment, the potential is defined as a saturated voltage. Then, the discharge is stopped, and a time from this moment until the charge voltage becomes ½ of the saturated voltage is measured.

(Inkjet Recording Device)

The foregoing cured film-forming composition can be provided in the ink repelling treated portion of the ink-jet recording head capable of jetting out fine droplets. Such an inkjet recording head having the ink repelling treated portion can be used in all of inkjet recording systems. Specifically, the contents described in the publications in the preceding section of recording head are enumerated.

Further, the invention can be applied adequately to instruments other than the inkjet recording device, which are a device suitable for jetting fine droplets through a small nozzle and require liquid repelling property on the nozzle plate. Examples of the liquid include paints (varnishes), solvents, and drug fluids.

EXAMPLES

The invention will be specifically described with reference to the following Examples, but it should not be construed that the invention is limited thereto.

SYNTHESIS EXAMPLES OF HIGH-MOLECULAR INITIATOR (Q)

Synthesis Example 1 of High-molecular Initiator (Q): High-molecular Initiator (Q-1)

A mixture of 26.4 g of 1,6-hexanediol, 38 g of tricyclo-[5.2.1.$0^{2,6}$]decane-8,9-dicarbonxylic acid, 0.01 g of dibutyltin oxide, and 150 g of toluene was heated under refluxing with stirring for 8 hours in a flask equipped with a Dean-Stark refluxing unit. The amount of water distilled out upon azeotropy together with the toluene solvent was about 3.5 g.

After cooling to room temperature, the reaction mixture was re-precipitated in 800 mL of methanol, and after decantation, a liquid was collected and dried in vacuo.

The resulting reaction product was dissolved in dimethylformamide and subjected to potentiometric titration using 0.1 mol/L of a sodium methylate solution in methanol. As a result, the contents of the hydroxyl group and the carboxyl group were found to be 300 μmol/g, respectively.

A mixture of 50 g of a solid of the foregoing reaction product, 12 g of the following dithiocarbamate compound, and 200 g of tetrahydrofuran was dissolved with stirring at room temperature. A mixed solution of 10.2 g of dicyclohexyl carbodiimide (DCC), 0.2 g of 4-(N,N-dimethylamino) pyridine, and 50 g of tetrahydrofuran was added to the foregoing mixture with stirring over one hour. The mixture was further stirred for 4 hours as it was.

As the DCC solution was dropped, insoluble crystals were deposited. 3 g of a 3% formic acid aqueous solution was added to the reaction mixture and stirred at room temperature for 2 hours. The reaction mixture was subjected to suction filtration using cerite, a filtrate was re-precipitated in 500 mL of methanol, and a solid was then collected. The solid was dissolved in 100 mL of tetrahydrofuran and re-precipitated in 500 mL of methanol. A solid was collected and dried in vacuo. The yield of the resulting product was 42 g, and its weight average molecular weight (Mw) was $2\times10^4$ (Mw is a value as reduced into polystyrene by gel permeation chromatography). As a result of analysis, it was noted that the reaction product was High-molecular Initiator (Q-1) as shown below. The resulting High-molecular Initiator (Q-1) was subjected to potentiometric titration in the same manner as described previously. As a result, the hydroxyl group content was found to be 3 μmol/g, and the rate of reaction was found to be 99%.

Dithiocarbamate

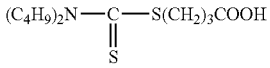

(Q-1)

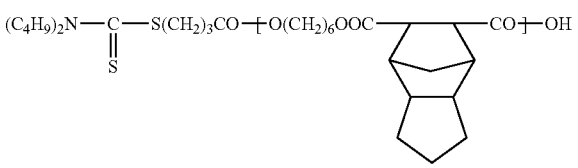

The parenthesis [ ] represents a repeating unit.

Synthesis Example 2 of High-molecular Initiator (Q): High-molecular Initiator (Q-2)

A mixture of 80.8 g of bisphenol A ethoxylate (manufactured by Aldrich), 1.0 g of succinic anhydride, 1.6 g of p-toluenesulfonic acid monohydrate, and 200 g of toluene 200 g was heated under refluxing with stirring for 6 hours in a flask equipped with a Dean-Stark refluxing unit.

After cooling, the reaction mixture was re-precipitated in one liter of methanol, and a precipitate was collected and dried in vacuo to obtain a reaction product in a yield of 88 g. The reaction product was dissolved in toluene and subjected to neutralization titration using 0.1 mol/L of a potassium hydroxide solution in methanol. As a result, the carboxyl group content was found to be 250 μmol/g.

Next, a mixed solution of 50 g of the foregoing reaction product, 13 g of the following xanthate compound, and 150 g of toluene was mixed with 0.3 g of t-butyl hydroquinone, to which was then dropped a mixed solution of 10.3 g of DCC, 0.1 g of 4-(N,N-dimethylamino)pyridine, 30 g of methylene chloride over one hour. The mixture was further stirred for 4 hours as it was.

The reaction mixture was passed through a 200-mesh nylon cloth to filter out insoluble matters. A filtrate was re-precipitated in 800 mL of methanol, and a powder was then collected. The powder was dissolved in 100 g of methylene chloride and again re-precipitated in 500 mL of methanol. A powder as collected and dried in vacuo to obtain 35 g of the following High-molecular Initiator (Q-2) having an Mw of $1.2\times10^4$. This High-molecular Initiator (Q-2) was subjected to neutralization titration in the same manner as described previously. As a result, the residual carboxyl group content was found to be 0.5 μmol/g, and the rate of reaction was found to be 99.8%.

Xanthate compound

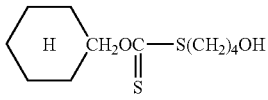

(Q-2)

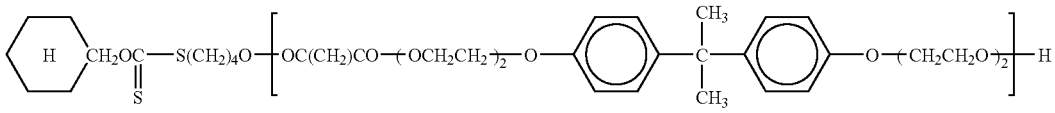

Synthesis Example 3 of High-molecular Initiator (Q): High-molecular Initiator (Q-3)

A mixed solution of 6 g of DCC, 0.1 g of 4-(N,N-dimethylamino)pyridine, and 10 g of methylene chloride wad dropped to a mixed solution of 50 g of High-molecular Initiator (Q-1), 10.5 g of the following dithiocarbamate compound, and 150 g of methylene chloride with stirring at a temperature of from 20 to 25° C. for 30 minutes, and the mixture was further stirred for 4 hours as it was. 5 g of formic acid was added to the reaction mixture, and after stirring for one hour, deposited insoluble matters were filtered out. A filtrate was re-precipitated in one liter of methanol, and the solvent was removed by decantation. A precipitate was collected and dried in vacuo to obtain the following High-molecular Initiator (Q-3). The yield of the resulting high-molecular initiator was 28 g, and its Mw was $2\times10^4$.

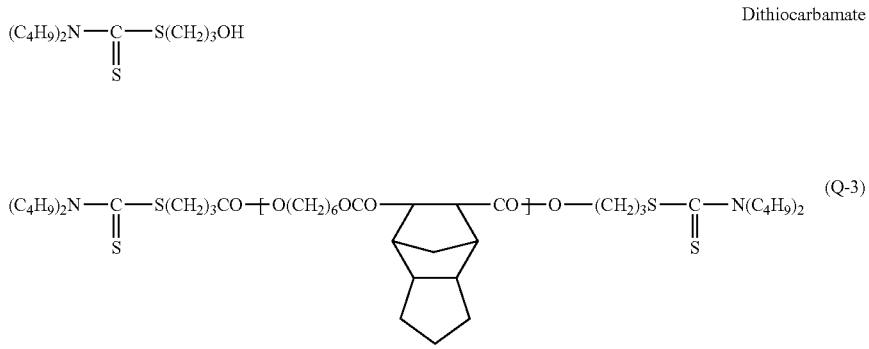

Synthesis Example 4 of High-molecular Initiator (Q): High-molecular Initiator (Q-4)

A mixture of 43.0 g of 1,3-cyclohexanedicarboxylic acid, 36.1 g of 1,4-cyclohexanemethanediol, and 0.005 g of dibutyltin oxide was heated at a temperature of 140° C. in a nitrogen atmosphere. After stirring at a degree of vacuum of 2.67 kPa for one hour, the resulting mixture was stirred at a temperature of 160° C. and at a degree of vacuum of 0.67 kPa for 3 hours.

Next, 5 g of 1,4-cyclomethanediol was added to this reaction mixture, and the mixture was stirred at a temperature of 160° C. and at a degree of vacuum of 0.67 kPa for 2 hours in the same manner as described previously.

After standing for cooling, the reaction mixture was dissolved in 180 g of toluene and re-precipitated in one liter of methanol. A precipitate was collected and dried in vacuo to obtain a product in a yield of 72 g.

Using 50 g of the foregoing reaction product and 20 g of the following dithiocarbamate compound, synthesis was carried out in a method using DCC in the same manner as in the foregoing Synthesis Examples 1 of High-molecular Initiator (Q), to obtain the following High-molecular Initiator (Q-4). The yield was 45 g, and the Mw was $3\times10^4$.

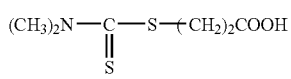

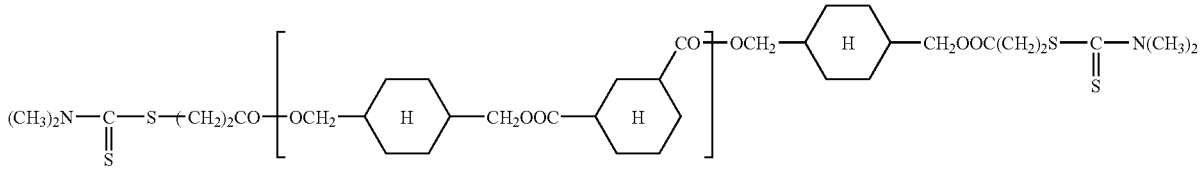

Synthesis Example 1 of Macromonomer (M): Macromonomer (M-1)

A mixture of 72.1 g of 1,4-cyclohexanemethanediol, 50 g of succinic anhydride, 0.7 g of p-toluenesulfonic acid monohydrate, and 200 g of xylene was reacted in the same manner as in the foregoing Synthesis Example 2 of High-molecular Initiator (Q), to obtain a reaction mixture.

Next, a mixed solution of 8.6 g of acrylic acid and 75 g of toluene and 0.5 g of t-butyl hydroquinone were added to the foregoing reaction mixture, and the mixture was further reacted under refluxing while stirring for 4 hours. After cooling to room temperature, the reaction mixture was re-precipitated in one liter of methanol, and a deposited solid was collected by filtration, followed by drying in vacuo to obtain the following Macromonomer (M-1). The yield of the resulting Macromonomer (M-1) was 67 g, and its weight average molecular weight was $8\times10^3$.

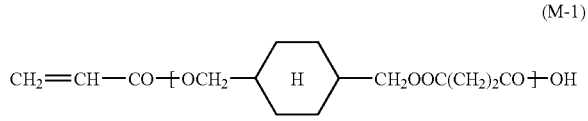

Synthesis Example 2 of Macromonomer (M): Macromonomer (M-2)

A mixture of 64.5 g of a diol compound having the following structure, 28.6 g of glutaric anhydride, 0.4 g of p-toluenesulfonic acid, and 220 g of mesitylene was reacted in the same manner as in the foregoing Synthesis Example 2 of High-molecular Initiator (Q).

After cooling to room temperature, the reaction mixture was re-precipitated in one liter of methanol, and a precipitated was collected by filtration and dried in vacuo to obtain a solid. 50 g of the resulting solid was reacted with a polymerizable monomer having the following structure in a method using DCC in the same manner as in the foregoing Synthesis Examples 1 of High-molecular Initiator (Q), to obtain 40 g of the following Macromonomer (M-2). The Mw was $7\times10^3$.

The subscript numerical values given outside the brackets and parentheses represent a weight ratio.

Synthesis Example 2 of Block Copolymer (PI): AB Type Block Copolymer (PI-2)

A round window made of quartz was inserted into the side wall of a 2-liter AISI 316 autoclave equipped with a stirrer capable of actuating at 400 rpm, and a Hanau (a registered trademark) TQ-150 UV lamp was aligned coincident with the quartz round window. This lamp is a high pressure

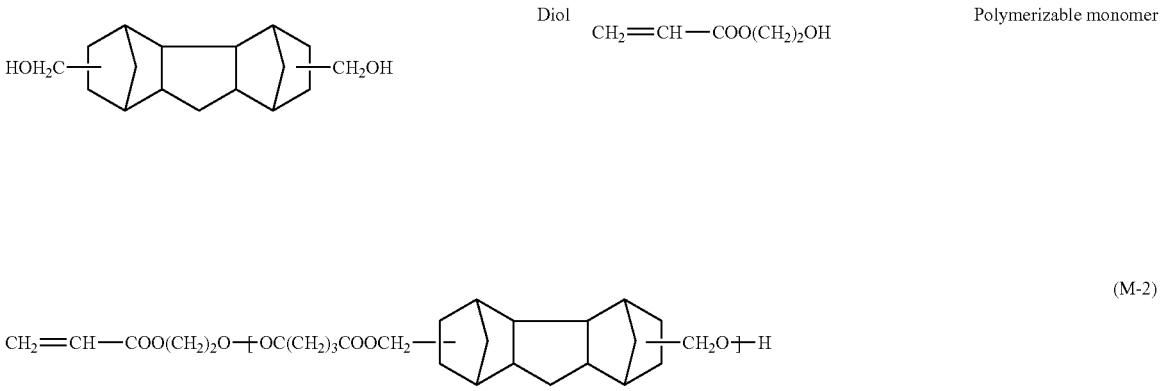

(M-2)

SYNTHESIS EXAMPLES OF AB TYPE BLOCK COPOLYMER (PI)

Synthesis Example 1 of Block Copolymer (PI): AB Type Block Copolymer (PI-I)

A mixture of 31.9 g of 2-perfluorooctylethyl methacrylate, 5.6 g of glycidyl methacrylate, 12.5 g of High-molecular Initiator (Q-1), and 50 g of tetrahydrofuran was heated at a temperature of 50° C. under a nitrogen gas stream to prepare a uniform solution. This solution was polymerized upon irradiation with light using a 400-W high pressure mercury vapor lamp from a distance of 10 cm through a glass filter for 8 hours, to obtain a polymer.

The resulting polymer was re-precipitated in 800 mL of methanol, and a precipitate was collected and dried to obtain the following Block Copolymer (PI-I) in a yield of 42 g. The Mw was $5\times10^4$.

mercury vapor lamp, emits light having a wavelength of from 240 to 600 nm, and has energy of 13.2 W in light having a wavelength of from 240 to 330 nm.

This device was charged with 10.5 g of a monomer having the following structure, 30 g of High-molecular Initiator (Q-2), and 100 g of tetrahydrofuran, and the inside of the system was deaerated and purged with a nitrogen gas. Further, 60 g of hexafluoropropane was introduced into the autoclave, and the temperature was raised to 45° C. After continuing the reaction for 10 hours, heating was stopped, and the reaction mixture was allowed to stand for cooling. At the point of time when the internal temperature lowered to room temperature, the autoclave was released, and the reaction solution was taken out. This reaction solution was re-precipitated in 1.0 liter of methanol, and a precipitate was collected and dried to obtain the following Block Copolymer (PI-2) in a yield of 83 g. The Mw was $6\times10^4$.

(PI-1)

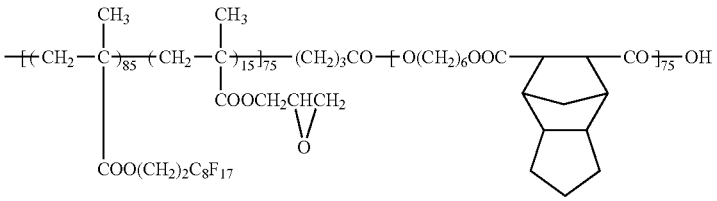

Monomer

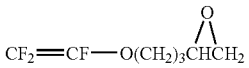

(PI-2)

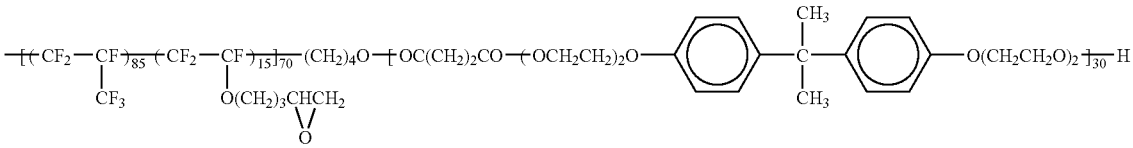

Synthesis Example 3 of Block Copolymer (PI): AB Type Block Copolymer (PI-3)

A mixture of 55 g of hexafluoropropane, 6 g of a monomer having the following structure, and 40 g of High-molecular Initiator (Q-5) having the following structure was subjected to polymerization reaction in the same manner as in Synthesis Example 1 of Block Copolymer (PI), to obtain a polymer. The yield was 86 g, and the Mw was $4\times10^4$.

50 g of this polymer and 4.1 g of acrylic acid were dissolved in 120 g of chloroform, to which was then added a mixed solution of 16.1 g of DCC, 0.1 g of 4-(N,N-dimethylamino)pyridine, and 37 g of methylene chloride with stirring at a temperature of 25° C. The mixture was stirred for 3 hours and further stirred at a temperature of 35° C. for 2 hours.

Next, 10 g of a 30% formic acid aqueous solution was added to the reaction mixture, the mixture was stirred for one hour, and formed insoluble matters were filtered out. A filtrate was re-precipitated in one liter of methanol, and a precipitate was collected and dried in vacuo to obtain the following Block Copolymer (PI-3). The yield was 43 g, and the Mw was $3.5\times10^4$.

Monomer

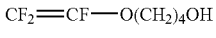

High-molecular initiator (Q-5)

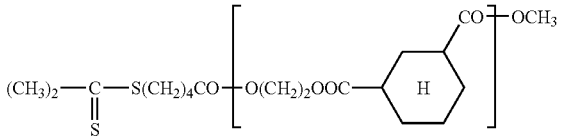

Mw 1 x $10^4$ (PI-3)

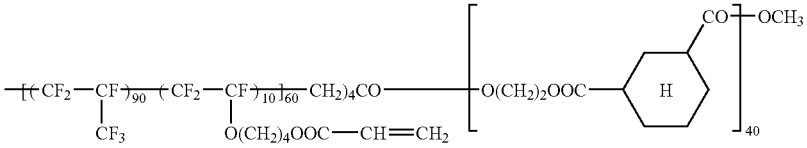

SYNTHESIS EXAMPLES OF ABA TYPE BLOCK COPOLYMER (PII)

Synthesis Example 1 of Block Copolymer (PII): ABA Type Block Copolymer (PII-1)

A mixture of 24 g of 2-perfluorododecylethyl methacrylate, 6 g of a monomer having the following structure, 20 g of High-molecular Initiator (Q-4), and 50 g of tetrahydrofuran was subjected to polymerization reaction in the same manner as in Synthesis Example (PI-1), to obtain the following Block Copolymer (PII-1). The yield was 43 g, and the Mw was $4\times10^4$.

Monomer

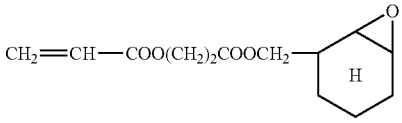

-continued (PII-1)

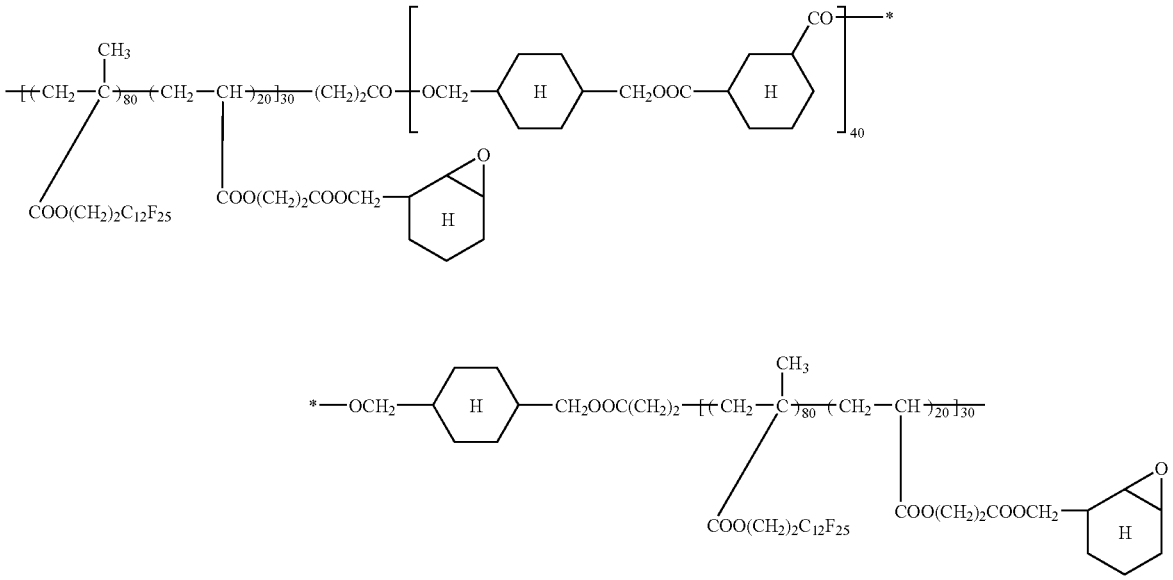

Synthesis Example 2 of Block Copolymer (PII): ABA Type Block Copolymer (PII-2)

A mixture of 27 g of perfluoropropane, 3 g of a monomer having the following structure, 20 g of High-molecular Initiator (Q-3), and 50 g of tetrahydrofuran was subjected to polymerization reaction in the same manner as in Synthesis Example (PI-2), to obtain the following Block Copolymer (PII-2). The yield was 41 g, and the Mw was $4\times10^4$.

Monomer (PII-2)

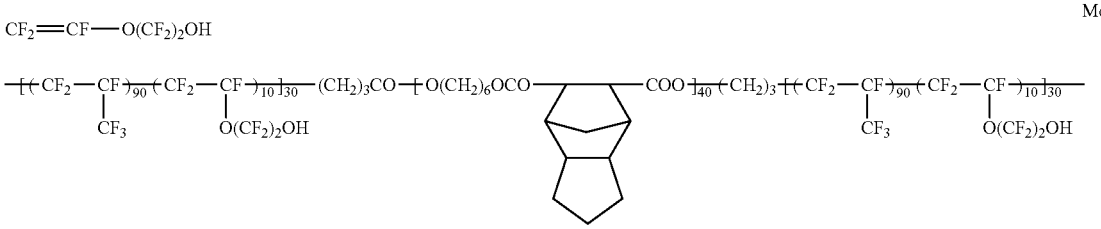

SYNTHESIS EXAMPLES OF COMB TYPE BLOCK COPOLYMERE (PIII)

Synthesis Example 1 of Block Copolymer (PIII): Comb Type Block Copolymer (PIII-1)

A mixture of 60 g of 2-perfluorooctylethyl methacrylate, 15 g of 3-(methoxysilyl)propyl methacrylate, 25 g of Macromonomer (M-1), 1.0 g of 3-mercaptopropyl trimethoxysilane, 200 g of toluene was heated at a temperature of 70° C. with stirring under a nitrogen gas stream. 0.5 g of 2,2-azobisisobutyronitrile (abbreviated as "AIBN") was added to the mixture and reacted for 5 hours. 1.0 g of AIBN was further added, and the mixture was heated at a temperature of 80° C. and reacted for 4 hours. After cooling to room temperature, the reaction mixture was re-precipitated in 1.0 liter of methanol, and a precipitate was collected and dried to obtain the following Block Copolymer (PIII-1). The yield was 85 g, and the Mw was $3.0\times10^4$.

(PIII-1)

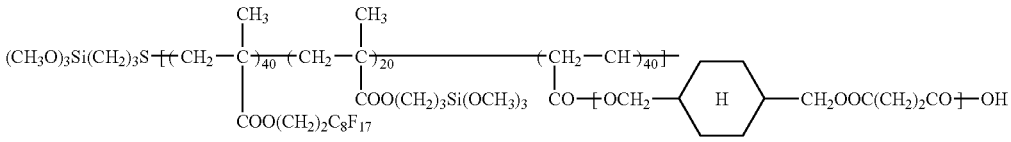

Synthesis Example 2 of Block Copolymer (PIII): Comb Type Block Copolymer (PIII-2)

A stainless steel stirrer-equipped autoclave having an inner volume of 500 mL was charged with 5 g of a monomer having the following structure, 15 g of Macromonomer (M-2), 1.0 g of AIBN as an initiator, and 93 g of methyl ethyl ketone, and the inside of the system was deaerated and purged with a nitrogen gas.

Further, 30 g of perfluorodiallyl ether was introduced into the autoclave, and the mixture was heated to 70° C. The mixture was allowed to react for 4 hours as it was, and a solution of 0.5 g of AIBN in 5 mL of tetrahydrofuran was then added while utilizing a nitrogen gas pressure.

Further, reaction was continued for 6 hours, and heating was then stopped, thereby allowing the reaction mixture to stand for cooling. At the point of time when the temperature lowered to room temperature, the autoclave was released, and the reaction solution was taken out. This reaction solution was re-precipitated in 800 mL of methanol, and a precipitate was collected and dried to obtain the following Block Copolymer (PIII-2) in a yield of 44 g. The Mw of the polymer was $6\times10^4$.

Synthesis Example 3 of Block Copolymer (PIII): Comb Type Block Copolymer (PIII-3)

Using 65 g of perfluoroallyl vinyl ether, 15 g of a monomer having the following structure, 20 g of Macromonomer (M-3) having the following structure, and 230 g of methyl ethyl ketone, polymerization reaction was carried out in the same manner as in Synthesis Example (PIII-2). Next, this reaction mixture was set up at a temperature of 60° C., to which was then added 0.03 g of tetrabutoxy titanate, followed by stirring.

A mixed solution of 9.7 g of 2-methacryloyloxyethyl isocyanate, 0.01 g of 2,5-t-butyl hydroquinone, and 25 g of toluene was dropped to the foregoing reaction mixture for 5 minutes, and the mixture was stirred for 4 hours as it was.

After cooling to room temperature, the reaction mixture was re-precipitated in one liter of methanol, and a precipitate was collected and dried in vacuo to obtain the following block copolymer. The yield was 87 g, and the Mw was $5\times10^4$.

Monomer

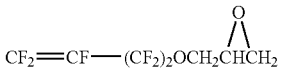

(PIII-2)

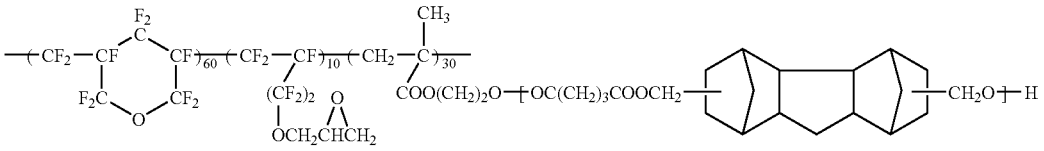

Monomer

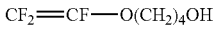

Macromonomer (M-3)

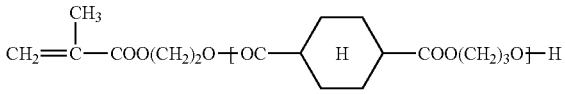

(PIII-3)

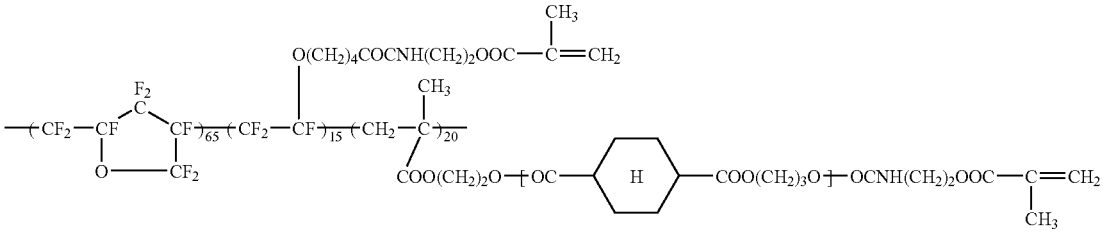

Synthesis Examples 4 to 8 of Block Copolymer (PIII): Comb Type Block Copolymers (PIII-4) to (PIII-8)

Polymers shown in Table 1 were synthesized in the same synthesis method as in Synthesis Example (PIII) of Comb Type Block Copolymer. The yield of the respective polymers was from 80 to 85% by weight, and the Mw was in the range of from $4\times10^4$ to $6\times10^4$.

TABLE 1

| Synthesis Example | Comb Type Block Co-polymer (PIII) | Polymerizable Components (formulation weight ratio) |
|---|---|---|
| 4 | PIII-4 | 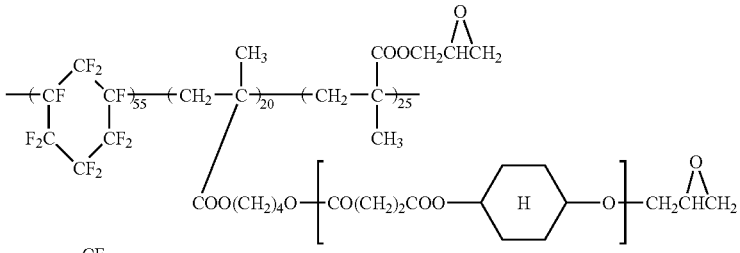 |
| 5 | PIII-5 | 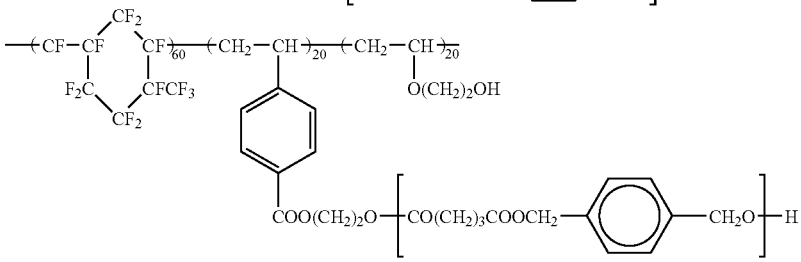 |
| 6 | PIII-6 | 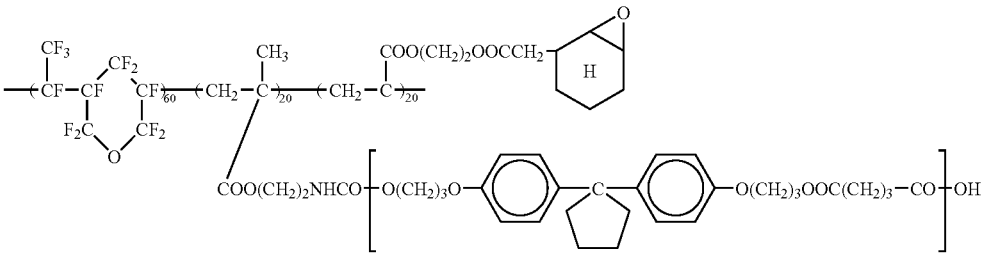 |

TABLE 1-continued

| Synthesis Example | Comb Type Block Co-polymer (PIII) | Polymerizable Components (formulation weight ratio) |
|---|---|---|
| 7 | PIII-7 | 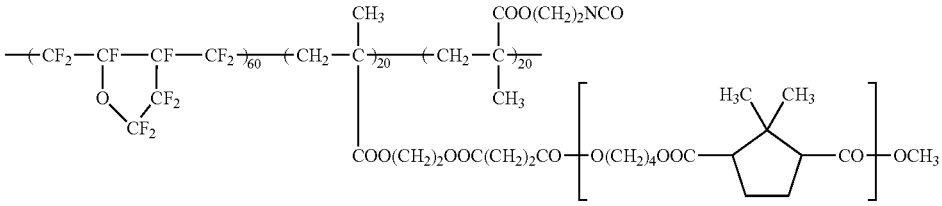 |
| 8 | PIII-8 | 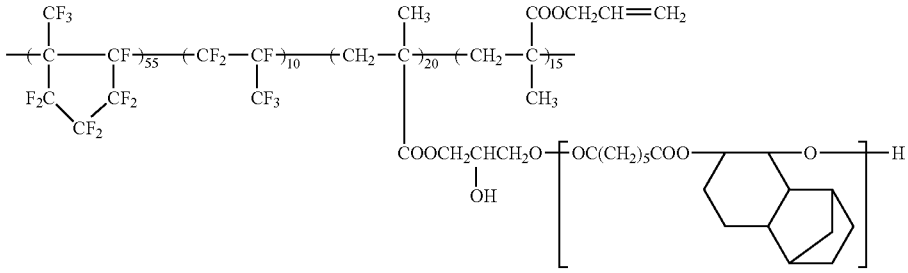 |

Example 1 and Comparative Examples 1 to 2

Example 1

(Coating Solution (HL-1) Composed of Cured Film-forming Composition)

A mixture of 5.4 parts by weight of Block Copolymer (PII-2), 1.1 parts by weight (as solids content) of an epoxy based curing agent DEX314 (manufactured by Nagase Kasei Kogyo K.K.), 0.35 parts by weight of p-toluenesulfonic acid, and 38.8 parts by weight of methyl ethyl ketone was stirred to prepare Coating Solution for Ink Repelling Layer (HL-1).

(Preparation of Nozzle Plate Having an Ink Repelling Treated Portion Formed Therein)

An inkjet recording head having a structure shown in the FIGURE was prepared using a polyimide sheet (manufactured by Ube Industries, Ltd.) having a thickness of 125 μm as a nozzle plate. In detail, Coating Solution for Ink Repelling Layer (HL-1) was coated in a film thickness after curing of 1 μm on the surface of a nozzle plate 1 in which a nozzle hole portion thereof had been previously protected by a positive resist from the back surface side of the plate using a bar coater. After coating, the nozzle plate was air dried for one minute, heated at 120° C. for 30 minutes, and then allowed to stand for cooling to room temperature to form an ink repelling layer. Thereafter, the resist was removed to prepare Nozzle Plate (HP-1) constituting an inkjet recording head having an ink repelling treated portion formed therein.

Comparative Example 1

Nozzle Plate (HP-R1) was prepared in the same manner as in Example 1, except for using the following Comparative Coating Solution (HL-R1) in place of the Coating Solution (HL-1) used in Example 1.

(Preparation of Comparative Coating Solution for Ink Repelling Layer (HL-R1))

A mixture of 3.2 parts by weight of Perfluoroolefin Copolymer (FPR) having the following structure, 2.2 parts by weight of a polyester (PER shown below) as a precursor of the polyester high-molecular initiator used in the foregoing Synthesis Example 2 of Block Copolymer (PII), 1.1 parts by weight (as solids content) of an epoxy based curing agent DEX314, 0.35 parts by weight of p-toluenesulfonic acid, 35 parts by weight of Fluorinert FC-75, and 5 parts by weight of tetrahydrofuran was stirred using an ultrasonic dispersion machine, to prepare Coating Solution (HL-R1) for forming an ink repelling treated portion as a mixture of a fluorine-containing polymer and a polyester.

Perfluoroolefin Copolymer (FPR)

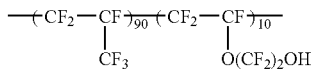

Mw: 4 x $10^4$ (formulation weight ratio)

Polyester (PER)

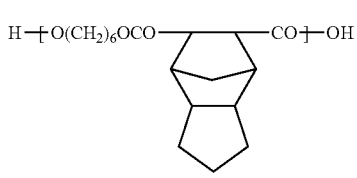

Comparative Example 2

Nozzle Plate (HP-R2) was prepared in the same manner as in Example 1, except for using the following Comparative Coating Solution (HL-R2) in place of the Coating Solution for Ink Repelling Layer (HL-1) used in Example 1.

(Preparation of Coating Solution for Ink Repelling Layer (HL-R2))

A mixture of 5.4 parts by weight of the foregoing Comparative Perfluoroolefin Copolymer (FPR), 1.1 parts by weight (as solids content) of an epoxy based curing agent DEX314, 0.35 parts by weight of p-toluenesulfonic acid, 35 parts by weight of Fluorinert FC-75, and 5 parts by weight of tetrahydrofuran was stirred using an ultrasonic dispersion machine, to prepare Coating Solution (HL-R2) for forming an ink repelling treated portion as a mixture of a fluorine-containing polymer and a polyester.

(Evaluation of Cured Film)

With respect to the resulting respective cured films (Example 1 and Comparative Examples 1 to 2), the following performances were evaluated. The results obtained are shown in Table 2.

(1) Coating Surface Property:

The surface of the ink repelling layer was visually observed, and the degree of the coating surface property such coating stripe and unevenness was evaluated according to the following criteria.

A: Neither coating stripe not unevenness is observed.

B: Stripe or unevenness is slightly observed.

C: Coating stripe and unevenness are remarkably observed.

(2) Adhesion:

One hundred crosshatches of 1 mm×1 mm were provided on the surface of the cured resin layer of each of the curing treated film and curing treated glass samples using a cutter. After standing under conditions at a temperature of 25° C. and a relative humidity of 60% for 2 hours, Cellotape (a registered trademark, manufactured by Nichiban Co., Ltd.) was stuck thereon and then peeled apart. The number of crosshatches of the cured coating peeled apart from the film substrate was measured and evaluated according to the following criteria.

A: No peeling is observed at all in the 100 crosshatches.

B: Peeling is observed within two crosshatches of the 100 crosshatches.

C: Peeling is observed in from two to ten crosshatches of the 100 crosshatches.

D: Peeling is observed exceeding ten crosshatches of the 100 crosshatches.

(3) Abrasion Resistance:

The film surface was rubbed 10 times under a load of 200 g using steel wool #0000, and the level of the presence of scratches was then confirmed. The judgment was carried out according to the following criteria.

A: No scratch is observed at all.

B: Fine scratches are slightly observed.

C: Fine scratches are observed.

D: Scratches are remarkably observed.

(4) Waterdrop Slip Property:

The ink repelling film was dipped in distilled water, washed in a ultra-high speed washing machine for one minute, and then air dried. 10 μL of a drop of distilled water was dropped on the sample surface under conditions at 25° C. and 65% RH using an inclination friction meter HEIDON 47L-388 (manufactured by Shinto Scientific Co., Ltd.), and a rolling angle of the waterdrop was measured. The evaluation was carried out according to the following criteria.

A: The rolling angle of the waterdrop is less than 100.

B: The rolling angle of the waterdrop is 100 or more and less than 30°.

C: The rolling angle of the waterdrop is 300 or more and less than 50°.

D: The rolling angle of the waterdrop is 50° or more.

(5) Ink Repelling Property:

The sample was dipped in an ink having the following formulation in an atmosphere at 50° C. for 3 days, to examine the ink repelling property. The ink repelling property was evaluated according to the following criteria. The ink properties after dipping are shown in Table 2.

Ink Formulation: Pure Water/glycerin/black (Water-soluble Black Dye)/N-methylpyrrolidone (70/15/3/12) Parts by Weight A: An ink droplet is not substantially observed on the nozzle surface.

B: A small ink droplet is observed on the nozzle surface.

C: A big ink droplet is observed in the vicinity of the discharge opening of the nozzle.

Further, as the degree of change of the ink repelling property, the case where a change in the ink repelling property was not substantially observed as compared with that before dipping is designated as "AA", and the case where the ink repelling property was deteriorated is designated as "BB".

(6) Durability:

The ink repelling film surface of the ink repelling treated nozzle plate was subjected to a wiping operation (cleaning operation) under the following conditions. Thereafter, the nozzle plate was mounted on an actual ink-jet head, and an image was printed on recording paper. The presence or absence of a difference from a printed sample by a nozzle plate at the initial stage when no wiping operation was carried out was evaluated according to the following criteria.

Wiping Operation:

The ink repelling film surface of the nozzle plate was subjected to an wiping operation 10,000 times in the ink-wetted state using a wiper made of a polyurethane rubber having a thickness of 1 mm under conditions of a wiping speed of 100 mm/sec and a biting amount of the wiper into the nozzle surface of 0.6 mm.

Printing Quality:

A: Neither dot deletion nor divergence of impact position is observed, and the printing quality is good.

B: Though dot deletion and divergence of impact position are observed, the characters can be discriminated.

C: Dot deletion and divergence of impact position are remarkably observed, and the characters cannot be discriminated.

TABLE 2

| | | | | | | Durability | | |
|---|---|---|---|---|---|---|---|---|
| | | | | | | Ink repelling property | | |
| | Coating Solution | Coating surface property | Adhesion | Abrasion resistance | Waterdrop slip property | Degree of change | After dipping | Printing quality |
| Example 1 | HP-1 | A | B | B | A | AA | A | A |
| Comparative Example 1 | HP-R1 | B | C | C | C | BB | B | C |
| Comparative Example 2 | HP-R2 | B | C | C | C | BB | B | C |

As is clear from the results shown in Table 2, the Ink-jet Recording Head (HP-1) of the invention having an ink repelling treated portion provided therein exhibited good coating property of the ink repelling film and uniform and good film surface property. Also, it exhibited satisfactory performances in adhesion and abrasion resistance of the film from the standpoint of practical use. Further, as to the slip angle, the fine waterdrop slipped off only at an angle of inclination of 10°. This demonstrates that the repellency of droplet is extremely good. Also, the durability of ink repelling property was good. Further, the durability of inkjet recording device was evaluated with respect to the actual printing quality. As a result, the printing quality before the durability test was sufficiently kept.

On the other hand, in Comparative Example 1 (HP-R1) prepared by blending the fluorine-containing polymer (FPR) and the polyester polymer (PER) which are respectively corresponding to the fluorine-containing polymer segment and the polyester segment constituting the Block Copolymer (PII-2) of the invention and curing the blend, the surface property of the film was not good, the strength of the film was low, and the results of the durability test were poor. Since the fluorine-containing polymer (FPR) itself was poor in solubility in organic solvents, a coating solution of a specific fluorine based solvent system was used. However, the coating surface property became worse. Also, in Comparative Example 2 (HP-R2) prepared by curing the polymer (FPR), the adhesion and waterdrop slip property were insufficient, and the printing durability was lowered likewise Comparative Example 1. In the light of the above, it is noted that only Example 1 can easily form a uniform thin film and that the resulting inkjet recording device of an ink repelling treated nozzle plate exhibits excellent performances in ink repelling property and durability against wiping. These results were exactly equal to those obtained by replacing the plate material with a polysulfone sheet or stainless a steel sheet.

Example 2

(Coating Solution for Forming Ink Repelling Portion (HL-2))

100 parts by weight of the following inorganic fine particle dispersion, 33 parts by weight of methyl ethyl ketone, 517 parts by weight of cyclohexanone, 3.0 parts by weight of a polymerization initiator Irgacure 907 (manufactured by Ciba-Geigy Japan Limited), and 2.1 parts by weight of a photosensitizer Kayacure DETX (manufactured by Nippon Kayaku Co., Ltd.) were added to 75 parts by weight of the foregoing Block Copolymer (PI-3) and 25 parts by weight of a mixture of dipentaerythritol pentaacrylate and dipentaerythritol hexaacrylate (DPHA, manufactured by Nippon Kayaku Co., Ltd.), and stirred. After completion of stirring, the reaction mixture was filtered using a polypropylene-made filter having a pore size of 0.4 μm to obtain Coating Solution (HL-2) for forming a cured film.

(Inorganic Fine Particle Dispersion)

20 parts by weight of the following dispersant and 360 parts by weight of cyclohexanone were added to 100 parts by weight of zirconium oxide particles and dispersed by a Dyno mill using zirconia beads having a particle size of 0.2 mm. The beads were separated by filtration using a 200-mesh nylon cloth to prepare a fine particle dispersion. The dispersed particle size of the resulting dispersion was measured using a scanning electron microscope. As a result, the dispersion had good monodispersibility and a mean particle size of 55 nm.

Also, the particle size distribution of the dispersion was measured (laser scattering particle size distribution analyzer LA-920, manufactured by Horiba, Ltd.). As a result, the rate of particles having a particle size of 300 nm or more was 0%.

Dispersant

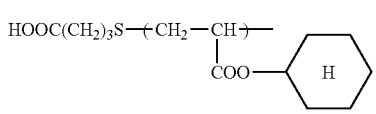

Mw 8.5 x $10^3$ (Preparation of Ink Repelling Treated Plate (HP-2))

The Coating Solution (HL-2) was used in place of the Coating Solution (HL-1) used in Example 1 and coated in a film thickness after curing of 1 μm using a bar coater in the same manner as in Example 1. After drying at 100° C., the coating was irradiated with ultraviolet rays at an illuminance of 400 W/$cm^2$ and an irradiation dose of 500 mJ/$cm^2$ using an air-cooled metal halide lamp (manufactured by Eyegraphics Co., Ltd.) of 160 W/cm while purging with nitrogen in an atmosphere having an oxygen concentration of not more than 1.0% by volume. Further, the irradiated coating was heated at 100° C. for 20 minutes and then allowed to stand for cooling to form an ink repelling layer having a thickness of 2 μm. Thereafter, the resist was removed to prepare Nozzle Plate (HP-2) constituting an inkjet recording head having an ink repelling treated portion provided therein.

(Evaluation of Ink Repelling Film)

The resulting Nozzle Plate (HP-2) was evaluated in the same manner as in Example 1. The results obtained are shown in Table 3.

Example 3

(Interlayer (Hard Coat Layer))

(Preparation of Hard Coat Layer Dispersion)

75 parts by weight of trimethylolpropane triacrylate and 47 parts by weight of a 53.2% by weight methyl ethyl ketone solution of polyglycidyl methacrylate (weight average molecular weight: $1.5\times10^4$) were dissolved in a mixed solution of 226 parts by weight of methyl ethyl ketone and 265 parts by weight of cyclohexanone, to which were then added 133 parts by weight of a methyl ethyl ketone dispersion of silica fine particles (MEK-ST, solids content: 30% by weight, manufactured by Nissan Chemical Industries, Ltd.), 3.8 parts by weight of Irgacure, and 2.5 parts by weight di-(t-butylphenyl) iodonium hexafluorophosphate while stirring, followed by stirring for 10 minutes. This mixture was filtered using a polypropylene-made filter having a pore size of 1 μm to prepare a hard coat layer forming composition.

(Hard Coat Layer-provided Plate)

The foregoing forming coating solution for forming a hard coat layer was coated on a nozzle plate the same as used in Example 1 using a gravure coater. After drying at 100° C., the coating was further dried at 120° C. Next, the coated layer was cured upon irradiation with ultraviolet rays at an illuminance of 400 W/cm$^2$ and an irradiation dose of 500 mJ/cm$^2$ using an air-cooled metal halide lamp (manufactured by Eyegraphics Co., Ltd.) of 160 W/cm while purging with nitrogen in an atmosphere having an oxygen concentration of not more than 1.0% by volume, to form a hard coat (interlayer) having a thickness of 8 μm.

(Evaluation of Surface Shape)

With respect to the surface shape of the hard coat layer, an arithmetical mean roughness (Ra) of surface irregularities based on JIS B0601-1994, a ten-point mean roughness (Rz), a maximum height (Ry), and a mean space of surface irregularities (Sm) were measured using an atomic force microscope (AFM), provided that Ra, Rz and Ry were measured at a measurement length of 4 μm, and Sm was measured at a measurement length of 20 μm. A uniformity of the surface irregularities was calculated from a ratio (Ra/Rz).

The shape of the resulting surface was as follows.

Ra:0.008 μm, Ra/Rz ratio:0.33, Ry:0.015 μm, Sm:0.01 μm (Preparation of Ink Repelling Treated Nozzle Plate (HP-3))

Next, a cured film having a thickness of 2 μm was formed on the thus formed hard coat layer to provide an ink repelling layer in the same manner as in Example 2. There was thus prepared Nozzle Plate (HP-3) constituting an inkjet recording head having an ink repelling treated portion provided therein.

(Evaluation of Nozzle Plate (HP-3) Having an Ink Repelling Treated Portion Formed Therein)

The foregoing Nozzle Plate (HP-3) was evaluated in the same manner as in Example 1. The results obtained are shown in Table 3.

TABLE 3

| | Ink repelling treated nozzle plate | Coating surface property | Adhesion | Abrasion resistance | Waterdrop slip property | Durability: Ink repelling property | Durability: Printing quality* |
|---|---|---|---|---|---|---|---|
| Example 2 | HP-2 | A | B | A to B | A | A | A |
| Example 3 | HP-2 | A | A | A | A | A | C |

*With respect to the durability test of the printing quality, the number of wiping was changed from 10,000 times to 15,000 times in the evaluation method described in Example 1.

As is clear from the results shown in Table 3, in both of Examples 2 and 3, the surface property after the cured film formation was uniform and good, the ink repelling property was extremely good in terms of the waterdrop slip property as an index, and when actually mounted on the recording device, the ink repelling property was good. In Example 2, the abrasion resistance was enhanced, and in Example 3, the adhesion and the abrasion resistance were further enhanced and good. Further, both of Examples 2 and 3 exhibited good performances such that even after wiping 15,000 times, the printing quality in the durability test did not change as compared with that at the initial stage.

Examples 4 to 12

Nozzle plates constituting an inkjet recording head having an ink repelling treated portion-formed therein were prepared in the same manner as in Example 2, except for using respective compounds shown in Table 4 in place of the block copolymer, the polyfunctional acrylate: DPHA, the polymerization initiator Irgacure 907, and the photo-sensitizer Kayacure DETX in the Coating Solution (HL-2) used in Example 2.

TABLE 4

| Example | Nozzle plate | Coating solution for ink repelling layer(HL) | Block copolymer (parts by weight) | Curing agent | Curing accelerator |
|---|---|---|---|---|---|
| 4 | HP-4 | HL-4 | PIII-2 (80) | Epoxy based curing agent DEX314 20 parts by weight | p-Toluenesulfonic acid 3.5 parts by weight |
| 5 | HP-5 | HL | PI-1 (80) | 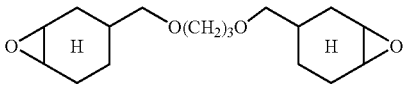 20 parts by weight | 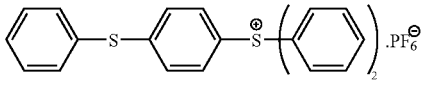 4.5 parts by weight |
| 6 | HP-6 | HL | PII-1 (70) | Trimethylolpropane triglycidyl ether 30 parts by weight | 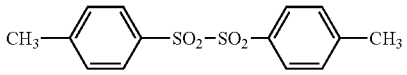 3.5 parts by weight |
| 7 | HP-7 | HL | PIII-5 (75) | Isocyanate based curing agent Takanate DHO (manufactured by Takeda Industries, Ltd.) 25 parts by weight | Tripropoxy aluminate 3 parts by weight |
| 8 | HP-8 | HL | PIII-2 (80) | 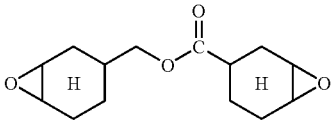 20 parts by weight | 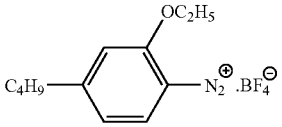 7.5 parts by weight |
| 9 | HP-9 | HL | PIII-7 (75) | Trimethylolpropane 25 parts by weight | Tetrabutoxy titanate 3.5 parts by weight |
| 10 | HP-10 | HL | PIII-3 (78) | Trimethylolpropane triacrylate 22 parts by weight | 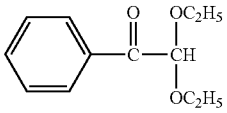 7.2 parts by weight |
| 11 | HP-11 | HL | PIII-1 (80) | 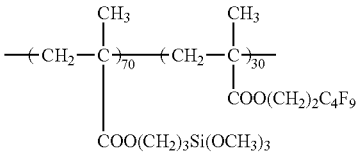 Mw: $1.2 \times 10^4$ (weight ratio) 20 parts by weight | Acetyl acetate/oxalic acid 4.5 parts by weight/ 1.0 part by weight |
| 12 | HP-12 | HL | PIII-8 (70) | Pentaerythritol tetraacrylate 30 parts by weight | Irgacure 1870 5 parts by weight |

With respect to each of the resulting plates, the respective performances were evaluated in the same manner as in Example 2. As a result, all of the respective plates of Examples 4 to 12 exhibited performances equivalent to or more than those of Example 2 and were good.

Example 13

(Preparation of Dispersion for Forming a Conductive Hard Coat Layer as an Interlayer)

125 parts by weight of a polyfunctional acrylate monomer DPHA, 125 parts by weight of a urethane acrylate oligomer UV-6300B (manufactured The Nippon Synthetic Chemical Industry Co., Ltd.), 7.5 parts by weight of Irgacure 907, and 5.0 parts by weight of Kayacure DETX were dissolved in a mixed solution of 192 parts by weight of methyl ethyl ketone and 128 parts by weight of cyclohexanone. 417 parts by weight of an antimony pentoxide-zinc fine particle dispersion "Celnax CX-Z200M (modified 2)" (30% by weight methanol dispersion, manufactured by Nissan Chemical Industries, Ltd.) was added to the solution under stirring, and after further stirring the mixture, the reaction mixture was filtered using a polypropylene-made filter having a pore size of 0.4 μm, to prepare a coating solution for conductive hard coat layer.

(Conductive Hard Coat Layer-provided Plate)

The foregoing coating solution for hard coat layer was coated on a nozzle plate the same as used in Example 1 using a gravure coater. After drying at 100° C., the resulting coating was further dried at 120° C. Next, the coated layer was cured upon irradiation with ultraviolet rays at an illuminance of 500 W/cm$^2$ and an irradiation dose of 600 mJ/cm$^2$ using an air-cooled metal halide lamp (manufactured by Eyegraphics Co., Ltd.) of 160 W/cm while purging with nitrogen in an atmosphere having an oxygen concentration of not more than 1.0% by volume, to form a hard coat layer (interlayer) having a thickness of 5 μm. The shape of the surface of the resulting hard coat layer was as follows. Ra:0.013 μm, Ra/Rz ratio:0.20, Ry:0.045 μm, Sm:0.077 μm (Preparation of Nozzle Plate (HP-13) Having an Ink Repelling Treated Portion Formed Therein)

Next, the following Coating Solution for Ink Repelling Layer (HL-13) was coated on the resulting hard coat layer in the same manner as in Example 2, to form a cured film having a thickness of 1.2 μm. There was thus prepared a nozzle plate constituting an inkjet recording head having an ink repelling treated portion formed therein.

(Coating Solution for Ink Repelling Layer (HL-13))

2.2 parts by weight (as solids content) of methyl group-modified colloidal silica MEK-ST (manufactured by Nissan Chemical Industries, Ltd.), 15.0 parts by weight of methyl ethyl ketone, 220.0 parts by weight of cyclohexanone, and 8 parts by weight of a polymerization initiator Irgacure 907 (Ciba-Geigy Japan Limited) were added to 70 parts by weight of Block Copolymer (PIII-6) and 30 parts by weight of a curable compound having the following structure, and the mixture was stirred. The reaction mixture was filtered using a polypropylene-made filter having a pore size of 0.4 μm to prepare Coating Solution (HL-13) for forming an ink repelling portion.

A cured film was prepared using the resulting Coating Solution (HL-13) in the same manner as in Example 1, to obtain Nozzle Plate (HP-13) constituting an inkjet recording head having an ink repelling treated portion provided therein.

Curable Compound

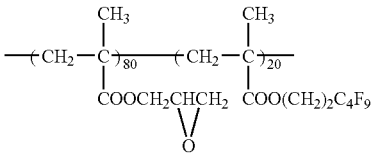

Mw: 1.0 x 10$^4$ (formulation weight ratio)

(Evaluation of Ink Repelling Treated Nozzle Plate (HP-13))

The characteristics were evaluated in the same manner as in Example 1. As a result, the Nozzle Plate (HP-13) exhibited good performances equal to or more than those in Example 2.

Further, the antistatic property and dust-attachment preventing property (dust-proof property) were evaluated.

With respect to the antistatic property, an electric field was applied under the electrostatic field; at the time of reaching a saturated potential, the charge was stopped; and a time from this moment until the charge voltage became 1/2 of the saturated voltage was measured. As a result, it was found to be 25 seconds.

Here, the behavior of the charge property was examined by allowing the sample to stand for 2 hours in an ambient at 25° C. and 65% RH and measuring it in the same ambient using Static Honestmeter Type-H0110 (manufactured by Shishido Electrostatic, Ltd.).

Also, the dust-attachment preventing property (dust-proof property) of the plate surface was examined in the following manner. As a result, the degree of dropping of artificial dusts was a level of "B".

Here, with respect to the dust-attachment preventing property (dust-proof property), the film to be measured was stuck onto a glass plate; after destaticization, the film was rubbed in the number of reciprocation of 5 times with Toraysee (manufactured by Toray Industries, Inc.); thereafter, fine expanded styrol powders were applied as artificial dusts onto the whole of the film; the film was made to stand; and the state of dropping of the artificial dusts was observed and evaluated according to the following standard of four grades.

A: Almost all of the artificial dusts drop.

B: 80% or more of the artificial dusts drop.

C: 50% or more of the artificial dusts drop.

D: 50% or more of the artificial dusts remain on the film surface.

In all of the evaluation methods, the antistatic property is good so that it is possible to reduce the attachment of dusts and paper powders within an actual recording device.

Example 14

One side of the polyimide sheet of the nozzle plate substrate used in Example 1 was subjected to a plasma treatment to form the following surface irregularities.

Ra:0.003 μm, Ra/Rz ratio:0.41, Ry:0.011 μm, Sm:0.12 μm

An ink repelling treated nozzle plate was obtained in the same manner as in Example 1, except for using the resulting plate. With respect to the resulting plate, performances were evaluated in the same manner as in Example 1. As a result, good results that are substantially the same as in Example 1 were obtained.

The present application claims foreign priority based on Japanese Patent Application No. JP-2003-332159 filed September 24 of 2003, the contents of which is incorporated herein by reference.

What is claimed is:

1. An inkjet recording head, which comprises a nozzle having: a hole for discharging a recording liquid including an ink; and a portion capable of repelling the ink at the periphery of the hole, wherein the portion comprises a cured film formed from a composition comprising a block copolymer, and the block copolymer is at least one of: a block copolymer comprising a unit A and a unit B; a block copolymer comprising the unit A, the unit B and the unit A in this order; and a comb block copolymer comprising the unit A as a main chain and the unit B as a side chain, wherein the unit A represents a block polymer (A) comprising a fluorine-containing polymer and a siloxane-containing polymer that comprises at least one of a group represented by formula (SI) and a group represented by formula (SII):

Formula (SI)

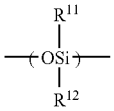

Formula (SII)

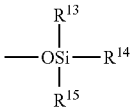

wherein $R^{11}$, $R^{12}$, $R^{13}$, $R^{14}$ and $R^{15}$ are the same or different and each represents an aliphatic group or an aromatic group; and the unit B represents a block polymer (B) comprising a polyester polymer, wherein the fluorine-containing polymer comprises at least one of a polymeric unit represented by formula (FI), a polymeric unit represented by formula (FII) and a polymeric unit represented by formula (FIII):

Formula (FI)

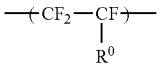

wherein $R^0$ represents a perfluoroalkyl group having from 1 to 8 carbon atoms, or an $—OR_f^1$ group; and the $R_f^1$ group represents a fluorine-containing aliphatic group having from 1 to 30 carbon atoms, Formula (FII)

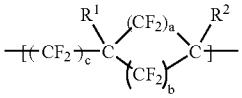

wherein $R^1$ and $R^2$ are the same or different and each represents a fluorine atom or a $—C_vF_{2v+1}$ group; v represents an integer of from 1 to 4; a represents 0 or 1; b represents an integer of from 2 to 5; and c represents 0 or 1, and Formula (FIII)

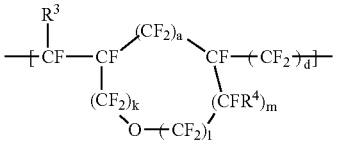

wherein $R^3$ and $R^4$ each represents a fluorine atom or a $—CF_3$ group; a represents the same as in formula (FII); d represents 0 or 1; k represents an integer of from 0 to 5; l represents an integer of from 0 to 4; m represents 0 or 1; and (k+l+m) represents an integer in the range of from 1 to 6.

2. The inkjet recording head according to claim 1, wherein the block copolymer has a reactive group, capable of contributing to crosslinking reaction, in at least one of a side chain substituent of the block polymer (A) and a main chain terminal of the block polymer (A); and the composition further comprises at least one of a curing agent and a curing accelerator.

3. The inkjet recording head according to claim 1, wherein the block polymer (B) comprises at least one ring structure selected from the group consisting of an alicyclic hydrocarbon ring and an aromatic ring.

4. The inkjet recording head according to claim 2, wherein the reactive group is at least one functional group selected from the group consisting of a radical polymerizable group, a cationic polymerizable group and a silyl group having a hydrolyzable substituent.

5. The inkjet recording head according to claim 1, wherein the block copolymer of the comb type is a copolymer of:

a monofunctional macromonomer which is a polyester polymer having a radical polymerizable group bonded to only one terminal of a main chain of the polyester polymer; and a radical polymerizable monomer.

6. The inkjet recording head according to claim 1, wherein the composition further comprises an inorganic particle having a mean particle size of not more than 100 nm.

7. The inkjet recording head according to claim 1, wherein the nozzle has an underlying surface coated by the composition, wherein the underlying surface has a surface irregularity based on JIS B0601-1994 such that:

an arithmetical mean roughness (Ra) is not more than 0.5 μm;

a ratio (Ra/Rz) of the arithmetical mean roughness (Ra) to a ten-point mean roughness (Rz) is 0.1 or more;

a maximum height (Ry) is not more than 0.5 μm; and a mean space of the surface irregularity (Sm) is from 0.005 to 1 μm.

8. The inkjet recording head according to claim 1, wherein the nozzle has an interlayer between the cured film and a substrate of the inkjet recording head.

9. The inkjet recording head according to claim 1, wherein the portion capable of repelling the ink satisfies a condition that after the portion has a saturated charge amount by applying to an electrostatic field, the period that the portion gets to have a half amount of the saturated charge amount is not longer than 60 seconds.

10. The inkjet recording head according to claim 1, wherein the portion capable of repelling the ink is on an outer surface of the nozzle.

11. An inkjet recording device, which comprises an inkjet recording head according to claim 1.

* * * * *